US006893810B1

(12) United States Patent
Sakai et al.

(10) Patent No.: US 6,893,810 B1
(45) Date of Patent: May 17, 2005

(54) SILVER HALIDE COLOR PHOTOGRAPHIC LIGHT-SENSITIVE MATERIAL FOR MOVIE

(75) Inventors: Hidekazu Sakai, Minami Ashigara (JP); Osamu Takahashi, Minami Ashigara (JP); Kiyohito Takada, Minami Ashigara (JP); Keizo Kimura, Minami Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/468,538

(22) Filed: Dec. 21, 1999

(30) Foreign Application Priority Data

Dec. 21, 1998 (JP) ..... 10-363002
Dec. 21, 1998 (JP) ..... 10-363003

(51) Int. Cl.[7] ..... G03C 1/00; G03C 7/38

(52) U.S. Cl. ..... 430/546; 430/551; 430/558; 430/637; 430/505; 430/934; 430/517

(58) Field of Search ..... 430/546, 551, 430/558, 637, 517, 505, 934

(56) References Cited

U.S. PATENT DOCUMENTS 4,006,025 A * 2/1977 Swank et al. ..... 96/520
4,474,872 A * 10/1984 Onishi et al. ..... 430/512
4,713,321 A * 12/1987 Mifune et al. ..... 430/569
5,273,866 A * 12/1993 Fujita et al. ..... 430/503
5,391,471 A * 2/1995 Ohshima et al. ..... 430/523
5,573,898 A * 11/1996 Sakai ..... 430/503
5,747,232 A * 5/1998 Anderson et al. ..... 430/514
5,962,207 A * 10/1999 Anderson et al. ..... 430/517

FOREIGN PATENT DOCUMENTS

EP 1139170 A2 * 10/2001 ..... G03C/7/38
EP 1193548 A2 * 4/2002 ..... G03C/7/38

OTHER PUBLICATIONS

Research Disclosure 17643, Section XVII. Dec. 1978.*

* cited by examiner

*Primary Examiner*—Amanda Walke
(74) *Attorney, Agent, or Firm*—Birch, Stewart, Kolasch & Birch, LLP

(57) ABSTRACT

A photographic material, comprising a support having thereon at least one yellow, cyan, and magenta color-forming light-sensitive silver halide emulsion layer, and at least one light-insensitive non-color forming hydrophilic colloid layer. At least one cyan emulsion layer contains a cyan dye-forming coupler [C-1] and at least one light-insensitive colloid layer exists between the support and a light-sensitive emulsion layer most adjacent thereto. Also, a photographic material, comprising a transparent support having thereon at least three kinds of light-sensitive hydrophilic colloid layers each containing any of yellow, magenta and cyan dye-forming couplers and containing silver halide grains different from each other in color sensitivity, and at least one light-insensitive hydrophilic colloid layer. Any layer contains a compound [XI], at least one colloid layer contains a solid fine particle dispersion of a dye [I], and said material has a film pH from 4.6 to 6.4.

24 Claims, No Drawings

SILVER HALIDE COLOR PHOTOGRAPHIC LIGHT-SENSITIVE MATERIAL FOR MOVIE

FIELD OF THE INVENTION

The present invention relates to a silver halide color photographic light-sensitive material for movie. In particular, the present invention relates to a silver halide color photographic light-sensitive material for movie, which is improved in the color reproducibility, sharpness and durability. More specifically, the present invention relates to a silver halide color photographic light-sensitive material for movie, which has high sharpness, is stable in the handling of light-sensitive material in a laboratory, in other words, stable against environment (temperature) at the exposure of light-sensitive material, and can simplify the processing step.

BACKGROUND OF THE INVENTION

Silver halide color light-sensitive materials used for the viewing, recording or storage of a dye image are always demanded to have higher image quality, and a large number of studies have been heretofore made thereon. For elevating the image quality of a silver halide color photographic light-sensitive material, a method of using an irradiation inhibiting dye or providing a colored layer to prevent halation, a method of reducing the thickness of hydrophilic colloid layer itself provided on a support to improve sharpness, a method of reducing the size of light-sensitive silver halide grains or controlling the shape of a dye cloud formed to improve the graininess, a method of employing a photographic coupler capable of giving a color-forming dye having excellent spectral absorption properties to improve color reproducibility, and a method of preventing unnecessary coloring of a support or a hydrophilic colloid layer provided thereon using the residual color of a dye or the like at the color development processing may be used. As a matter of importance, these functions must continue without varying depending on the conditions at the development processing or during storage.

In view of improvement of image quality, sharpness is particularly a very important property for silver halide color photographic light-sensitive materials which may be enlarged at the viewing or transfer to a material for viewing, such as color photographic light-sensitive material for photographing, or for silver halide color photographic light-sensitive materials conditioned on that an enlarged image is viewed, such as cinematic printing material.

Movies are projected through enlargement, accordingly, a light-sensitive material which is used in respective stages of photographing, cutting or projecting is demanded to have small graininess and high sharpness. Furthermore, in order to more effectively attain the special effect by the use of computer graphics in recent years, cinematic positive films are particularly demanded to have color reproducibility in higher saturation.

For the improvement of sharpness, it is generally effective to prevent halation or irradiation. To this purpose, a coloring agent such as dye is used. The coloring agent used to this effect is required to have the following capabilities:

(1) not to give chemically adverse effect on silver halide emulsion layers of a light-sensitive material, for example, not to cause change in sensitivity or fogging;

(2) to be completely decolorized during the photographic processing or be readily dissolved out from the photographic light-sensitive material not to leave unnecessary coloring on the material; and (3) to have proper spectral absorption according to the use purpose.

As the coloring means for preventing halation, a method of incorporating fine particle colloid silver into a specific light-insensitive hydrophilic colloid layer, a method of using a support having thereon a hydrophilic resin layer in which carbon fine particles are dispersed, and a method of incorporating a solid fine particle dispersion of a dye which is removable at the development processing, are known.

However, the method of incorporating fine particle colloid silver into a light-insensitive hydrophilic colloid layer cannot be used in principle in the system of recording information using silver produced by the development (for example, a black-and-white photographic light-sensitive material and a cinematic printing material having a sound track).

The method of using a support having a hydrophilic resin layer where carbon fine particles are dispersed is disadvantageous in that an exclusive bath must be provided so as to remove the resin layer at the development processing and this increase in the number of steps necessary for the color development contradicts to the nowadays trend toward simplified photographic processing. Furthermore, a large amount of washing water contaminated with carbon is discharged and this is not preferred in view of water saving and environmental conservation.

For the purpose of solving these problems, some methods of selectively coloring a specific hydrophilic colloid layer have been proposed. Examples of the method include a method of allowing a hydrophilic polymer containing a moiety having a charge opposite to the dye ion to be present together in a hydrophilic colloid layer so as to prevent diffusion of a dye described in JP-A-50-65230 (the term "JP-A" as used herein means an "unexamined Japanese patent application"), and a method of anchoring a dye in the solid dispersion state to a specific hydrophilic colloid layer described in JP-A-56-12639, JP-A-55-155350, JP-A-55-155351, JP-A-55-92716, JP-A-63-197943, JP-A-63-27838, JP-A-64-40827, EP-A-15601, EP-A-276566 and International Patent Publication No. 88-04794.

The method of using a solid fine particle dispersion of a dye which is removable at the development processing is an excellent method because the tone of colored layer can be controlled, both the sharpness of a dye image, as a target to attain, and the sensitivity can be obtained, and the method can be applied to cinematic positive film where a sound track is formed using silver produced by the development.

However, even in these methods, when a dye is added in an amount necessary for improving the sharpness, the dissolving out rate (i.e., the eluting rate) of the dye at the photographic processing inevitably decreases and it is difficult to attain both the sharpness and the reduction in white background coloration, which are important properties for the image quality. To solve this problem, investigations have been made for dyes having a tendency to keep the solid dispersion state in a hydrophilic colloid layer and capable of readily decolorizing or dissolving out at the processing, and dyes described, for example, in JP-A-2-282244 have been proposed.

With respect to the prevention of irradiation, a coloring method using a water-soluble dye is known. Examples of the dye include oxonol dyes described in U.S. Pat. No. 4,078,933, azo dyes, anthraquinone dyes, arylidene dyes, styryl dyes, triarylmethane dyes, merocyanine dyes and cyanine dyes.

However, in preventing halation by introducing a solid dispersion of a dye and preventing irradiation using a water-soluble dye, when a dye is added in an amount necessary for improving the sharpness, the dissolving out rate of the dye at the photographic processing inevitably decreases and it is difficult to attain both the sharpness and the reduction in white background coloration, which are important properties for the image quality.

These problems can be solved, as generally known, by reducing the thickness of a hydrophilic colloid layer itself provided on a support. More specifically, when the thickness is reduced, the dye can be readily dissolved out at the processing and a comparable effect of preventing irradiation can be obtained with a small amount of anti-irradiation dye.

As a result of progress in the projection technique in recent years, a stable and bright light source can be used at the projection. Therefore, the cinematic color positive film is required to have broader dynamic range, namely, higher color density. In order to realize the higher color density, a larger amount of silver halide emulsion or coupler must be introduced into a hydrophilic colloid layer and the design necessary therefor naturally contradicts the above-described reduction in the layer thickness. Accordingly, new means for obtaining higher color density with the same use amount is necessary.

As is well known, in a silver halide color photographic light-sensitive material, an aromatic primary amine color developing agent is oxidized using exposed silver halide and reacts with a coupler to provide a dye such as indophenol, indoaniline, indamine, azomethine, phenoxazine, phenazine or the like, thereby forming an image. In this photographic system, a subtractive color process is known and a color image is formed by yellow, magenta and cyan dyes.

For forming a cyan dye image, phenol or naphthol-base couplers have been heretofore used. However, the dyes formed from these couplers have disadvantageous absorption in the region of from yellow to magenta, as a result, the saturation is low and the molecular absorption coefficient is also low. Therefore, a large amount of coupler must be used for obtaining a necessary density.

In order to improve the hue of cyan image, heterocyclic compounds described in U.S. Pat. Nos. 4,728,598 and 4,873,183, and EP-A-0249453 have been proposed. However, these couplers have fatal defects such that the coupling activity is low or the dye formed has poor fastness.

As the coupler capable of overcoming these problems, pyrrolotriazole couplers described in U.S. Pat. No. 5,256,526 and EP-A-0545300 have been proposed.

The cinematic color positive film is repeatedly used by a motion picture projector in many cases and is required to have physical durability. In particular, red dotted failure called red spot failure resulting from lubricating oil of the projector entering into flaws generated in a hydrophilic colloid layer having a dye image and occurring on extracting the color-forming dye out of the film is a serious problem for the image quality.

After extensive studies, the present inventors have found pyrrolotriazole coupler is preferred as the cyan coupler and therefore, various investigations have been further made on silver halide color photographic light-sensitive materials having introduced thereinto a pyrrolotriazole coupler having excellent properties. However the fact found there was that the extraction of cyan color-forming dye out of the film (so-called red spot failure) due to entering of lubricating oil of the projector is more serious than conventional.

To cope with the demand for simple and rapid processing of a transparent color photographic light-sensitive material, particularly of a cinematic color film, the present inventors have manufactured a silver halide color photographic light-sensitive material using a solid fine particle dispersion of a dye having excellent suitability for removal at the development processing and high sharpness, where the dye is subjected to a heat treatment at 40° C. or more.

However, after studies in particular from the practical standpoint, this silver halide color photographic light-sensitive material is found to have a serious problem. That is, when the exposure conditions are actually adjusted in the morning in a laboratory to give a neutral gray and a sample aged for a relatively long time after the coating is exposed in the daytime under the same conditions, there arises a problem that the gray coloration is shifted. This is a critical problem for the improvement of productivity in a laboratory and for the stable maintenance of quality. Accordingly, the present inventors have further made extensive investigations on this matter. As a result, the following facts are found out.

Samples aged long after the coating is large in the temperature dependency at the exposure, particularly, undergoes great fluctuation in the sensitivity to yellow and cyan. More specifically, when the exposure conditions are adjusted to a neutral gray at a low temperature, particularly in the morning of winter season, and the sample is exposed under the same conditions in the daytime at an elevated temperature, there occurs a phenomenon such that yellow and cyan are sensitized and gray shifted to green tint results.

These problems do not arise when the above-described solid dye dispersion is not used. In other words, these problems are peculiar to the case where the above-described solid dye dispersion ensuring simple processability is used.

SUMMARY OF THE INVENTION

Accordingly, a first object of the present invention is to provide a silver halide color photographic light-sensitive material for movie, having good image quality.

A second object of the present invention is to provide a silver halide color photographic light-sensitive material for movie, having color reproducibility of high saturation and also having excellent durability.

A third object of the present invention is to provide a silver halide color photographic light-sensitive material for movie, satisfied in the sharpness and the color forming density region and reduced in the staining of white background.

A fourth object of the present invention is to provide a silver halide color photographic light-sensitive material, having high sharpness, being stable in handling of the light-sensitive material at a laboratory, namely, stable against environment (temperature) at the exposure of the light-sensitive material, and ensuring simple processing.

As a result of extensive investigations, the present inventors have found that the above-described objects can be attained by the means described below:

(1) a silver halide color photographic light-sensitive material for movie, comprising a support having thereon at least one yellow color-forming light-sensitive silver halide emulsion layer, at least one cyan color-forming light-sensitive silver halide emulsion layer, at least one magenta color-forming light-sensitive silver halide emulsion layer, and at least one light-insensitive non-color forming hydrophilic colloid layer, wherein at least one cyan color-forming silver halide emulsion layer contains at least one cyan dye-forming coupler selected from the compounds represented by the following formula [C-1] and at least one light-insensitive non-color forming hydrophilic colloid layer is positioned between the support and a light-sensitive silver halide emulsion layer most adjacent to the support:

[C-1]

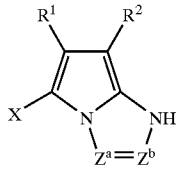

wherein $Z^a$ and $Z^b$ each represents —C($R^3$)═ or —N═, provided that either one of $Z^a$ and $Z^b$ is —N═ and another is —C($R^3$)═, $R^1$ and $R^2$ each represents an electron attractive group having a Hammett's substituent constant $\sigma_p$ value of from 0.20 or more, provided that the sum of $\sigma_p$ values of $R^1$ and $R^2$ is 0.65 or more, $R^3$ represents hydrogen atom or a substituent, X represents hydrogen atom or a group capable of splitting off upon coupling reaction with an oxidation product of an aromatic primary amine color developing agent, and the group represented by $R^1$, $R^2$, $R^3$ or X may assume a divalent group and combine with a divalent or greater polymer or a polymer chain to form a homopolymer or a copolymer; and (2) a silver halide color photographic light-sensitive material for movie, comprising a transparent support having thereon at least three kinds of light-sensitive hydrophilic colloid layers each containing any one of yellow, magenta and cyan dye-forming couplers and containing silver halide emulsion grains different from each other in the color sensitivity, and at least one light-insensitive hydrophilic colloid layer, wherein any one layer contains at least one compound represented by formula [XI], at least one light-insensitive hydrophilic colloid layer contains a solid fine particle dispersion of a dye represented by formula [I], and the silver halide color photographic light-sensitive material has a film pH of from 4.6 to 6.4:

[XI]

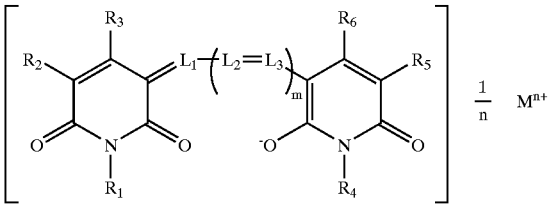

wherein $R_1$ and $R_4$ each independently represents hydrogen atom, an aliphatic group, an aromatic group, a heterocyclic group, —$NR_7R_8$, —$NR_7CONR_7R_8$, —$NR_8COR_9$ or —$NR_8SO_2R_9$, $R_2$ and $R_5$ each independently represents hydrogen atom, an aliphatic group, an aromatic group, a heterocyclic group, a cyano group, a sulfo group, —$NR_7R_8$, —$NR_8COR_9$, —$NR_7CONR_7R_8$, —$CO_2R_7$, $CONR_7R_8$, —$COR_9$, —$SO_2R_9$ or —$SO_2NR_7R_8$, $R_3$ and $R_4$ each independently represents a hydrogen atom, an aliphatic group, an aromatic group, —$OR_7$, —$CO_2R_7$, —$COR_9$, —$CONR_7R_8$, —$NR_7R_8$, —$NR_8COR_9$, —$NR_8SO_2R_9$, —$NR_7CONR_7R_8$, —$SO_2R_9$, —$SO_2NR_7R_8$ or a cyano group (wherein $R_7$ and $R_8$ each independently represents hydrogen atom, an aliphatic group or an aromatic group, $R_9$ represents an aliphatic group or an aromatic group, $R_7$ and $R_8$ or $R_8$ and $R_9$ may be combined with each other to form a 5- or 6-membered ring), $L_1$, $L_2$ and $L_3$ each independently represents a methine group, m represents 0, 1 or 2, $M^{n+}$ represents a n-valence cation, and n represents 1, 2 or 3:

$$D—(X)_y \qquad [I]$$

wherein D represents a compound residue having a chromophore, X represents a dissociative hydrogen atom or a group having a dissociative hydrogen atom, and y represents an integer of from 1 to 7.

The present invention and preferred embodiments thereof are described below.

(1) A silver halide color photographic light-sensitive material for movie, comprising a support having thereon at least one yellow color-forming light-sensitive silver halide emulsion layer, at least one cyan color-forming light-sensitive silver halide emulsion layer, at least one magenta color-forming light-sensitive silver halide emulsion layer, and at least one light-insensitive non-color forming hydrophilic colloid layer, wherein at least one cyan color-forming silver halide emulsion layer contains at least one cyan dye-forming coupler selected from the compounds represented by the following formula [C-1] and at least one light-insensitive non-color forming hydrophilic colloid layer is positioned between the support and a light-sensitive silver halide emulsion layer most adjacent to the support:

[C-1]

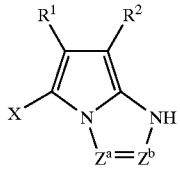

wherein $Z^a$ and $Z^b$ each represents —C($R^3$)═ or —N═, provided that either one of $Z^a$ and $Z^b$ is —N═ and another is —C($R^3$)═, $R^1$ and $R^2$ each represents an electron attractive group having a Hammett's substituent constant op value of from 0.20 or more, provided that the sum of $\sigma_p$ values of $R^1$ and $R^2$ is 0.65 or more, $R^3$ represents hydrogen atom or a substituent, X represents hydrogen atom or a group capable of splitting off upon coupling reaction with an oxidation product of an aromatic primary amine color developing agent, and the group represented by $R^1$, $R^2$, $R^3$ or X may assume a divalent group and combine with a divalent or greater polymer or a polymer chain to form a homopolymer or a copolymer.

(2) The silver halide color photographic material for movie as claimed in claim 1, wherein the cyan dye-forming coupler represented by formula [C-1] is a compound represented by formula [C-2]:

[C-2]

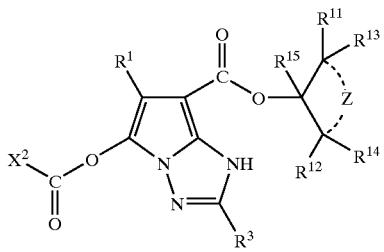

wherein $R^{11}$, $R^{12}$, $R^{13}$, $R^{14}$ and $R^{15}$, which may be the same or different, each represents hydrogen atom or a substituent, $R^3$ represents hydrogen atom or a substituent, and $X^2$ represents hydrogen atom or a substituent;

(3) the silver halide color photographic light-sensitive material for movie as described in (1) above, wherein at least one non-color forming hydrophilic colloid layer positioned between the support and a light-sensitive silver halide emulsion layer most adjacent to the support contains a solid fine particle dispersion of a dye represented by formula [I]:

$$D—(X)_y \qquad [I]$$

wherein D represents a compound residue having a chromophore, X represents a dissociative hydrogen atom or a group having a dissociative hydrogen atom, and y represents an integer of from 1 to 7.

(4) The silver halide color photographic light-sensitive material for movie as described in (3) above, wherein the dye is represented by formula [II] or [III]:

$$a^1{=}L^1—(L^2{=}L^3)_n—Q \qquad [II]$$

wherein $A^1$ represents an acidic nucleus, Q represents an aryl group or a heterocyclic group, $L^1$, $L^2$ and $L^3$ each represents a methine group, and m represents 0, 1 or 2, provided that the compound represented by formula [II] has from 1 to 7 groups selected from the group consisting of a carboxylic acid group, a sulfonamide group, a sulfamoyl group, a sulfonylcarbamoyl group, an acylsulfamoyl group, a phenolic hydroxyl group and an enol group of an oxonol dye, within the molecule;

$$a^1{=}L^1—(L^2{=}L^3)_n—A^2 \qquad [III]$$

wherein $A^1$ and $A^2$ each represents an acidic nucleus, $L^1$, $L^2$ and $L^3$ each represents a methine group, and n represents 1 or 2, provided that the compound represented by formula [III] has from 1 to 7 groups selected from the group consisting of a carboxylic acid group, a sulfonamide group, a sulfamoyl group, a sulfonylcarbamoyl group, an acylsulfamoyl group, a phenolic hydroxyl group and an enol group of an oxonol dye, within the molecule.

(5) The silver halide color photographic light-sensitive material for movie as described in (3), wherein the solid fine particle dispersion of a dye represented by formula [I] is dispersed using a dispersion aid represented by formula [V-a] or [V-b]:

[V-a]

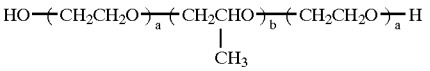

[V-b]

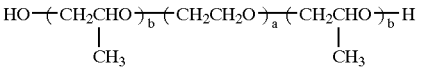

wherein a and be each is a number of from 5 to 500.

(6) The silver halide color photographic light-sensitive material for movie as described in (3) above, wherein fine particles in the solid dispersion of a dye represented by formula [I] have an average particle size of from 0.005 to 10 $\mu$m.

(7) The silver halide color photographic light-sensitive material for movie as described in (3) above, wherein the solid fine particle dispersion of a dye represented by formula [I] is a solid fine particle dispersion of a dye represented by formula [III];

(8) The silver halide color photographic light-sensitive material for movie as described in (3) above, wherein the non-color forming hydrophilic colloid layer containing the solid fine particle dispersion of a dye has a dye content of from 5 to 30 wt % based on the hydrophilic colloid.

(9) The silver halide color photographic light-sensitive material for movie as described in (3) above, wherein the solid fine particle dispersion of a dye is prepared through a heat treatment step at 40° C. or more.

(10) A silver halide color photographic light-sensitive material for movie, comprising a transparent support having thereon at least three kinds of light-sensitive hydrophilic colloid layers each containing any one of yellow, magenta and cyan dye-forming couplers and containing silver halide emulsion grains different from each other in the color sensitivity, and at least one light-insensitive hydrophilic colloid layer, wherein any one layer contains at least one compound represented by formula [XI], at least one light-insensitive hydrophilic colloid layer contains a solid fine particle dispersion of a dye represented by formula [I], and the silver halide color photographic light-sensitive material has a film pH of from 4.6 to 6.4:

[XI]

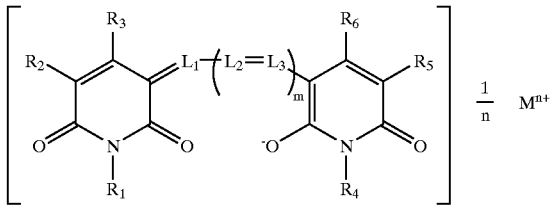

wherein $R_1$ and $R_4$ each independently represents hydrogen atom, an aliphatic group, an aromatic group, a heterocyclic group, $—NR_7R_8$, $—NR_7CONR_7R_8$, $—NR_8COR_9$ or $—NR_8SO_2R_9$, $R_2$ and $R_5$ each independently represents hydrogen atom, an aliphatic group, an aromatic group, a heterocyclic group, a cyano group, a sulfo group, $—NR_7R_8$, $—NR_8COR_9$, $—NR_8SO_2R_9$, $—NR_7CONR_7R_8$, $—CO_2R_7$, $—CONR_7R_8$, $—COR_9$, $—SO_2R_9$ or $—SO_2NR_7R_8$, $R_3$ and $R_6$ each independently represents a hydrogen atom, an aliphatic group, an aromatic group, $—OR_7$, $—CO_2R_7$, $—COR_9$, $—CONR_7R_8$, $—NR_7R_8$, $—NR_8COR_9$, $—NR_8SO_2R_9$, $—NR_7CONR_7R_8$, $—SO_2R_9$, $—SO_2NR_7R_8$ or a cyano group (wherein $R_7$ and $R_8$ each independently represents hydrogen atom, an aliphatic group or an aromatic group, $R_9$ represents an aliphatic group or an aromatic group, $R_7$ and $R_8$ or $R_8$ and $R_9$ may be combined with each other to form a 5- or 6-membered ring), $L_1$, $L_2$ and $L_3$ each independently represents a methine group, m represents 0, 1 or 2, $Mn^+$ represents a n-valence cation, and n represents 1, 2 or 3:

$$D—(X)_y \qquad [I]$$

wherein D represents a compound residue having a chromophore, X represents a dissociative hydrogen atom or a group having a dissociative hydrogen atom, and y represents an integer of from 1 to 7.

(11) The silver halide color photographic light-sensitive material for movie as described in (10) above, wherein the solid fine particle dispersion of a dye is prepared through a heat treatment step at 40° C. or more.

(12) The silver halide color photographic light-sensitive material for movie as described in (10) above, wherein in formula [XI], $R_1$ and $R_4$ each represents a group having at least one sulfo group or carboxy group, $R_2$ and $R_5$ each represents a cyano group or a substituted or unsubstituted carbamoyl group, and $R_3$ and $R_6$ each represents an aliphatic group or an aromatic group.

(13) The silver halide color photographic light-sensitive material for movie as described in (10) above, wherein at least one cyan dye-forming coupler is represented by formula [C-1]:

[C-1]

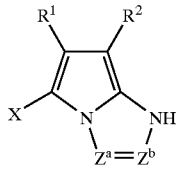

wherein $Z^a$ and $Z^b$ each represents —C($R^3$)=or —N=, provided that either one of $Z^a$ and $Z^b$ is —N=and another is —C($R^3$)=, $R^1$ and $R^2$ each independently represents an electron attractive group having a Hammett's substituent constant $\sigma_p$ value of from 0.20 or more, provided that the sum of $\sigma_p$ values of $R^1$ and $R^2$ is 0.65 or more, $R^3$ represents hydrogen atom or a substituent, X represents hydrogen atom or a group capable of splitting off upon coupling reaction with an oxidation product of an aromatic primary amine color developing agent, and the group represented by $R^1$, $R^2$, $R^3$ or X may assume a divalent group and combine with a divalent or greater polymer or a polymer chain to form a homopolymer or a copolymer.

(14) The silver halide color photographic light-sensitive material for movie as described in (13) above, wherein the cyan dye-forming coupler represented by formula [C-1] is represented by formula [C-2]:

[C-2]

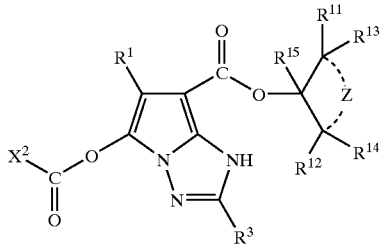

wherein $R^{11}$, $R^{12}$, $R^{13}$, $R^{14}$ and $R^{15}$, which may be the same or different, each represents hydrogen atom or a substituent, $R^3$ represents hydrogen atom or a substituent, and $X^2$ represents hydrogen atom or a substituent.

(15) The silver halide color photographic light-sensitive material for movie as described in (10) above, wherein the amount of the compound represented by formula [XI] used is in terms of the optical density from 0.05 to 30.

(16) The silver halide color photographic light-sensitive material for movie as described in (10) above, wherein the solid fine particle dispersion of a dye represented by formula [I] is a solid fine particle dispersion of a dye represented by formula [II] or [III]:

$$A^1{=}L^1{-}(L^2{=}L^3)_m{-}Q \qquad [II]$$

wherein $A^1$ represents an acidic nucleus, Q represents an aryl group or a heterocyclic group, $L^1$, $L^2$ and $L^3$ each represents a methine group, and m represents 0, 1 or 2, provided that the compound represented by formula [II] has from 1 to 7 groups selected from the group consisting of a carboxylic acid group, a sulfonamide group, a sulfamoyl group, a sulfonylcarbamoyl group, an acylsulfamoyl group, a phenolic hydroxyl group and an enol group of an oxonol dye, within the molecule;

$$A^1{=}L^1{-}(L^2{=}L^3)_n{-}A^2 \qquad [III]$$

wherein $A^1$ and $A^2$ each represents an acidic nucleus, $L^1$, $L^2$ and $L^3$ each represents a methine group, and n represents 1 or 2, provided that the compound represented by formula [III] has from 1 to 7 groups selected from the group consisting of a carboxylic acid group, a sulfonamide group, a sulfamoyl group, a sulfonylcarbamoyl group, an acylsulfamoyl group, a phenolic hydroxyl group and an enol group of an oxonol dye, within the molecule.

(17) The silver halide color photographic light-sensitive material for movie as described in (10) above, wherein the solid fine particle dispersion of a dye represented by formula [I] is a solid fine particle dispersion of a dye represented by formula [IV]:

[IV]

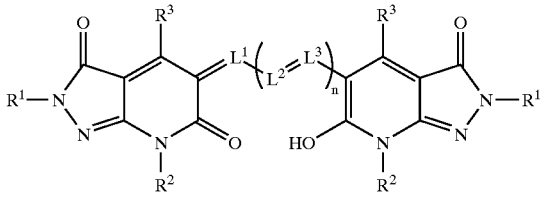

wherein $R^1$ represents hydrogen atom, an alkyl group, an aryl group or a heterocyclic group, $R^2$ represents hydrogen atom, an alkyl group, an aryl group, a heterocyclic group, —$COR^4$ or —$SO_2R^4$, $R^3$ represents hydrogen atom, a cyano group, a hydroxyl group, a carboxyl group, an alkyl group, an aryl group, —$CO_2R^4$, —$OR^4$, —$NR^5R^6$, —$CONR^5R^6$, —$NR^5COR^4$, —$NR^5SO_2R^4$ or —$NR^5CONR^5R^6$ (wherein $R^4$ represents an alkyl group or an aryl group, and $R^5$ and $R^6$ each represents hydrogen atom, an alkyl group or an aryl group), $L^1$, $L^2$ and $L^3$ each represents a methine group, and n represents 1 or 2.

(18) The silver halide color photographic light-sensitive material for movie as described in (10) above, wherein the solid fine particle dispersion of a dye represented by formula [I] is dispersed using a dispersion aid represented by formula [V-a] or [V-b]:

[V-a]

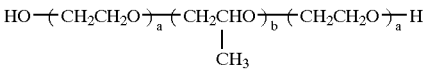

[V-b]

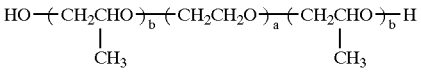

wherein a and b each is a number of from 5 to 500.

(19) The silver halide color photographic light-sensitive material for movie as described in (10) above, wherein fine particles in the solid dispersion of a dye represented by formula [I] have an average particle size of from 0.005 to 10 $\mu$m.

(20) The silver halide color photographic light-sensitive material for movie as described in (13) above, wherein the halogen composition of all silver halide emulsion grains contained is silver chlorobromide, silver chloroiodide, silver chloroiodobromide or silver chloride, having a silver chloride content of 90 mol % or more.

DETAILED DESCRIPTION OF THE INVENTION

The present invention is described in detail below.

The Hammett's substituent constant $\sigma_p$ value used herein is described below. The Hammett's rule is an empirical rule proposed by L. P. Hammett in 1935 in order to quantitatively examine the effect of substituents on the reaction or equilibrium of a benzene derivative, and its propriety is widely admitted at present. The substituent constant obtained by the Hammett's rule includes $\sigma_p$ value and $\sigma_m$ value and these values are described in many publications, for example, J. A. Dean (compiler) *Lange's Handbook of Chemistry*, 12th ed., McGraw Hill (1979) and *Kagaku no Ryoiki* (*Zokan*) (*Chemical Region* (*Extra*)), Vol. 122, pages 96 to 103, Nankodo (1979) describe thereon in detail. In the present invention, the substituents are sometimes specified or described using the Hammett's substituent constant $\sigma_p$ value, however, it should be noted that these substituents are by no means limited to the substituents of which values are already known and described in publications. As a matter of course, the substituents include those having a Hammett's substituent constant $\sigma_p$ value within the specified range even if the value is first determined based on the Hammett's rule but not known in the publications. The compound represented by formula [C-1] of the present invention is not a benzene derivative, however, the $\sigma_p$ value is used as a measure for indicating the electron effect of substituents irrespective of the substitution position. In the present invention, the $\sigma_p$ value is hereinafter used in this meaning. The term "lipophilic" as used in the present invention means that the solubility in water at room temperature is 10% or less.

In the present invention, the aliphatic group may be linear, branched or cyclic, or saturated or unsaturated. The aliphatic group means, for example, alkyl, alkenyl, alkynyl, cycloalkyl or cycloalkenyl, and may have a substituent. The aromatic group means an aryl group and may have a substituent. The heterocyclic group means a ring having therein a hetero atom, including an aromatic heterocyclic group, and the heterocyclic group may have a substituent. Unless otherwise indicated, the substituents in the present invention and the substituents of the aliphatic, aromatic or heterocyclic group may be any as long as it can substitute. Examples thereof include an aliphatic group, an aromatic group, a heterocyclic group, an acyl group, an acyloxy group, an acylamino group, an aliphatic oxy group, an aromatic oxy group, a heterocyclic oxy group, an aliphatic oxycarbonyl group, an aromatic oxycarbonyl group, a heterocyclic oxycarbonyl group, an aliphatic carbamoyl group, an aromatic carbamoyl group, an aliphatic sulfonyl group, an aromatic sulfonyl group, an aliphatic sulfamoyl group, an aromatic sulfamoyl group, an aliphatic sulfonamido group, an aromatic sulfonamido group, an aliphatic amino group, an aromatic amino group, an aliphatic sulfinyl group, an aromatic sulfinyl group, an aliphatic thio group, an aromatic thio group, a mercapto group, a hydroxy group, a cyano group, a nitro group, a hydroxyamino group and a halogen atom.

The cyan coupler represented by formula [C-1] for use in the present invention is described in detail below.

$Z^a$ and $Z^{Ab}$ each represents —C($R^3$)═ or —N═, provided that either one of $Z^a$ and $Z^b$ is —N═ and another is —C($R^3$)═.

$R^3$ represents hydrogen atom or a substituent. Examples of the substituent include a halogen atom, an alkyl group, an aryl group, a heterocyclic group, a cyano group, a hydroxy group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group and an acyl group. These groups each may be further substituted by a substituent described above as the substituent for $R^3$.

More specifically, $R^3$ represents hydrogen atom, a halogen atom (e.g., chlorine, bromine), an alkyl group (for example, a linear or branched alkyl group having from 1 to 32 carbon atoms, an aralkyl group, an alkenyl group, an alkynyl group, a cycloalkyl group or a cycloalkenyl group; e.g., methyl, ethyl, propyl, isopropyl, tert-butyl, tridecyl, 2-methanesulfonylethyl, 3-(3-pentadecylphenoxy)propyl, 3-{4-{2-[4-(4-hydroxyphenylsulfonyl)phenoxy] dodecanamido}phenyl}-propyl, 2-ethoxytridecyl, trifluoromethyl, cyclopentyl, 3-(2,4-di-tert-amylphenoxy) propyl), an aryl group (e.g., phenyl, 4-tert-butylphenyl, 2,4-di-tert-amylphenyl, 4-tetradecanamidophenyl), a heterocyclic group (e.g., imidazolyl, pyrazolyl, triazolyl, 2-furyl, 2-thienyl, 2-pyrimidinyl, or 2-benzothiazolyl), a cyano group, a hydroxy group, a nitro group, a carboxy group, an amino group, an alkoxy group (e.g., methoxy, ethoxy, 2-methoxyethoxy, 2-dodecylethoxy, 2-methanesulfonylethoxy), an aryloxy group (e.g., phenoxy, 2-methylphenoxy, 4-tert-butylphenoxy, 3-nitrophenoxy, 3-tert-butyloxycarbamoylphenoxy, or 3-methoxycarbamoylphenoxy), an acylamino group (e.g., acetamido, benzamido, tetradecanamido, 2-(2,4-di-tert-amylphenoxy)-butanamido, 4-(3-tert-butyl-4-hydroxyphenoxy) butanamido, 2-{4-(4-hydroxyphenylsulfonyl)phenoxy] decanamido), an alkyl-amino group (e.g., methylamino, butylamino, dodecylamino, diethylamino, methylbutylamino), an anilino group (e.g., phenylamino, 2-chloroanilino, 2-chloro-5-tetradecanamino-anilino, 2-chloro-5-dodecyloxycarbonylanilino, N-acetyl-anilino, 2-chloro-5-{2-(3-tert-butyl-4-hydroxyphenoxy)-dodecanamido]anilino), a ureido group (e.g., phenylureido, methylureido, N,N-dibutylureido), a sulfamoylamino group (e.g., N,N-dipropylsulfamoylamino, N-methyl-N-decylsulfamoylamino), an alkylthio group (e.g., methylthio, octylthio, tetradecylthio, 2-phenoxyethylthio, 3-phenoxypropylthio, 3-(4-tert-butylphenoxy)propylthio), an arylthio group (e.g., phenylthio, 2-butoxy-5-tert-octylphenylthio, 3-pentadecylphenylthio, 2-carboxyphenylthio, 4-tetradecanamidophenylthio), an alkoxycarbonylamino group (e.g., methoxycarbonylamino, tetradecyloxycarbonylamino), a sulfonamido group (e.g., methanesulfonamido, hexadecane-sulfonamido, benzenesulfonamido, p-toluenesulfonamido, octadecanesulfonamido, 2-methoxy-5-tert-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, N-{3-(2,4-di-tert-amylphenoxy)-propyl}carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a sulfonyl group (e.g., methanesulfonyl, octanesulfonyl, benzene-sulfonyl, toluenesulfonyl), an alkoxycarbonyl group (e.g., methoxycarbonyl, butoxycarbonyl, dodecyloxycarbonyl, octadecyloxycarbonyl), a heterocyclic oxy group (e.g., 1-phenyltetrazolyl-5-oxy, 2-tetrahydropyranyloxy), an azo group (e.g., phenylazo, 4-methoxyphenylazo, 4-pivaloylaminophenylazo, 2-hydroxy-4-propanoylphenylazo), an acyloxy group (e.g., acetoxy), a carbamoyloxy group (e.g., N-methylcarbamoyloxy, N-phenylcarbamoyloxy), a silyloxy group (e.g., trimethylsilyloxy, dibutylmethylsilyloxy), an aryloxycarbonylamino group (e.g., phenoxycarbonylamino), an imido group (e.g., N-succinimido, N-phthalimido, 3-octadecenylsuccinimido), a heterocyclic thio group (e.g., 2-benzothiazolylthio, 2,4-diphenoxy-1,3,5-triazolyl-6-thio, 2-pyridylthio), a sulfinyl group (e.g., dodecanesulfinyl, 3-pentadecylphenylsufinyl, 3-phenoxypropylsulfinyl), a phosphonyl group (e.g., phenoxyphosphonyl, octyloxy-phosphonyl, phenylphosphonyl), an aryloxycarbonyl group (e.g., phenoxycarbonyl) or an acyl group (e.g., acetyl, 3-phenylpropanoyl, benzoyl, 4-dodecyloxybenzoyl).

$R^3$ is preferably an alkyl group, an aryl group, a heterocyclic group, a cyano group, a nitro group, an acylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an acyloxy group, a carbamoyloxy group, an aryloxycarbonylamino group, an imido group, a heterocyclic thio group, a sulfinyl group, a phosphonyl group, an aryloxycarbonyl group or an acyl group.

$R^3$ is more preferably an alkyl group or an aryl group. In view of cohesion, $R^3$ is more preferably an alkyl group or aryl group having at least one substituent, still more preferably an alkyl group or aryl group having at least one alkyl group, alkoxy group, sulfonyl group, sulfamoyl group, carbamoyl group, acylamido group or sulfonamido group as a substituent, and particularly preferably an alkyl group or aryl group having at least one alkyl group, acylamido group or sulfonamido group as a substituent. When the aryl group has a substituent as described above, the substituent is preferably present at least at the ortho or para position.

The cyan coupler for use in the present invention forms a color of cyan image when $R^1$ and $R^2$ each is an electron attractive group having a Hammett's substituent constant $\sigma_p$ value of 0.20 or more and the sum of the $\sigma_p$ values of $R^1$ and $R^2$ is 0.65 or more. The sum of the $\sigma_p$ values of $R^1$ and $R^2$ is preferably 0.70 or more, with the upper limit of about 2.0.

$R^1$ and $R^2$ each represents an electron attractive group having a Hammett's substituent constant $\sigma_p$ value of 0.20 or more, preferably 0.30 or more, with the upper limit of 1.0 or less.

Examples of the electron attractive group having a $\sigma_p$ value of 0.20 or more represented by $R^1$ or $R^2$ include an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenated alkyl group, a halogenated alkoxy group, a halogenated aryloxy group, a halogenated alkylamino group, a halogenated alkylthio group, an aryl group substituted with an electron attractive group having a up value of 0.20 or more, a heterocyclic group, a halogen atom, an azo group and a selenocyanate group. Of these substituents, the groups capable of having a substituent may further have a substituent described above as the substituent for $R^3$.

More specifically, examples of the electron attractive group having a $\sigma_p$ value of 0.20 or more represented by $R^1$ or $R^2$ include an acyl group (e.g., acetyl, 3-phenylpropanoyl, benzoyl, 4-dodecyloxybenzoyl), an acyloxy group (e.g., acetoxy), a carbamoyl group (e.g., carbamoyl, N-ethylcarbamoyl, N-phenylcarbamoyl, N,N-dibutylcarbamoyl, N-(2-dodecyloxyethyl)carbamoyl, N-(4-n-pentadecanamido)phenyl-carbamoyl, N-methyl-N-dodecylcarbamoyl, N-{3-(2,4-di-tert-amylphenoxy)propyl}carbamoyl), an alkoxycarbonyl group (e.g., methoxycarbonyl, ethoxycarbonyl, isopropyloxycarbonyl, tert-butyloxycarbonyl, isobutyloxycarbonyl, butyloxycarbonyl, dodecyloxycarbonyl, octadecyloxycarbonyl), an aryloxy-carbonyl group (e.g., phenoxycarbonyl), a cyano group, a nitro group, a dialkylphosphono group (e.g., dimethyl-phosphono), a diarylposphono group (e.g., diphenylphosphono), a diarylphosphinyl group (e.g., diphenylphosphinyl), an alkylsulfinyl group (e.g., 3-phenoxypropylsulfinyl), an arylsulfinyl group (e.g., 3-pentadecylphenylsulfinyl), an alkylsulfonyl group (e.g., methanesulfonyl, octanesulfonyl), an arylsulfonyl group (e.g., benzenesulfonyl, toluene-sulfonyl), a sulfonyloxy group (e.g., methanesulfonyloxy, toluenesulfonyloxy), an acylthio group (e.g., acetylthio, benzoylthio), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a thio-cyanate group, a thiocarbonyl group (e.g., methylthio-carbonyl, phenylthiocarbonyl), a halogenated alkyl group (e.g., trifluoromethyl, heptafluoropropyl), a halogenated alkoxy group (e.g., trifluoromethoxy), a halogenated aryloxy group (e.g., pentafluorophenoxy), a halogenated alkylamino group (e.g., N,N-di-(trifluoromethyl)amino), a halogenated alkylthio group (e.g., difluoromethylthio, 1,1,2,2-tetrafluoroethylthio), an aryl group substituted with an electron attractive group having a $\sigma_p$ value of 0.20 or more (e.g., 2,4-dinitrophenyl, 2,4,6-trichlorophenyl, pentachlorophenyl), a heterocyclic group (e.g., 2-benzoxazolyl, 2-benzothiazolyl, 1-phenyl-2-benzimidazolyl, 5-chloro-1-tetrazolyl, 1-pyrrolyl), a halogen atom (e.g., chlorine, bromine), an azo group (e.g., phenylazo) and a selenocyanate group. Of these substituents, the groups capable of having a substituent may further have a substituent described above as the substituent for $R^3$.

$R^1$ and $R^2$ each is preferably an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenated alkyl group, a halogenated alkyloxy group, a halogenated alkylthio group, a halogenated aryloxy group, an aryl group substituted with at least two other electron attractive groups having a $\sigma_p$ value of 0.20 or more, or a heterocyclic group, more preferably an alkoxycarbonyl group, a nitro group, a cyano group, an arylsulfonyl group, a carbamoyl group, or a halogenated alkyl group. $R^1$ is most preferably a cyano group. $R^2$ is still more preferably an alkoxycarbonyl group, and most preferably a branched alkoxycarbonyl group (in particular, a cycloalkoxycarbonyl group).

X represents hydrogen atom or a group capable of splitting off upon coupling reaction with an oxidation product of an aromatic primary amine color developing agent. Examples of the group capable of splitting off include a halogen atom, an alkoxy group, an aryloxy group, an acyloxy group, an alkylsulfonyloxy group, an arylsulfonyloxy group, an acylamino group, an alkylsulfonamido group, an arylsulfonamido group, an alkoxycarbonyloxy group, an aryloxycarbonyloxy group, an alkyl thio group, an aryl thio group, a heterocyclic thio group, a carbamoylamino group, a carbamoyloxy group, a heterocyclic carbonyloxy group, a 5- or 6-membered nitrogen-containing heterocyclic group, an imido group and an arylazo group. These groups each may further be substituted with a substituent described above as the substituent of $R^3$.

More specifically, examples of the group capable of splitting off include a halogen atom (e.g., fluorine, chlorine, bromine), an alkoxy group (e.g., ethoxy, dodedyloxy, methoxyethylcarbamoylmethoxy, carboxypropyloxy, methanesulfonylethoxy, ethoxycarbonylmethoxy), an aryloxy group (e.g., 4-methylphenoxy, 4-chlorophenoxy, 4-methoxy-phenoxy, 4-carboxyphenoxy, 3-ethoxycarbonylphenoxy, 3-acetylaminophenoxy, 2-carboxyphenoxy), an acyloxy group (e.g., acetoxy, tetradecanoyloxy, benzoyloxy), an alkyl- or arylsulfonyloxy group (e.g., methanesulfonyloxy, toluenesulfonyloxy), an acylamino group (e.g., dichloroacetylamino, heptafluorobutyrylamino), an alkyl- or arylsulfonamido group (e.g., methanesulfonylamino, trifluoromethanesulfonylamino, p-toluenesulfonylamino), an alkoxy-carbonyloxy group (e.g., ethoxycarbonyloxy, benzyloxy-carbonyloxy) an aryloxycarbonyloxy group (e.g., phenoxy-carbonyloxy), an alkyl-, aryl- or heterocyclic-thio group (e.g., dodecylthio, 1-carboxydodecylthio, phenylthio, 2-butoxy-5-tert-octylphenylthio, tetrazolylthio), a carbamoyl-amino group (e.g., N-methylcarbamoylamino, N-phenyl-carbamoylamino), a carbamoyloxy group (e.g., N,N-diethylcarbamoyloxy, N-ethylcarbamoyloxy, N-ethyl-N-phenylcarbamoyloxy), a heterocyclic carbonyloxy group (e.g., morpholinocarbonyloxy, piperidinocarbonyloxy), a 5- or 6-membered nitrogen-containing heterocyclic group (e.g., imidazolyl, pyrazolyl, triazolyl, tetrazolyl, 1,2-dihydro-2-oxo-1-pyridyl), an imido group (e.g., succinimido, hydantoinyl) and an arylazo group (e.g., phenylazo, 4-methoxyphenylazo). Other than these, X may be a splitting-off group bonded through a carbon atom and in this case, the coupler assumes a bis-type coupler obtained by the condensation of a 4-equivalent coupler with an aldehyde or ketone. Furthermore, X may contain a photographically useful group such as development inhibitor or development accelerator.

X is preferably a halogen atom, an alkoxy group, an aryloxy group, an alkylthio group, an arylthio group, an alkyloxycarbonyloxy group, an aryloxycarbonyloxy group, a carbamoyloxy group, a heterocyclic carbonyloxy group or a 5- or 6-membered nitrogen-containing heterocyclic group bonded to the coupling active site through nitrogen atom, more preferably a halogen atom, an alkylthio group, an arylthio group, an alkyloxycarbonyloxy group, an aryloxycarbonyloxy group, a carbamoyloxy group or a heterocyclic carbonyloxy group, still more preferably a carbamoyloxy group or a heterocyclic carbonyloxy group.

The group represented by $R^1$, $R^2$, $R^3$ or X may form a divalent group and in this case, the cyan coupler represented by the formula [C-1] may combine with a dimer or greater polymer or with a polymer chain to form a homopolymer or a copolymer. A typical example of the homopolymer or copolymer formed by the combining with a polymer chain is a homopolymer or copolymer of an addition polymerizable ethylenically unsaturated compound having a cyan coupler residue represented by formula [C-1]. The polymer may contain one or more cyan color forming repeating unit having a cyan coupler residue represented by formula or may be a copolymer containing one or more non-color forming ethylenic monomer as a copolymerization component. The cyan color forming repeating unit having a cyan coupler residue represented by the formula [C-1] is preferably represented by the following formula (P):

(P)

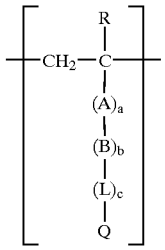

wherein R represents hydrogen atom, an alkyl group having from 1 to 4 carbon atoms or a chlorine atom, A represents —CONH—, —COO— or a substituted or unsubstituted phenylene group, B represents a substituted or unsubstituted alkylene group, a substituted or unsubstituted phenylene group or a substituted or unsubstituted alkylene group, L represents —CONH—, —NHCONH—, —NHCOO—, —NHCO—, —OCONH—, —NH—, —COO—, —OCO—, —CO—, —O—, —S—, $—SO_2—$, $—NHSO_2—$ or $—SO_2NH—$, a, b and c each represents 0 or 1, and Q represents a cyan coupler residue resulting from releasing hydrogen atom from $R^1$, $R^2$, $R^3$ or X in the compound represented by formula [C-1]. The polymer is preferably a copolymer of a cyan color forming monomer represented by the coupler unit of formula [C-1] and a non-color forming ethylenic monomer incapable of coupling with an oxidation product of an aromatic primary amine developing agent.

Examples of the non-color forming ethylenic monomer incapable of coupling with an oxidation product of an aromatic primary amine developing agent include acrylic acid, α-chloroacrylic acid, α-alkylacrylic acid (e.g., methacrylic acid), an amide or ester derived from these acrylic acids (e.g., acrylamide, methacrylamide, n-butylacrylamide, tert-butylacrylamide, diacetone acrylamide, methyl acrylate, ethyl acrylate, n-propyl acrylate, n-butyl acrylate, tert-butyl acrylate, isobutyl acrylate, 2-ethylhexyl acrylate, n-octyl acrylate, lauryl acrylate, methyl methacrylate, ethyl methacrylate, n-butyl methacrylate, β-hydroxy methacrylate), a vinyl ester (e.g., vinyl acetate, vinyl propionate, vinyl laurate), acrylonitrile, methacrylonitrile, an aromatic vinyl compound (for example, styrene and a derivative thereof, e.g., vinyltoluene, divinylbenzene, vinylacetophenone, sulfostyrene), an itaconic acid, a citraconic acid, a crotonic acid, vinylidene chloride, a vinyl alkyl ether (e.g., vinyl ethyl ether), a maleic acid ester, N-vinyl-2-pyrrolidone, N-vinylpyridine, 2-vinylpyridine and 4-vinylpyridine.

Among these, an acrylic acid ester, a methacrylic acid ester and a maleic acid ester are preferred. Two or more of these non-color forming ethylenic monomers may be used in combination. Examples thereof include a combination of methyl acrylate and butyl acrylate, a combination of butyl acrylate and styrene, a combination of butyl methacrylate and methacrylic acid, and a combination of methyl acrylate and diacetone acrylamide.

As is well known in the field of polymer coupler, the ethylenically unsaturated monomer copolymerized with the vinyl-based monomer corresponding to formula [C-1] may be selected so that good effects can be provided on the physical properties and/or chemical properties of the copolymer formed, such as solubility, compatibility with a binder of a photographic colloid composition (for example, gelatin), flexibility and thermal stability.

For incorporating the cyan coupler used in the present invention into a silver halide light-sensitive material, preferably into a red-sensitive silver halide emulsion layer, the cyan coupler is preferably a so-called coupler-in-emulsion type coupler. To this purpose, at least one of the groups represented by $R^1$, $R^2$, $R^3$ and X is preferably a so-called ballast group (preferably having 10 or more carbon atoms in total, more preferably from 10 to 50 carbon atoms in total). More preferably, $R^3$ is a ballast group.

The cyan coupler represented by formula [C-1] is still more preferably a compound having a structure represented by the following formula [C-2]:

[C-2]

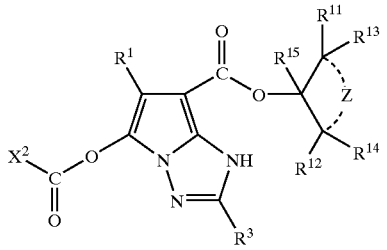

wherein $R^{11}$, $R^{12}$, $R^{13}$, $R^{14}$ and $R^{15}$, which may be the same or different, each represents hydrogen atom or a substituent. The substituent is preferably a substituted or unsubstituted aliphatic group or a substituted or unsubstituted aryl group. More preferred embodiments thereof are described below.

$R^{11}$ and $R^{12}$ each is preferably an aliphatic group such as a linear, branched or cyclic alkyl group having from 1 to 36 carbon atoms, an aralkyl group, an alkenyl group, an alkynyl group or a cycloalkenyl group, e.g., methyl, ethyl, propyl, isopropyl, tert-butyl, tert-amyl, tert-octyl, tridecyl, cyclopentyl or cyclohexyl. The aliphatic group more preferably has from 1 to 12 carbon atoms. $R^{13}$, $R^{14}$ and $R^{15}$ each preferably represents hydrogen atom or an aliphatic group. Examples of the aliphatic group include the groups described above for $R^{11}$ or $R^{12}$. $R^{13}$, $R^{14}$ and $R^{15}$ each is more preferably hydrogen atom.

Z represents a non-metallic atom group necessary for forming a 5-, 6-, 7- or 8-membered ring. The ring formed may be substituted, may be a saturated ring or may contain an unsaturated bond. Preferred examples of the non-metallic atom include a nitrogen atom, an oxygen atom, a sulfur atom and a carbon atom. Among these, a carbon atom is more preferred.

Examples of the ring formed by Z include a cyclopentane ring, a cyclohexane ring, a cycloheptane ring, a cyclooctane ring, a cyclohexene ring, a piperazine ring, an oxane ring and a thiane ring. These rings each may have a substituent described above as the substituent represented by $R^3$.

The ring formed by Z is preferably a cyclohexane ring which may be substituted, more preferably a cyclohexane ring substituted with an alkyl group having from 1 to 24 carbon atoms at the 4-position (which may have a substituent described above as the substituent represented by $R^3$).

$R^3$ in formula [C-2] has the same meaning as $R^3$ in formula [C-1] and $R^3$ is preferably an alkyl group or an aryl group, more preferably a substituted aryl group. With respect to the number of carbon atoms, the alkyl group preferably has from 1 to 36 carbon atoms and the aryl group preferably has from 6 to 36 carbon atoms.

Out of the aryl groups, those substituted with an alkoxy group at the ortho-position with respect to the site bonding to the coupler mother nucleus (i.e., the base nucleus of the coupler) are not preferred because the dye originated from these couplers is poor in the light fastness.

From this point, the substituent of the aryl group is preferably a substituted or unsubstituted alkyl group, most preferably an substituted alkyl group. The unsubstituted alkyl group preferably has from 1 to 30 carbon atoms.

$X^2$ represents hydrogen atom or a substituent. The substituent is preferably a group capable of accelerating the release of $X^2$—C(=O)O— group at the oxidation coupling reaction. $X^2$ is more preferably a heterocyclic group, an unsubstituted or substituted amino group or an aryl group. The heterocyclic ring is preferably a 5-, 6-, 7- or 8-membered ring containing a nitrogen atom, an oxygen atom or a sulfur atom and having from 1 to 36 carbon atoms, more preferably a 5- or 6-membered ring connected through nitrogen atom, still more preferably 6-membered ring. The ring may form a condensed ring together with a benzene ring or a heterocyclic ring. Specific examples of the heterocyclic ring include imidazole, pyrazole, triazole, a lactam compound, piperidine, pyrrolidine, pyrrole, morpholine, pyrazolidine, thiazolidine and pyrazoline. Among these, morpholine and piperidine are preferred, and morpholine is more preferred.

Examples of the substituent of the substituted amino group include an aliphatic group, an aryl group and a heterocyclic group. Examples of the aliphatic group include the substituents described above for $R^3$. The aliphatic group may further be substituted with a cyano group, an alkoxy group (e.g., methoxy), an alkoxycarbonyl group (e.g., ethoxycarbonyl), a chlorine atom, a hydroxy group or a carboxyl group. The substituted amino group is preferably a disubstituted amino group rather than a monosubstituted amino group. The substituent of the substituted amino group is an alkyl group.

The aryl group preferably has from 6 to 36 carbon atoms and a monocyclic aryl group is more preferred. Specific examples thereof include phenyl, 4-tert-butylphenyl, 2-methylphenyl, 2,4,6-trimethylphenyl, 2-methoxyphenyl, 4-methoxyphenyl, 2,6-dichlorophenyl, 2-chlorophenyl and 2,4-dichlorophenyl group.

The cyan coupler represented by formula [C-2] for use in the present invention preferably has an oil-solubilizing group in its molecule and is easily soluble in a high boiling point organic solvent. Furthermore, the coupler itself and a dye formed by the oxidation coupling reaction of the coupler and a reducing agent for color formation (developing agent) are preferably not diffusive in a hydrophilic colloid layer.

The coupler represented by formula [C-2] may assume a dimer or greater polymer where $R^3$ contains a coupler residue represented by formula [C-2], or may assume a homopolymer or copolymer where $R^3$ contains a polymer chain. A typical example of the homopolymer or copolymer containing a polymer chain is a homopolymer or copolymer of an addition polymerizable ethylenically unsaturated compound having a coupler residue represented by formula [C-2]. The polymer may contain one or more cyan color-forming repeating unit having a coupler residue represented by formula [C-2] or may be a copolymer containing one or more non-color forming ethylenic monomer incapable of coupling with an oxidation product of an aromatic primary amine developing agent as a copolymerization component, such as acrylic acid ester, methacrylic acid ester or maleic acid ester.

Specific examples of the cyan coupler specified in the present invention are set forth below, but the present invention should not be construed as being limited thereto.

(1)
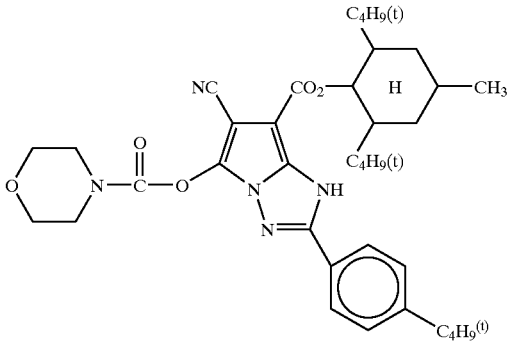
pKa 7. 14
(2)
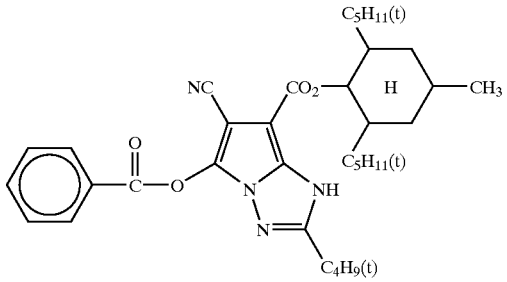
pKa 7. 90
(3)
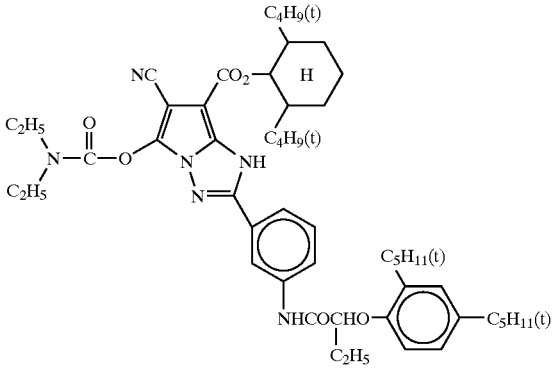
(4)
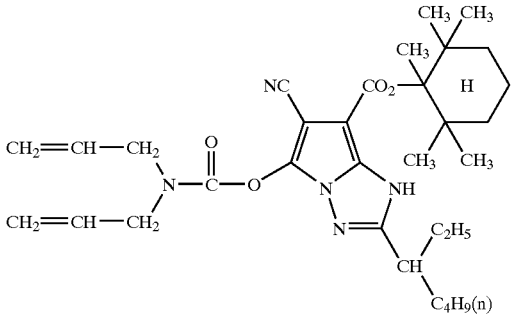
(5)
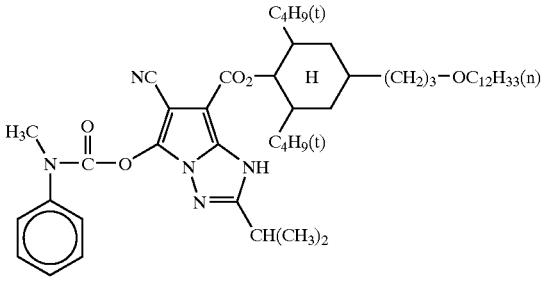
(6)
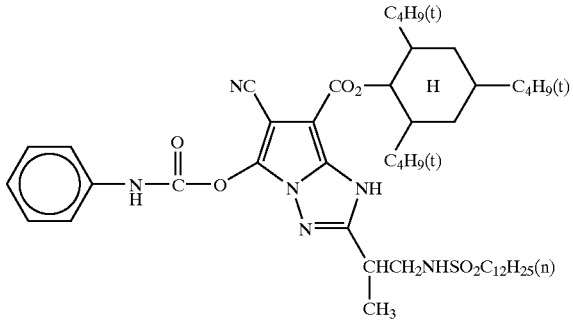
(7)
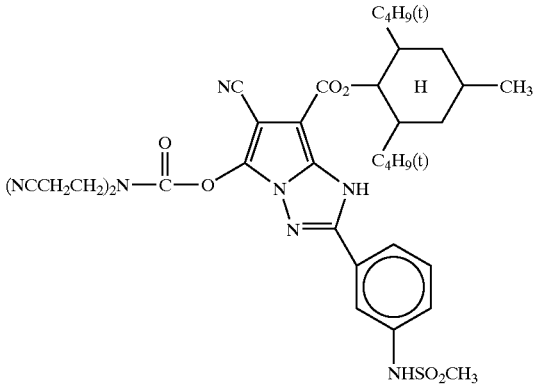
(8)
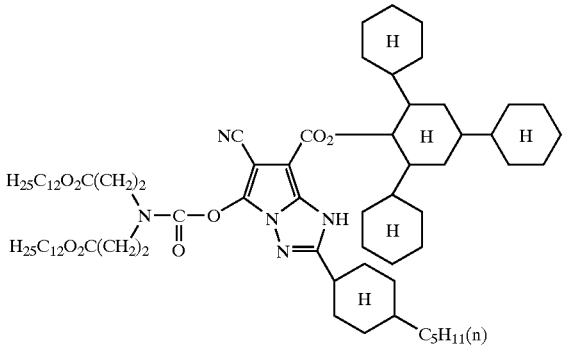

-continued
(9)
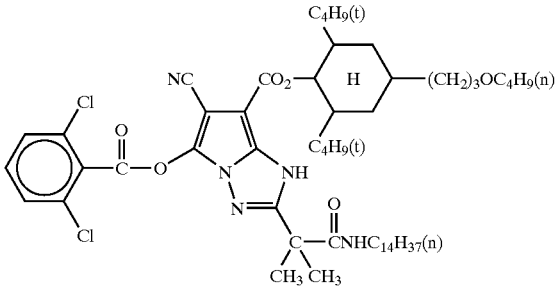
(10)
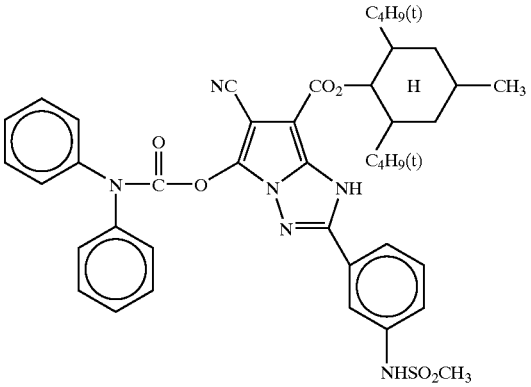
(11)
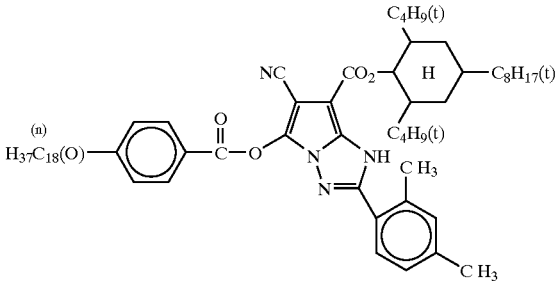
(12)
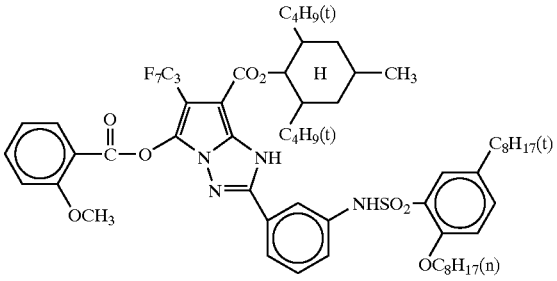
(13)
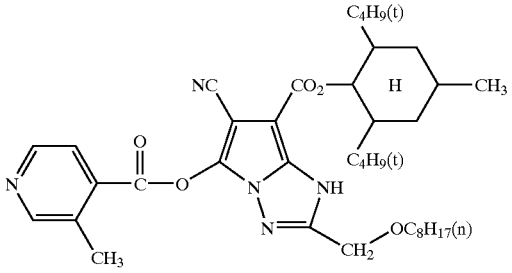
(14)
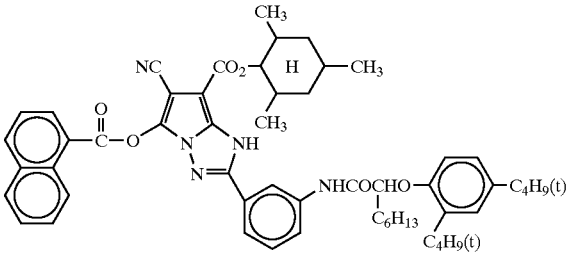
(15)
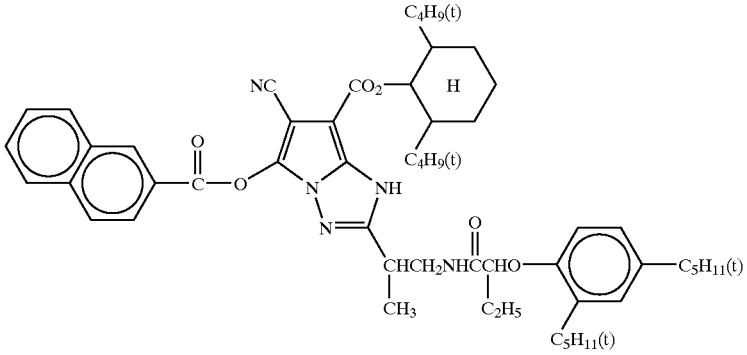

-continued
(16)
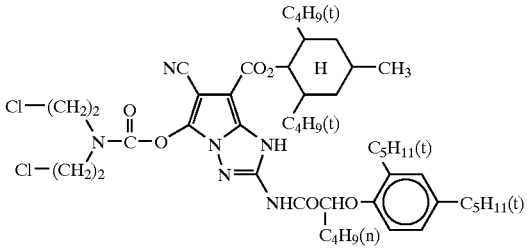
(17)
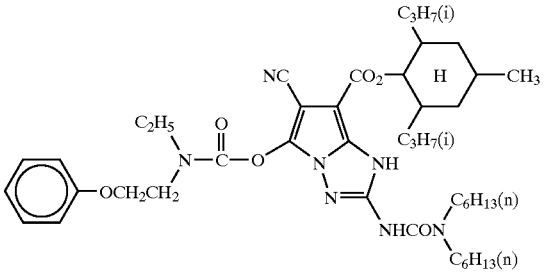
(18)
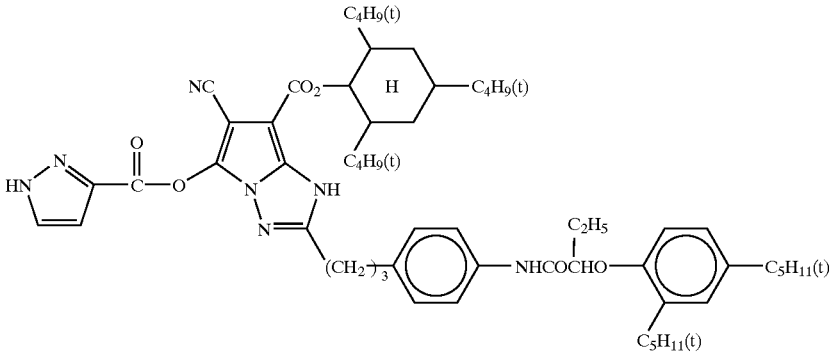
(19)
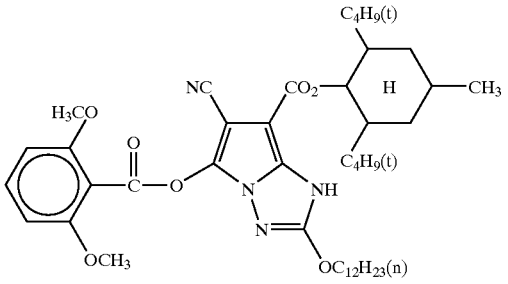
(20)
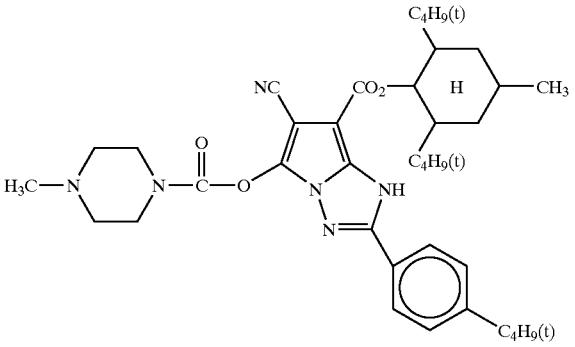
(21)
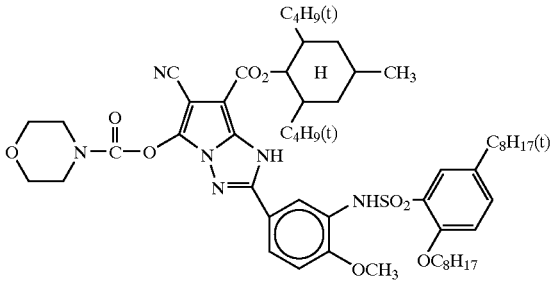
p K a 7. 70
(22)
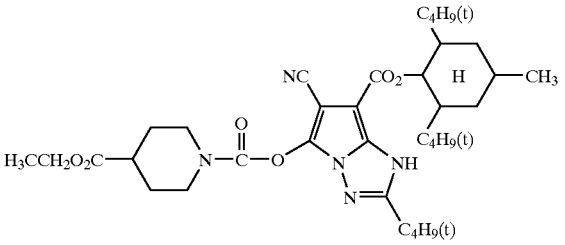
p K a 8. 30

-continued
(23)
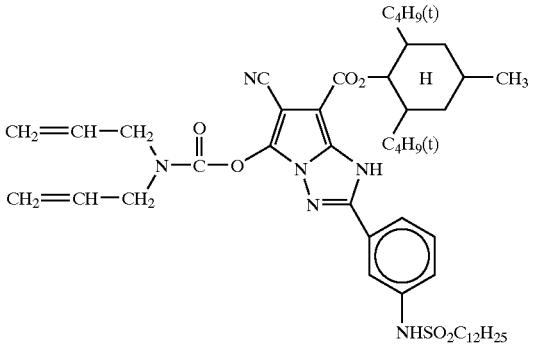
(24)
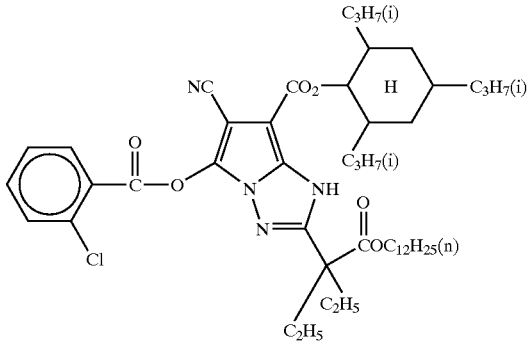
(25)
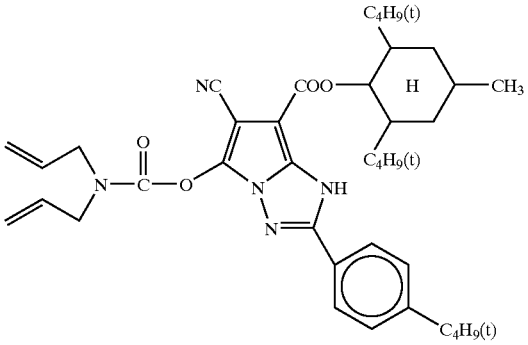
p K a 7. 47
(26)
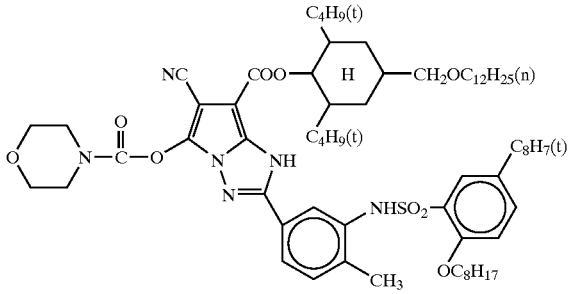
p K a 7. 38
(27)
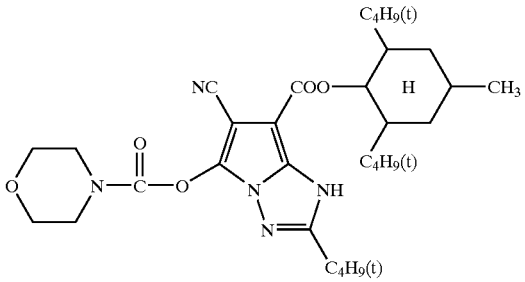
p k a 8. 28
(28)
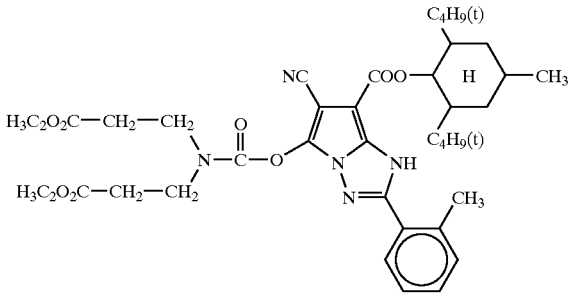
(29)
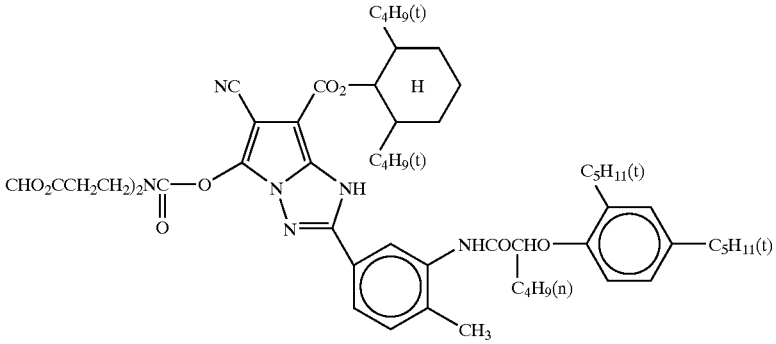

-continued
(30)
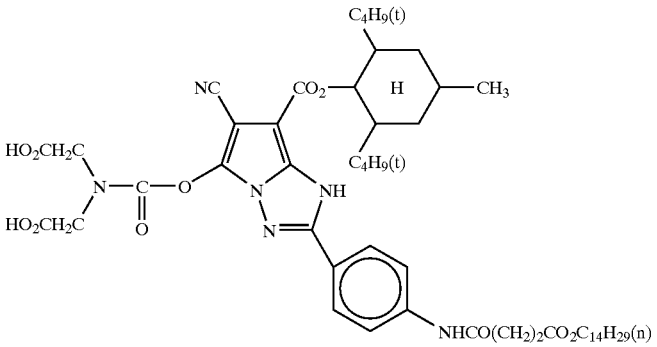
(31)
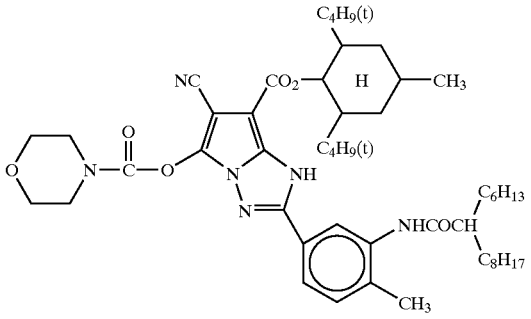
(32)
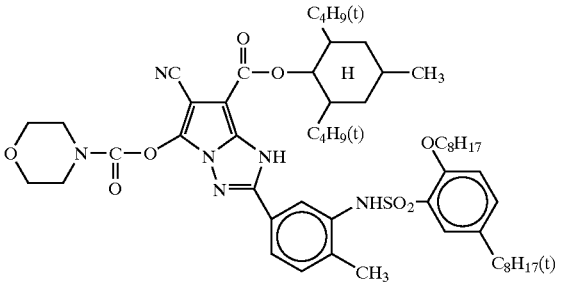
p K a 7. 38
(33)
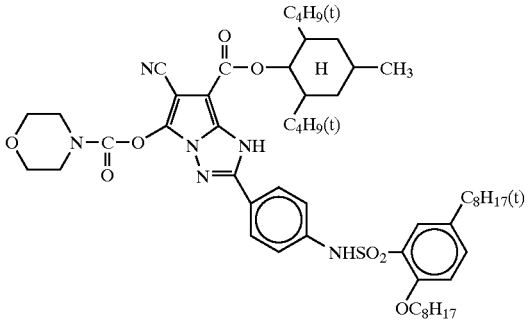
(34)
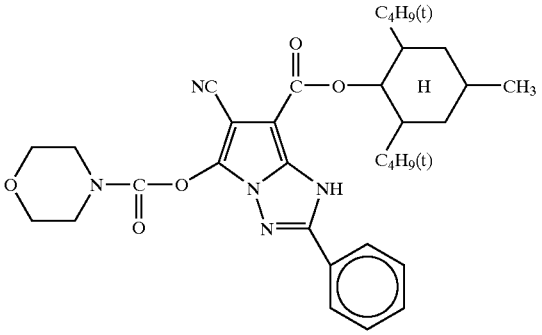
(35)
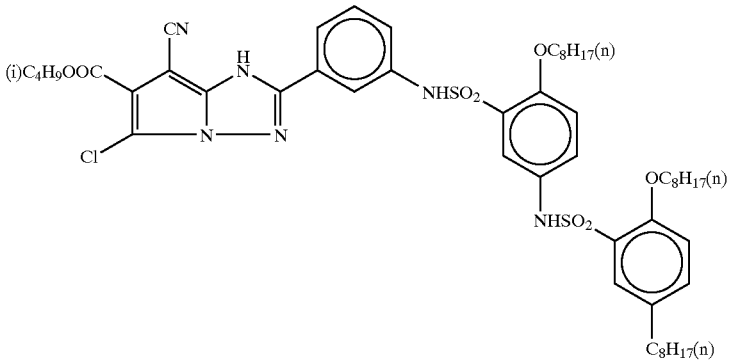

-continued
(36)
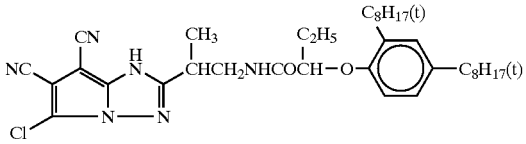
(37)
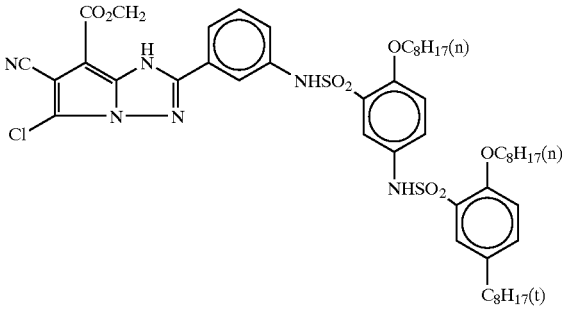
(38)
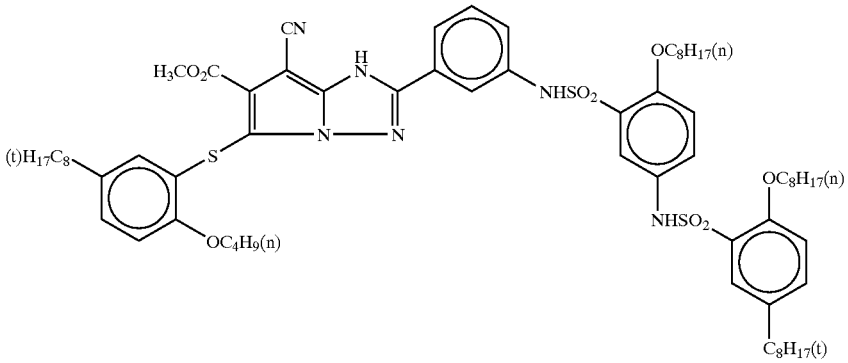
(39)
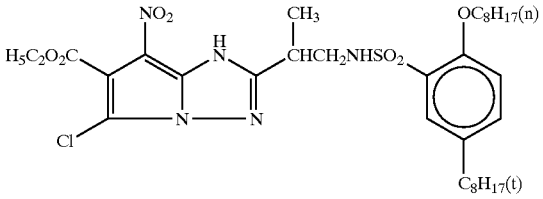
(40)
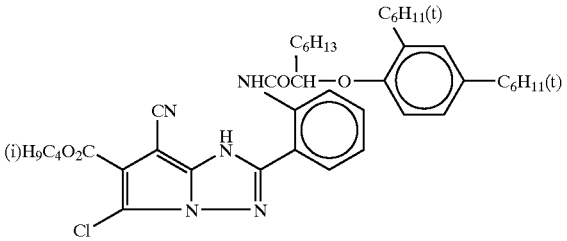
(41)
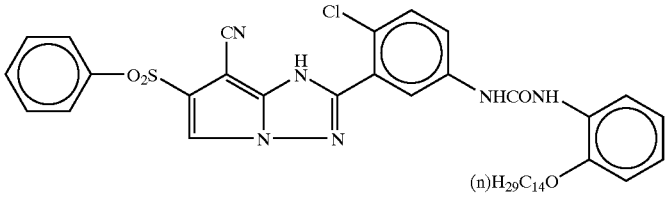
(42)
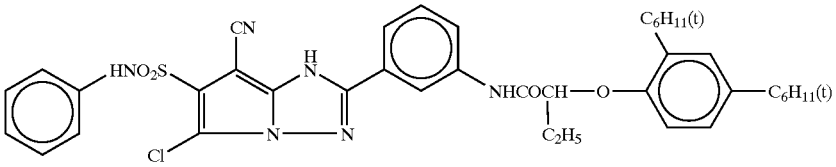
(43)
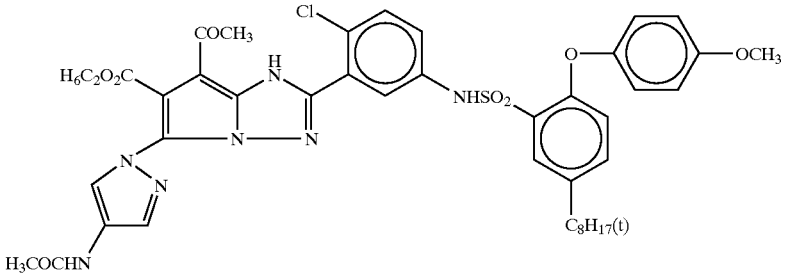

-continued
(44)
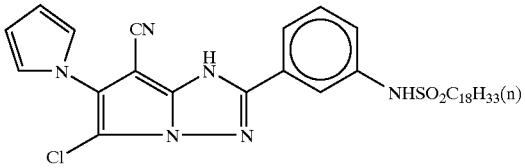
(45)
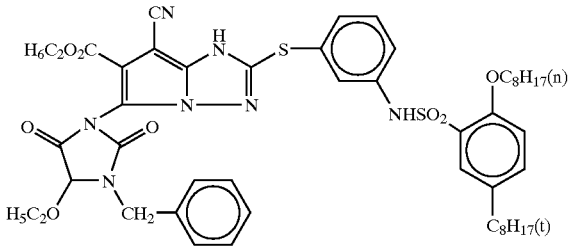
(46)
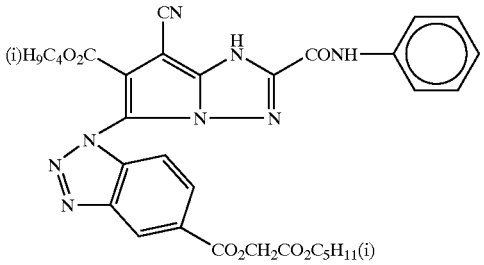
(47)
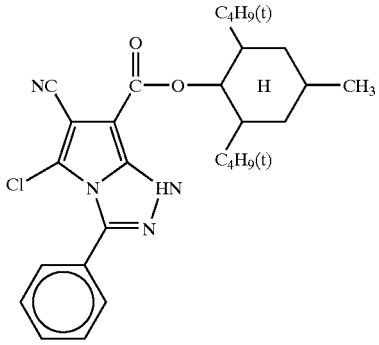
The cyan coupler represented by formula [C-1] may be synthesized by a well-known method, for example, the methods described in JP-A-5-150423, JP-A-5-255333, JP-A-5-202004 and JP-A-7-48376.
Specific synthesis examples of the cyan coupler represented by formula [C-1] are described below.
SYNTHESIS EXAMPLE 1
Synthesis of Compound (1)
Compound (1) was synthesized through the following route.
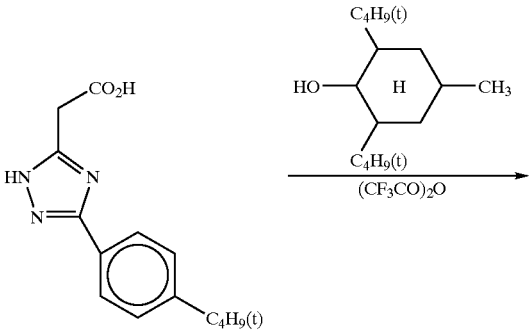
(a)
-continued
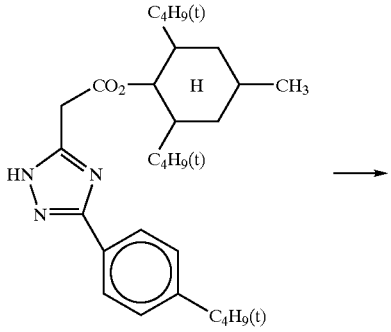
(b)
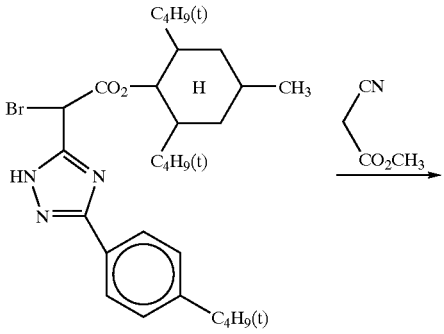
(c)

-continued

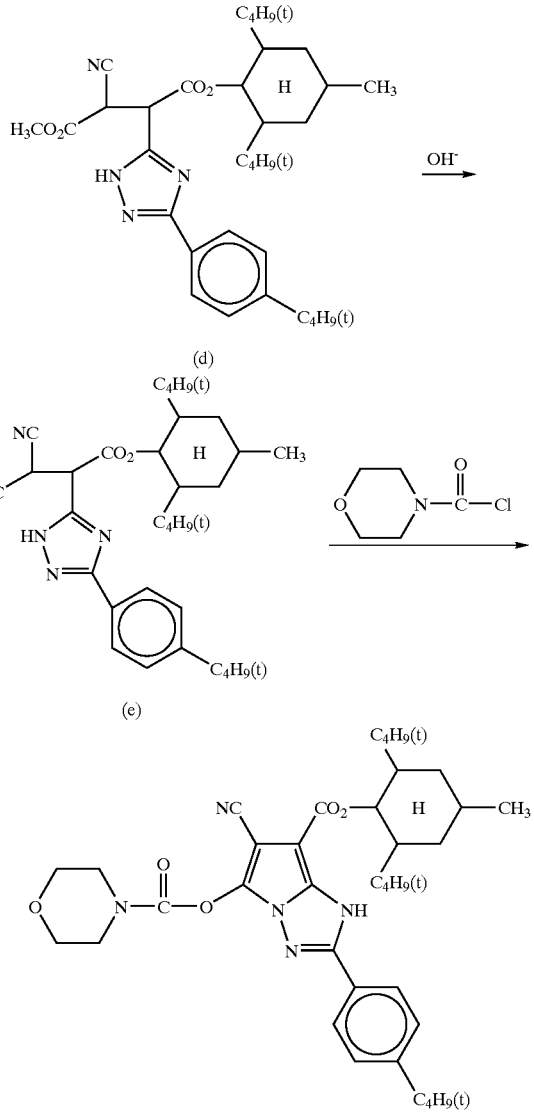

Compound (1)

Synthesis of Compound (b)

To 200 ml of an acetonitrile solution containing 17 g (75 mmol) of 2,6-di-tert-butyl-4-methylcyclohexanol, 10.6 ml (75 mmol) of trifluoroacetic acid anhydride was added dropwise at a temperature of 0° C. and subsequently, 15.6 g (60.4 mmol) of Compound [C-1] was gradually added thereto. The reaction solution was stirred at room temperature for 2 hours and then extracted by adding 300 ml of water and 300 ml of ethyl acetate. The organic layer was washed with an aqueous sodium bicarbonate solution, water and saline water, and then dried over magnesium sulfate. The solvent was distilled off under reduced pressure and the residue was recrystallized from acetonitrile to obtain 19.6 g of Compound (b).

Synthesis of Compound (c)

To 200 ml of ethyl acetate solution containing 19.6 g of Compound (b), 5 ml of pyridine was added and then bromine was added dropwise under ice cooling. After stirring for one hour, the solution was extracted by adding 300 ml of water and 300 ml of ethyl acetate. After the extraction, the ethyl acetate layer was dried over magnesium sulfate, the solvent was distilled off, and the residue was recrystallized by adding acetonitrile to obtain 18.0 g of Compound (c).

Synthesis of Compound (e)

To 20 ml of dimethylacetamide solution containing 2.2 g of methyl cyanoacetate, 0.8 g of sodium hydride was gradually added at a temperature of 0° C. and the mixture was stirred at room temperature for 30 minutes (Solution S).

10.0 g of Compound (c) dissolved in 50 ml of dimethylacetamide solution was gradually added dropwise to Solution S under ice cooling. After stirring for one hour, 4 g of sodium hydroxide dissolved in 20 ml of water and 20 ml of methanol were added to the reaction solution and the mixture was stirred for one hour while maintaining the reaction temperature at 50° C. After the reaction, 200 ml of ethyl acetate was added thereto, and the mixture was neutralized with aqueous hydrochloric acid and washed with water. The ethyl acetate layer was dried over magnesium sulfate and the solvent was distilled off under reduced pressure to obtain Compound (e) as a crude product.

Synthesis of Compound (1)

8.0 g of crude Compound (e) was dissolved in 40 ml of dimethylacetamide and 6 ml of pyridine, and thereto 4.3 g of morpholinocarbamoyl chloride was added at 0° C. The mixture was stirred for 2 hours at room temperature, then poured into 200 ml of diluted aqueous hydrochloric acid and extracted with 200 ml of ethyl acetate. The organic phase was washed with water and dried over magnesium sulfate. The solvent was distilled off under reduced pressure and the residue was crystallized by adding hexane to obtain 6.0 g of Compound (1). The melting point was 256 to 257° C.

SYNTHESIS EXAMPLE 2

Synthesis of Compound (25)

In the synthesis of Compound (1), 4.5 g of diallylcarbamoyl chloride was added in place of morpholinocarbamoyl chloride, and the mixture was stirred for 2 hours at room temperature. The reaction solution was poured into 200 ml of diluted aqueous hydrochloric acid and extracted with 200 ml of ethyl acetate. The organic phase was dried over magnesium sulfate, the solvent was distilled off under reduced pressure, and the residue was crystallized by adding hexane to obtain 5.5 g of the objective compound. The melting point was 219 to 220° C.

Other compounds can be synthesized in the same manner.

The amount of the cyan coupler coated of the present invention varies depending on the molar extinction coefficient of the cyan coupler, however, it is generally from 0.01 to 1 g/m$^2$, preferably from 0.05 to 0.5 g/m$^2$.

In the case where the cyan coupler used is a coupler represented by formula [C-2], the amount of the coupler used is preferably from 0.01 to 2.0 g/m$^2$, more preferably from 0.05 to 1.0 g/m$^2$, still more preferably from 0.1 to 0.8 g/m$^2$.

The ratio in the amount of cyan coupler and silver halide used varies depending on the equivalence of the coupler, but in the case of a 2-equivalent coupler, the Ag/coupler ratio is from 1.5 to 8, and in the case of a 4-equivalent coupler, from 3 to 16. In the present invention, a 2-equivalent coupler having a low pKa is preferred and in this case, the Ag/coupler ratio is from 1.5 to 8, preferably from 2 to 6, more preferably from 2.5 to 5.

In the present invention, a compound represented by the following formula [M-1] may be used in combination with the cyan coupler for use in the present invention:

[M-1]

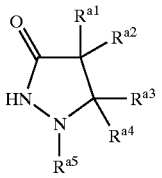

wherein $R^{a1}$ and $R^{a2}$ each independently represents hydrogen atom, an alkyl group or an aryl group, $R^{a3}$ and $R^{a4}$ each represents hydrogen atom, an alkyl group or an aryl group, and $R^{a5}$ represents an aryl group, provided that the total number of carbon atoms of $R^{a1}$, $R^{a2}$, $R^{a3}$, $R^{a4}$ and $R^{a5}$ is more than 13.

The compound represented by formula [M-1] may be used by dispersing it in a light-insensitive hydrophilic colloid layer together with an organic compound such as high boiling point organic solvent, color mixing inhibitor, ultraviolet absorbent and polymer dispersant, and a dispersion aid such as surface active agent. The amount of the compound used is from 0.1 to 200 mol %, preferably from 1 to 100 mol %, more preferably from 5 to 50 mol %, based on the cyan coupler coated.

The compound represented by formula [M-1] is preferably used simultaneously in the cyan color-forming layer in addition to the light-insensitive hydrophilic colloid layer. In this case, the amount of the compound used in the cyan color-forming layer is from 1 to 100 mol %, preferably from 5 to 50 mol %, based on the cyan coupler. In layers other than those described above, the compound represented by formula [M-1] may be preferably used in combination and in this case, the total amount of the compound used is from 1 to 200 mol %, preferably from 5 to 100 mol %, more preferably from 10 to 50 mol %, based on the cyan coupler.

Specific examples of the compound represented by formula [M-1] are set forth below, however, the present invention is by no means limited thereto.

1.

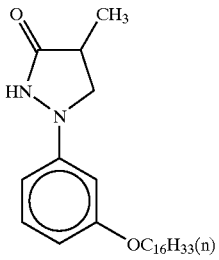

2.

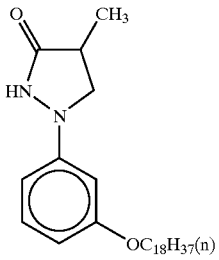

-continued

3.

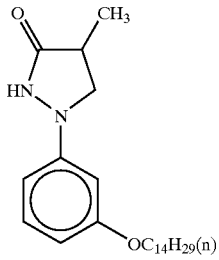

4.

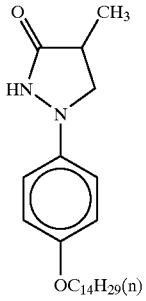

5.

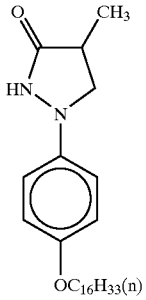

6.

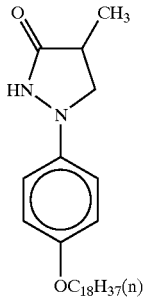

7.

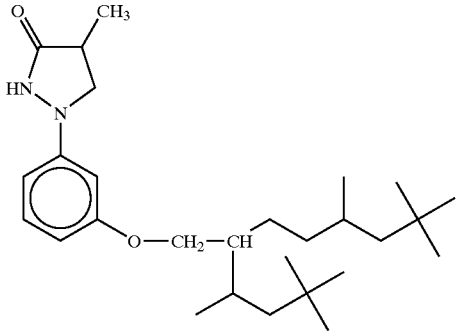

-continued
8.
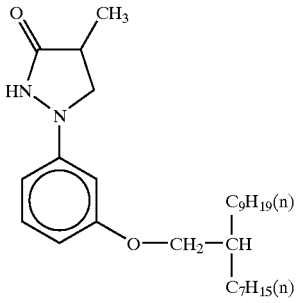
9.
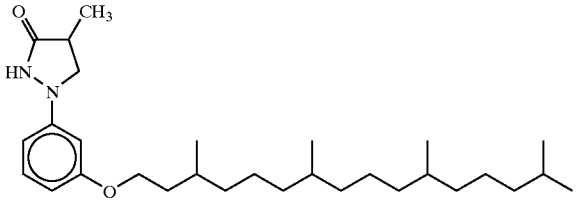
10.
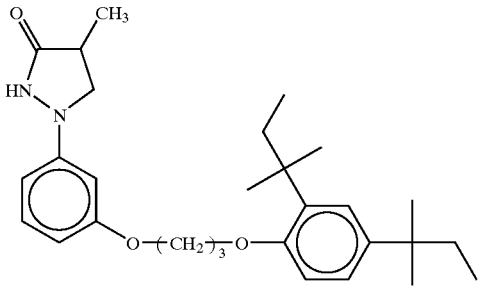
11.
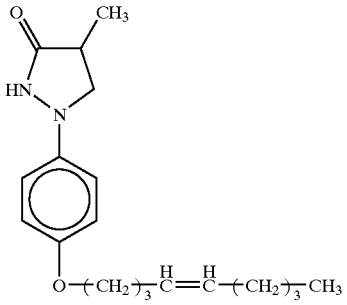
12.
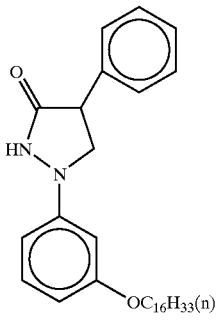
-continued
13.
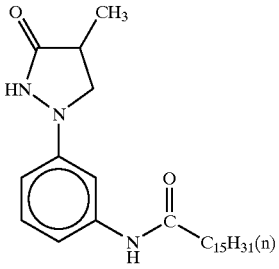
14.
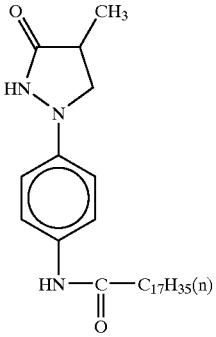
15.
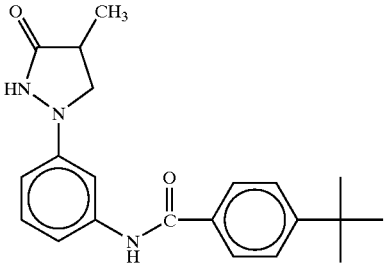
16.
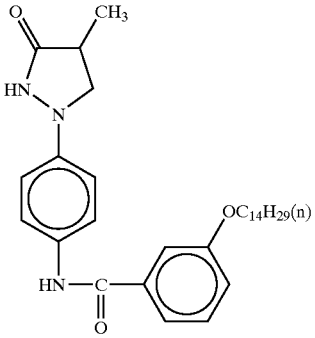
17.
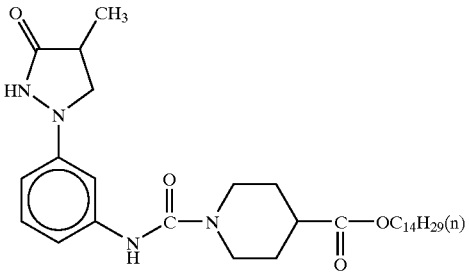

-continued
18.
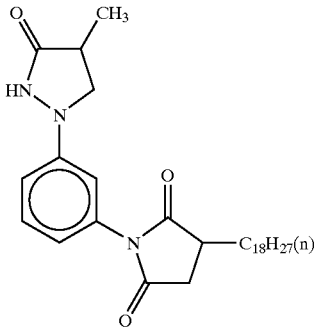
19.
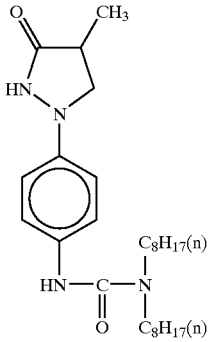
20.
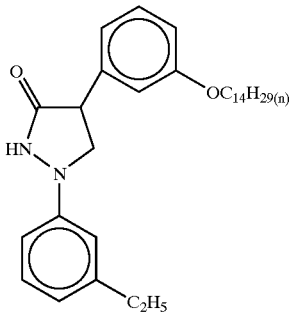
21.
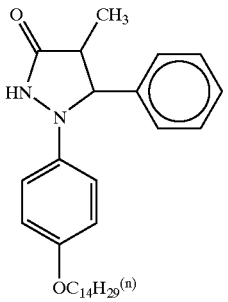
-continued
22.
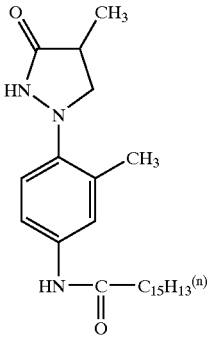
23.
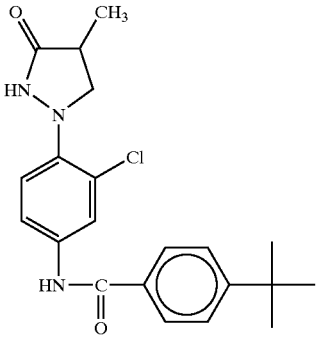
24.
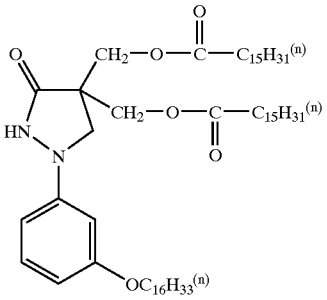
25.
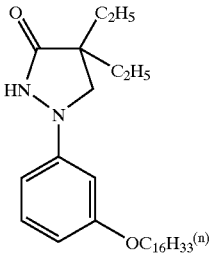

-continued
26.
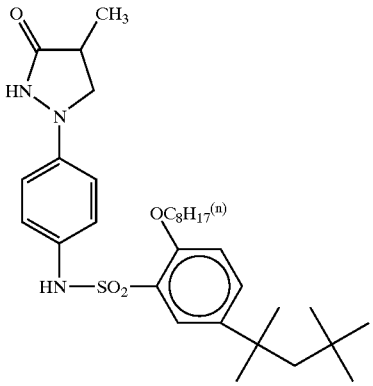
27.
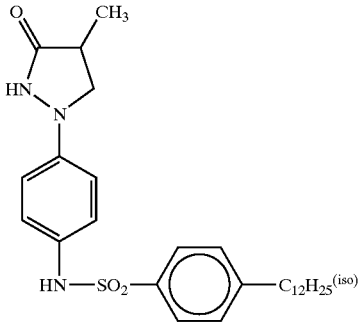
28.
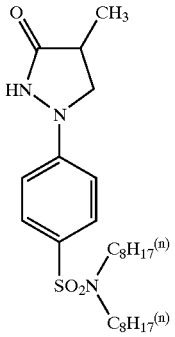
29.
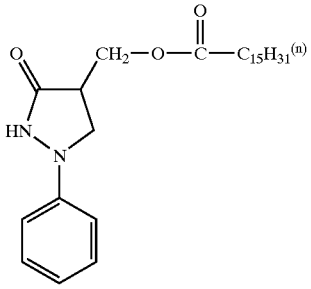
-continued
30.
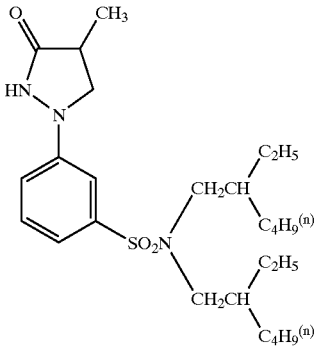
31
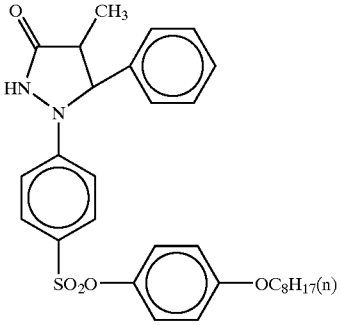
32.
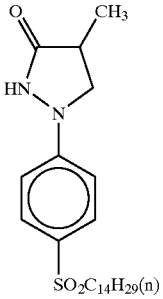
33.
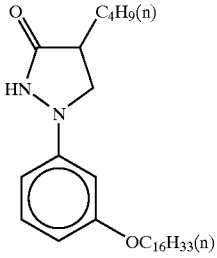
34.
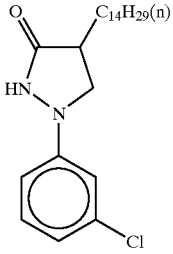

-continued
35.
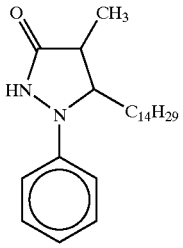
36.
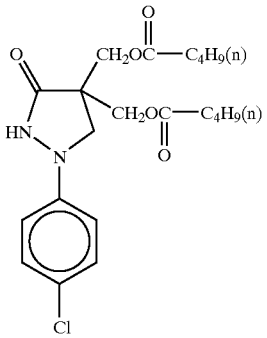
37.
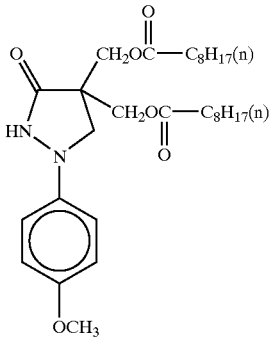
38.
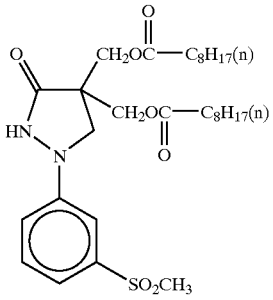
39.
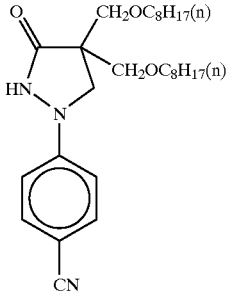
-continued
40.
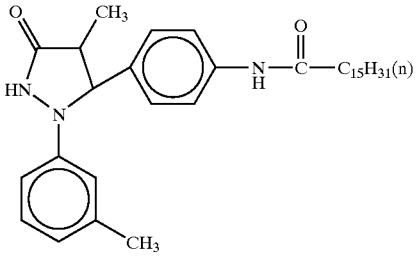
41.
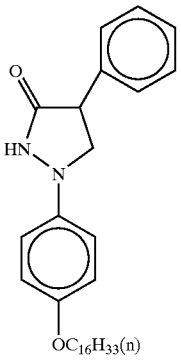
42.
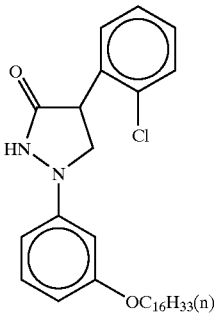
43.
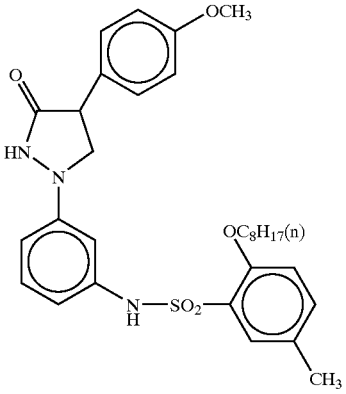

-continued
44.
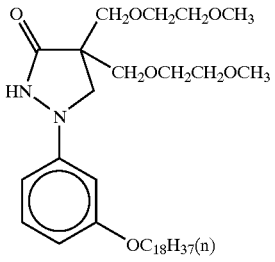
45.
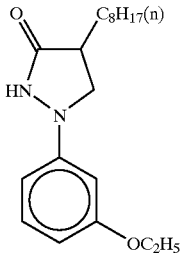
46.
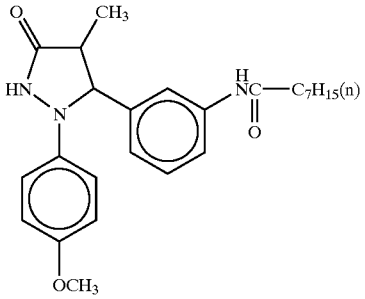
47.
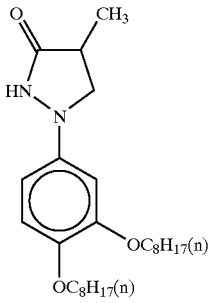
48.
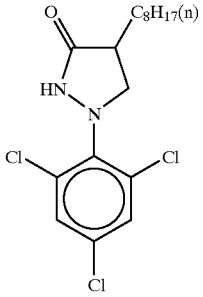
-continued
49.
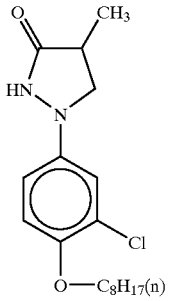
50.
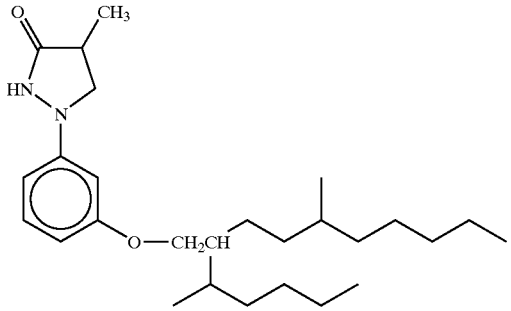
51.
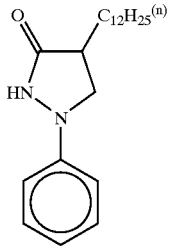
52.
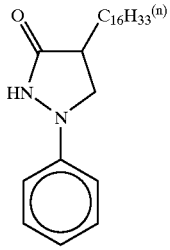
53.
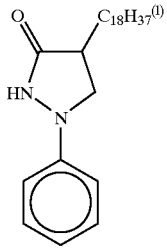

-continued
54.
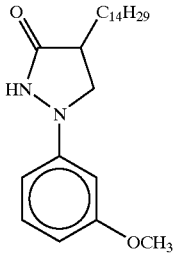
55.
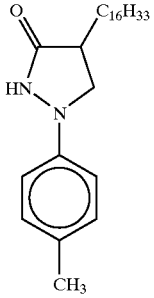
56.
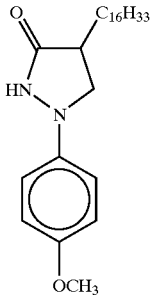
57.
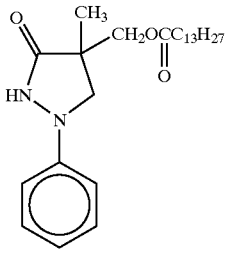
58.
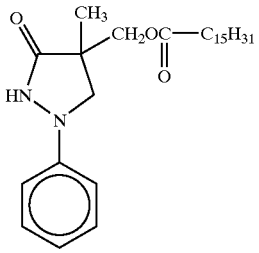
-continued
59.
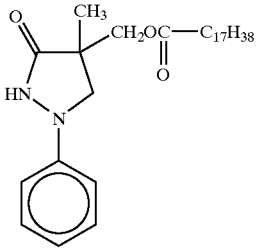
60.
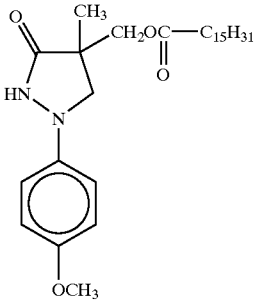
61.
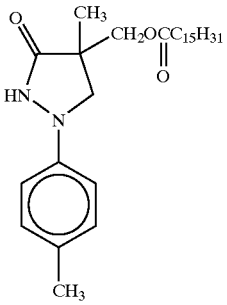
62.
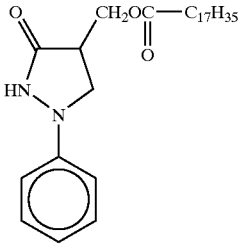
63.
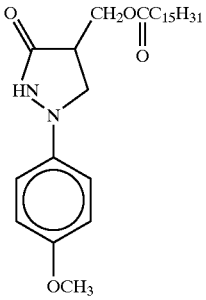

-continued
64.
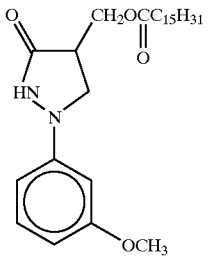
65.
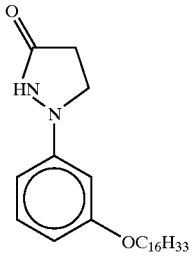
66.
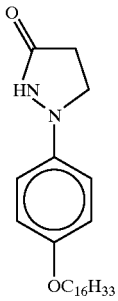
67.
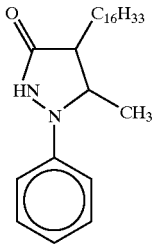
68.
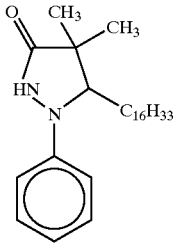
-continued
69.
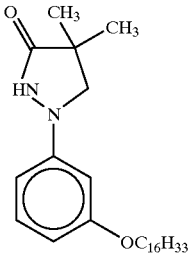
70.
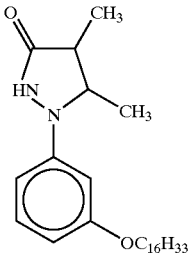
71.
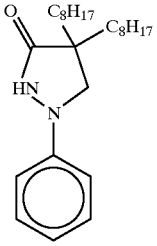
72.
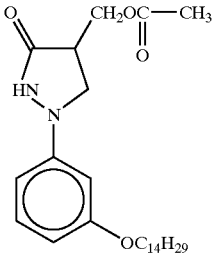
In addition to the compounds described above, any of the compounds represented by the following formulae [M-2], [M-3], [M-4] and [M-5] may be used together with the cyan coupler for use in the present invention so as to control the hue and accelerate the coloration. Multiple kinds of these compounds may also be used in combination according to the purpose.
[M-2]
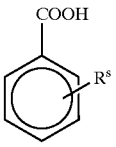

-continued

[M-3]

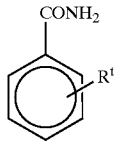

[M-4]

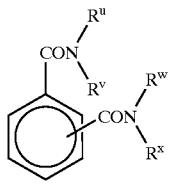

[M-5]

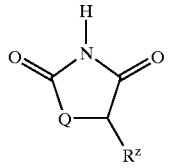

In formula [M-2], the substituent $R^a$ represents an alkyl group, an alkoxy group, an acyl group, an alkoxycarbonyl group, an acyloxy group, an acylamino group, a sulfonamido group, a carbamoyl group, a sulfamoyl group or a sulfonyl group. These substituents each may further have a substituent such as a halogen atom, a hydroxyl group, an alkyl group, an aryl group, an alkoxy group and an ester group. The substituent $R^a$ is preferably an alkoxy group or an alkoxycarbonyl group, most preferably an alkoxy group. $R^a$ may be substituted at any of the ortho-position, the meta-position and the para-position to the COOH group, but in view of the hue controlling ability, $R^a$ is preferably substituted at the ortho-position. The benzene ring may further have a substituent thereon, such as halogen atom and alkyl group.

In formula [M-3], the substituent $R^t$ represents an alkyl group, an alkoxy group, an acyl group, an alkoxycarbonyl group, an acyloxy group, an acylamino group, a sulfonamido group, a carbamoyl group, a sulfamoyl group or a sulfonyl group. These substituents each may further have a substituent such as halogen atom, hydroxyl group, alkyl group, aryl group, alkoxy group and ester group. The substituent $R^t$ is preferably an alkoxy group or an alkoxycarbonyl group, most preferably an alkoxy group. $R^t$ may be substituted at any of the ortho-position, the meta-position and the para-position to the $CONH_2$ group, but in view of the hue controlling ability, $R^t$ is preferably substituted at the ortho-position. The benzene ring may further have a substituent thereon, such as halogen atom and alkyl group.

In formula [M-4], $R^u$, $R^v$, $R^w$ and $R^x$, which may be the same or different, each represents hydrogen atom, an alkyl group, an aryl group, an alkoxycarbonyl group or an acyl group. These substituents each may further have a substituent such as halogen atom, hydroxyl group, alkyl group, aryl group, alkoxy group and ester group. The substituents $R^u$, $R^v$, $R^w$ and $R^x$ each is preferably hydrogen atom, an allyl group or an aryl group, more preferably a branched alkyl group or a cycloalkyl group, most preferably a cycloalkyl group. Two carbamoyl groups may be substituted at any of the ortho-position, the meta-position and the para-position but in view of the hue controlling ability, they are preferably substituted at the meta-position. The benzene ring may further have a substituent thereon, such as halogen atom and alkyl group.

In formula [M-53, the substituent Q represents >N—$R^y$ or >C($R^{y1}$)$R^{y2}$. The substituents $R^y$, $R^{y1}$ and $R^{y2}$ each represents hydrogen atom, an alkyl group, an aryl group, an alkoxycarbonyl group or an acyl group. The substituent $R^2$ represents hydrogen atom, an alkyl group, an alkoxy group, an aryloxy group or an acyloxy group. These substituents each may further have a substituent such as halogen atom, hydroxyl group, alkyl group, aryl group, alkoxy group and ester group. The substituent $R^y$ is preferably an alkyl group or an aryl group, more preferably a linear or branched alkyl group or an alkyl group substituted by an aryl group. The substituent $R^2$ is preferably an alkyl group or an alkoxy group, more preferably an alkoxy group. $R^{y1}$ and $R^{y2}$ each is preferably hydrogen atom or an alkyl group.

Specific examples of the compounds represented by formulae [M-2], [M-3], [M-4] and [M-5] are set forth below, however, the compound which is preferably used in combination with the coupler for use in the present invention is by no means limited to the following compounds.

M-2A

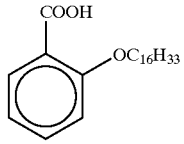

M-2B

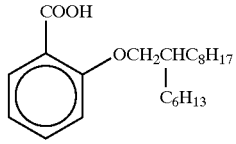

M-2C

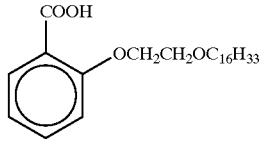

M-2D

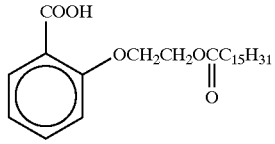

M-2E

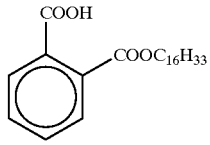

M-2F

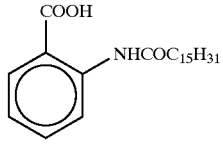

M-2G

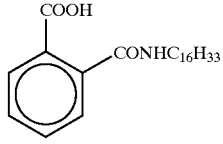

-continued
M-2H
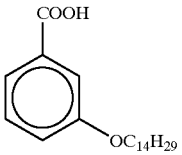
M-2I
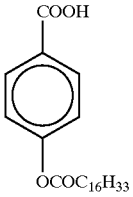
M-2J
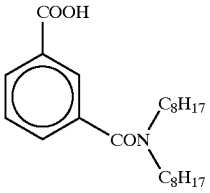
M-2K
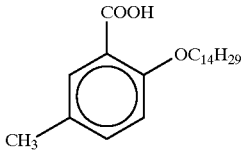
M-2L
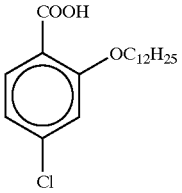
M-2G
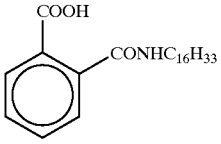
M-3A
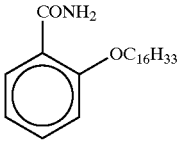
M-3B
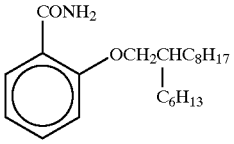
M-3C
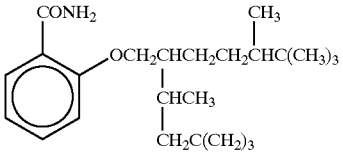
-continued
M-3D
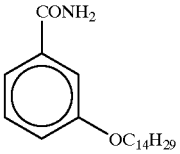
M-3E
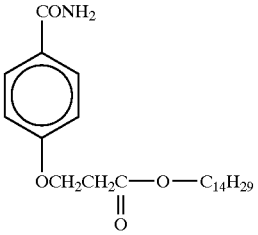
M-3F
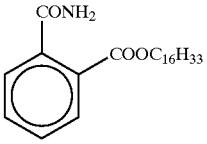
M-3G
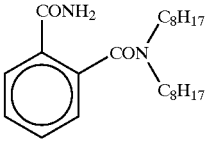
M-3H
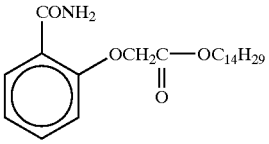
M-4A
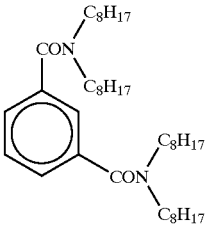
M-4B
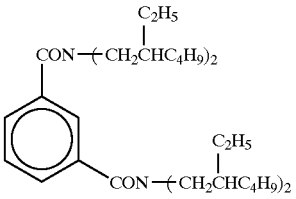
M-4C
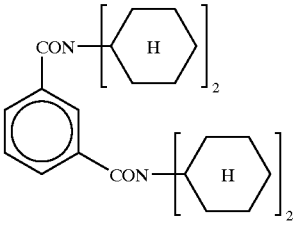

-continued

M-4D

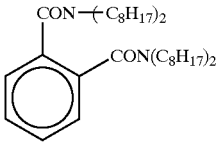

M-4E

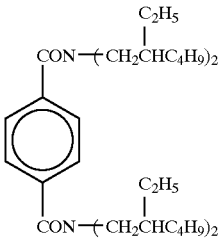

M-4F

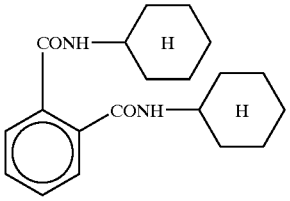

M-4G

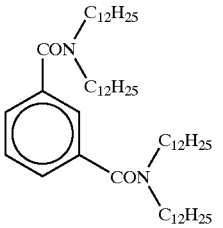

M-4H

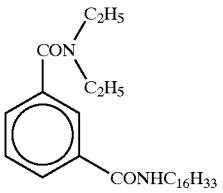

M4-I

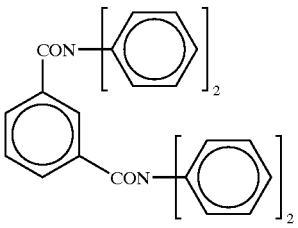

M5-A

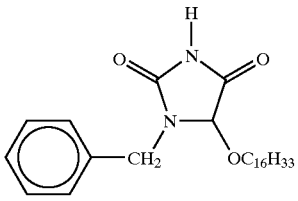

-continued

M5-B

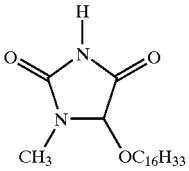

M5-C

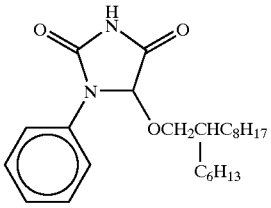

M-5D

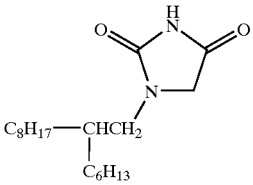

M-5E

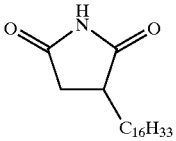

M-5F

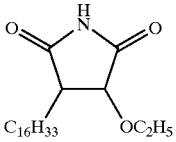

M-5G

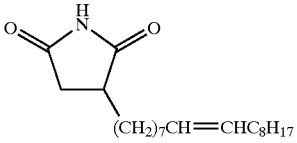

M-5H

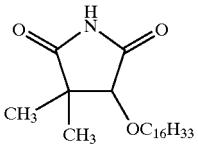

M-5I

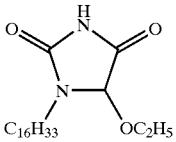

The above-described cyan coupler and the like may be introduced into a silver halide light-sensitive material by a known dispersion method such as oil-in-water dispersion method using a high boiling point organic solvent which is described later, and latex dispersion method.

In the oil-in-water dispersion method, the cyan coupler or other photographically useful compounds may be dissolved in a high boiling point organic solvent and then emulsion-dispersed as fine particles in a hydrophilic colloid, preferably an aqueous gelatin solution, together with a dispersant such as surface active agent, using a known apparatus such as colloid mill, homogenizer, Manton Gaulin and high-speed dissolver.

In dissolving the coupler, an auxiliary solvent may be used. The auxiliary solvent as used herein means an organic solvent which is effective in the dispersion by emulsification and which is substantially removed from the light-sensitive material after the coating and drying. Examples thereof include lower alcohol acetates such as ethyl acetate and butyl acetate, ethyl propionate, secondary butyl alcohol, methyl ethyl ketone, methyl isobutyl ketone, β-ethoxyethyl acetate, methyl cellosolve acetate, methyl carbitol acetate, methyl carbitol propionate and cyclohexanone.

Furthermore, if desired, an organic solvent completely miscible with water, such as methyl alcohol, ethyl alcohol, acetone, tetrahydrofuran and dimethylformamide, may be partially used in combination. These organic solvents may be used in combination of two or more thereof.

From the standpoint of improving aging stability during storage in the state of an emulsified dispersion or of improving aging stability of the final coating composition after the mixing with an emulsion and in turn preventing changes in the photographic performance, all or a part of the auxiliary solvent may be removed from the emulsified dispersion, if desired, by distillation under reduced pressure, noodle washing or ultrafiltration.

The thus-obtained lipophilic fine particle dispersion preferably has an average particle size of from 0.04 to 0.50 μm, more preferably from 0.05 to 0.30 μm, most preferably from 0.08 to 0.20 μm. The average particle size can be measured using Coulter Submicron Particle Analyzer Model N4 (manufactured by Coulter Electronics).

In the oil-in-water method using a high boiling point organic solvent, the weight ratio of the high boiling point organic solvent to the weight of all cyan couplers used may be freely selected, however, it is preferably from 0.1 to 10.0, more preferably from 0.3 to 7.0, most preferably from 0.5 to 5.0. The high boiling point organic solvent may not be used at all.

In combination with the cyan coupler of the present invention, a cyan coupler conventionally used, such as 2-acylamino-5-alkylphenol type cyan coupler, 2,5-diacylaminophenol type cyan coupler or 2-carbamoyl-1-naphthol type cyan coupler, may be used. Among these, a combination use with a 2-acylamino-5-alkylphenol type cyan coupler is preferred. In this case, the amount of the cyan coupler used in combination is preferably from 1 to 90 mol %, preferably from 5 to 80 mol %, based on the coupler of the present invention.

In order to improve the image fastness of the cyan coupler of the present invention, a method of co-emulsifying an organic solvent-soluble and water-insoluble polymer in an oil droplet may also be preferably used. In this case, the polymer is preferably a styrene, acrylamide, methacrylamide, acrylate or methacrylate-type polymer or a copolymer thereof, and preferably has a number average molecular weight of from 20,000 to 200,000.

In order to improve the stability of emulsified product, an oligomer molecule having an average molecular weight of approximately from 500 to 5,000 is also preferably used. A styrene oligomer and an α-methylstyrene oligomer are preferred. In particular, an oligomer of styrene and α-methylstyrene is more preferred in view of the solubility.

Furthermore, in order to accelerate the color formation, an amphipathic polymer is also preferably added to the coating solution. To this purpose, a copolymer of acrylic acid or methacrylic acid with an ester thereof is preferably used. In particular, a copolymer of methacrylic acid and butyl acrylate is more preferred because of its large effect.

The dye represented by formula [I] is described below.

In formula [I], D represents a compound residue having a chromophore, X represents dissociative hydrogen or a group having dissociative hydrogen, and y represents an integer of from 1 to 7. The dye represented by formula [I] is characterized by having dissociative hydrogen in the molecular structure.

The compound residue having a chromophore represented by D may be selected from a large number of known dyes.

Examples of the compound include oxonol dye, merocyanine dye, cyanine dye, arylidene dye, azomethine dye, triphenylmethane dye, azo dye, anthraquinone dye and indoaniline dye.

X represents dissociative hydrogen or a group having dissociative hydrogen, bonded to D directly or through a divalent linking group.

Examples of the divalent linking group between X and D include an alkylene group, an arylene group, a heterocyclic residue, —CO—, —$SO_a$— (wherein n is 0, 1 or 2), —NR— (wherein R represents hydrogen atom, an alkyl group or an aryl group), —O— or a divalent group comprising a combination of these linking groups. These groups each may further have a substituent such as alkyl group, aryl group, alkoxy group, amino group, acylamino group, halogen atom, hydroxyl group, carboxy group, sulfamoyl group, carbamoyl group and sulfonamido group. Preferred examples thereof include —$(CH_2)_n$—, (wherein n is 1, 2 or 3), —$CH_2CH(CH_3)CH_2$—, 1,2-phenylene, 5-carboxy-1,3-phenylene, 1,4-phenylene, 6-methoxy-1,3-phenylene and —$CONHC_6H_4$—.

The dissociative hydrogen or group having dissociative hydrogen represented by X has a property such that it is non-dissociative in the condition where the dye represented by formula [I] is added to a silver halide photographic light-sensitive material of the present invention, but is dissociated in the process of developing the light-sensitive material to render the compound of formula [I] to be substantially water-soluble. Examples of the group having dissociative hydrogen represented by X include groups having a carboxylic acid group, a sulfonamide group, a sulfamoyl group, a sulfonylcarbamoyl group, an acylsulfamoyl group or a phenolic hydroxyl group. Examples of the dissociative hydrogen represented by X include hydrogen in the enol group of an oxonol dye.

y is preferably from 1 to 5, more preferably from 1 to 3.

Among the compounds represented by formula [I], preferred are compounds where the group having dissociative hydrogen represented by X is a group having a carboxylic acid group, and more preferred are compounds having an aryl group substituted by a carboxyl group.

The compound represented by formula [I] is more preferably a compound represented by the following formula [II] or [III]:

$$A^1{=}L^1{-}(L^2{=}L^3)_n{-}Q \qquad [II]$$

wherein $A^1$ represents an acidic nucleus, Q represents an aryl group or a heterocyclic group, $L^1$, $L^2$ and $L^3$ each represents a methine group, and m represents 0, 1 or 2, provided that the compound represented by formula [II] has as a water-soluble group within the molecule thereof from 1 to 7 groups selected from the group consisting of a carboxylic acid group, a sulfonamide group, a sulfamoyl group, a sulfonylcarbamoyl group, an acylsulfamoyl group, a phenolic hydroxyl group and an enol group of an oxonol dye.

$$A^1{=}L^1{-}(L^2{=}L^3)_n{-}A^2 \quad [III]$$

wherein $A^1$ and $A^2$ each represents an acidic nucleus, $L^1$, $L^2$ and $L^3$ each represents a methine group, and n represents 0, 1, 2 or 3, provided that the compound represented by formula [III] has as a water-soluble group within the molecule thereof from 1 to 7 groups selected from the group consisting of a carboxylic acid group, a sulfonamide group, a sulfamoyl group, a sulfonylcarbamoyl group, an acylsulfamoyl group, a phenolic hydroxyl group and an enol group of an oxonol dye.

Formulae [II] and [III] are described in detail below.

The acidic nucleus represented by $A^1$ or $A^2$ is preferably derived from a compound having a methylene group interposed between cyclic ketomethylene compounds or between electron attractive groups. Examples of the cyclic ketomethylene compound include 2-pyrazolin-5-one, rhodanine, hydantoin, thiohydantoin, 2,4-oxazolidinedione, isooxazolone, barbituric acid, thiobarbituric acid, indanedione, dioxopyrazolopyridine, hydroxypyridone, pyrazolidinedione and 2,5-dihydrofuran. These compounds each may have a substituent.

The compound having a methylene group interposed between electron attractive groups can be represented by the formula: $Z^1CH_2Z^2$, wherein $Z^1$ and $Z^2$ each represents —CN, $—SO_2R^{11}$, $—COR^{11}$, $—COOR^{12}$, $—CONHR^{12}$, $—SO_2NHR^{12}$ or $—C[{=}C(CN)_2]R^{11}$ (wherein $R^{11}$ represents an alkyl group, an aryl group or a heterocyclic group, and $R^{12}$ represents hydrogen atom or a group represented by $R^{11}$, provided that these each may have a substituent).

Examples of the aryl group represented by Q include a phenyl group and a naphthyl group. These groups each may have a substituent. Examples of the heterocyclic group represented by Q include pyrrole, indole, furan, thiophene, imidazole, pyrazole, indolidine, quinoline, carbazole, phenothiazine, phenoxazine, indoline, thiazole, pyridine, pyridazine, thiadiazine, pyrane, thiopyrane, oxodiazole, benzoquinoline, thiadiazole, pyrrolothiazole, pyrrolopyridazine, tetrazole, oxazole, coumarin and chroman. These groups each may have a substituent.

The methine groups represented by $L_1$, $L^2$ and $L^3$ each may have a substituent and the substituents may be combined with each other to form a 5- or 6-membered ring (e.g., cyclopentene, cyclohexene).

The substituent of each group is not particularly limited as long as it is a substituent incapable of rendering the compound of formula [I], [II] or [III] to be substantially soluble in water having a pH of from 5 to 7. Examples thereof include the following substituents:

a carboxylic acid group, a sulfonamido group having from 1 to 10 carbon atoms (e.g., methanesulfonamido, benzenesulfonamido, butanesulfonamido, n-octanesulfonamido), an unsubstituted or alkyl- or aryl-substituted sulfamoyl group having from 0 to 10 carbon atoms (e.g., unsubstituted sulfamoyl, methylsulfamoyl, phenylsulfamoyl, naphthylsulfamoyl, butylsulfamoyl), a sulfonylcarbamoyl group having from 2 to 10 carbon atoms (e.g., methanesulfonyl-carbamoyl, propanesulfonylcarbamoyl, benzenesulfonylcarbamoyl), an acylsulfamoyl group having from 1 to 10 carbon atoms (e.g., acetylsulfamoyl, propionylsulfamoyl, pivaloylsulfamoyl, benzoylsulfamoyl), a chained or cyclic alkyl group having from 1 to 8 carbon atoms (e.g., methyl, ethyl, isopropyl, butyl, hexyl, cyclopropyl, cyclopentyl, cyclohexyl, 2-hydroxyethyl, 4-carboxybutyl, 2-methoxyethyl, benzyl, phenethyl, 4-carboxybenzyl, 2-diethylaminoethyl), an alkenyl group having from 2 to 8 carbon atoms (e.g., vinyl, allyl), an alkoxy group having from 1 to 8 carbon atoms (e.g., methoxy, ethoxy, butoxy), a halogen atom (e.g., F, Cl, Br), an amino group having from 0 to 10 carbon atoms (e.g., unsubstituted amino, dimethylamino, diethylamino, carboxyethylamino), an ester group having from 2 to 10 carbon atoms (e.g., methoxycarbonyl), an amido group having from 1 to 10 carbon atoms (e.g., acetylamino, benzamido), a carbamoyl group having from 1 to 10 carbon atoms (e.g., unsubstituted carbamoyl, methylcarbamoyl, ethylcarbamoyl), an aryl group having from 6 to 10 carbon atoms (e.g., phenyl, naphthyl, hydroxyphenyl, 4-carboxyphenyl, 3-carboxyphenyl, 3,5-dicarboxyphenyl, 4-methanesulfon-amidophenyl, 4-butanesulfonamidophenyl), an aryloxy group having from 6 to 10 carbon atoms (e.g., phenoxy, 4-carboxyphenoxy, 3-methylphenoxy, naphthoxy), an alkylthio group having from 1 to 8 carbon atoms (e.g., methylthio, ethylthio, octylthio), an arylthio group having from 6 to 10 carbon atoms (e.g., phenylthio, naphthylthio), an acyl group having from 1 to 10 carbon atoms (e.g., acetyl, benzoyl, propanoyl), a sulfonyl group having from 1 to 10 carbon atoms (e.g., methanesulfonyl, benzenesulfonyl), a ureido group having from 1 to 10 carbon atoms (e.g., ureido, methylureido), a urethane group having from 2 to 10 carbon atoms (e.g., methoxycarbonylamino, ethoxycarbonylamino), a cyano group, a hydroxyl group, a nitro group, and a heterocyclic group (e.g., 5-carboxybenzoxazole ring, pyridine ring, sulfolane ring, pyrrole ring, pyrrolidine ring, morpholine ring, piperazine ring, pyrimidine ring, furan ring).

The compound represented by formula [III] is preferably a compound represented by the following formula [IV]. This compound represented by formula [IV] has hydrogen of an enol group as the dissociative hydrogen.

[IV]

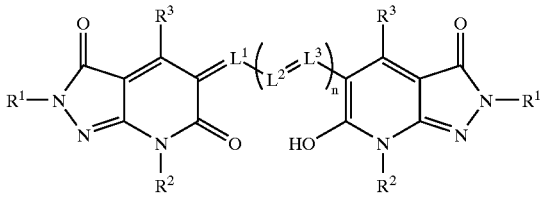

wherein $R^1$ represents hydrogen atom, an alkyl group, an aryl group or a heterocyclic group, $R^2$ represents hydrogen atom, an alkyl group, an aryl group, a heterocyclic group, $—COR^4$ or $—SO_2R^4$, $R^3$ represents hydrogen atom, a cyano group, a hydroxyl group, a carboxyl group, an alkyl group, an aryl group, $—CO_2R^4$, $—OR^4$, $—NR^5R^6$, $—CONR^5R^6$, $—NR^5COR^4$, $—NR^5SO_2R^4$ or $—NR^5CONR^5R^6$ (wherein $R^4$ represents an alkyl group or an aryl group, and $R^1$ and $R^6$ each represents hydrogen atom, an alkyl group or an aryl group), $L^1$, $L^2$ and $L^3$ each represents a methine group, and n represents 1 or 2.

In formula [IV], examples of the alkyl group represented by $R^1$ include an alkyl group having from 1 to 4 carbon atoms, a 2-cyanoethyl group, a 2-hydroxyethyl group and a carboxybenzyl group; examples of the aryl group include a phenyl group, a 2-methylphenyl group, a 2-carboxyphenyl group, a 3-carboxyphenyl group, a 4-carboxyphenyl group, a 3,6-dicarboxyphenyl group, a 2-hydroxyphenyl group, a 3-hydroxyphenyl group, a 4-hydroxyphenyl group, a 2-chloro-4-carboxyphenyl group and a 4-methylsulfamoylphenyl group; and examples of the heterocyclic group include a 5-carboxybenzoxazol-2-yl group.

Examples of the alkyl group represented by $R^2$ include an alkyl group having from 1 to 4 carbon atoms, a carboxymethyl group, a 2-hydroxyethyl group and a 2-methoxyethyl group; examples of the aryl group include a 2-carboxyphenyl group, a 3-carboxyphenyl group, a 4-carboxyphenyl group and a 3,6-dicarboxyphenyl group; examples of the heterocyclic group include a pyridyl group; examples of —$COR^4$ include an acetyl group; and examples of —$SO_2R^4$ include a methanesulfonyl group.

Examples of the alkyl group represented by $R^3$, $R^4$, $R^5$ or $R^6$ include an alkyl group having from 1 to 4 carbon atoms; and examples of the aryl group represented by $R^3$, $R^4$, $R^5$ or $R^6$ include a phenyl group and a methylphenyl group.

In the present invention, $R^1$ is preferably a carboxyl group substituted phenyl group (e.g., 2-carboxyphenyl, 3-carboxyphenyl, 4-carboxyphenyl, 3,6-dicarboxyphenyl).

Specific examples of the compounds represented by formulae [I]to [IV] for use in the present invention are set fourth below, however, the present invention is by no means limited thereto.

(I-1)

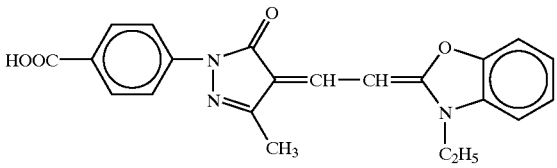

(I-2)

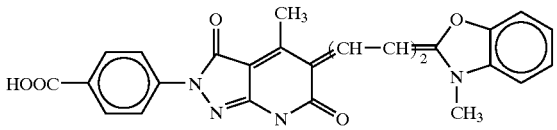

(I-3)

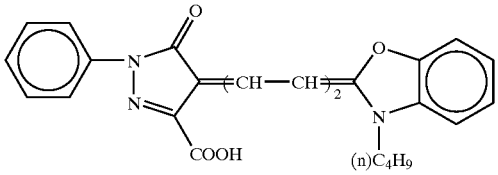

(I-4)

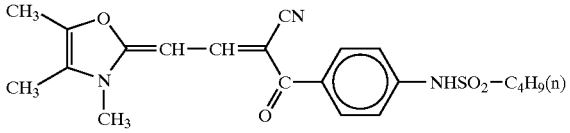

(I-5)

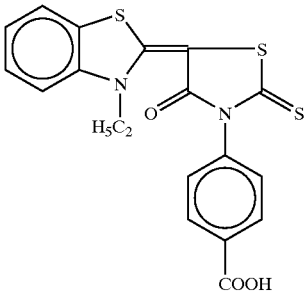

(I-6)

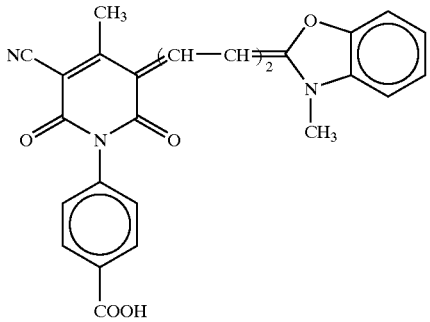

(I-7)

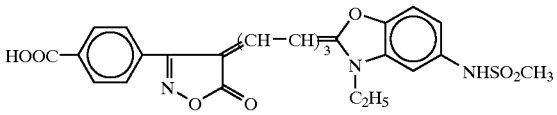

(I-8)

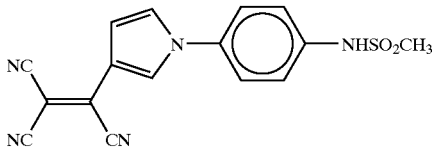

(I-9)

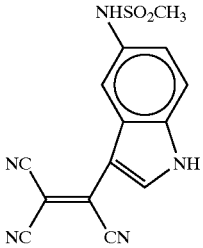

(I-10)

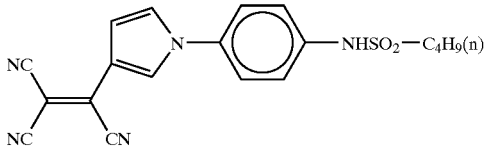

-continued
(I-11)
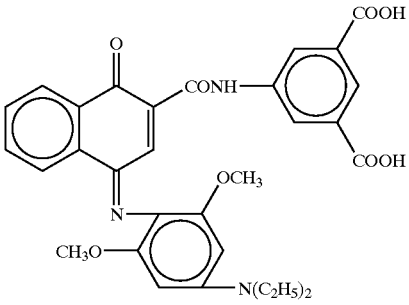
(I-12)
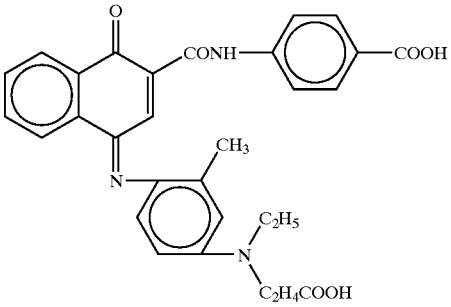
(I-13)
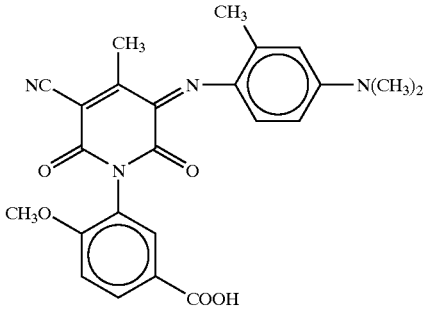
(I-14)
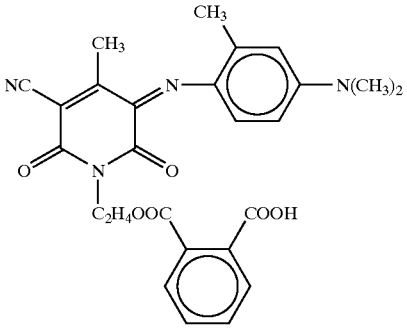
(II-1)
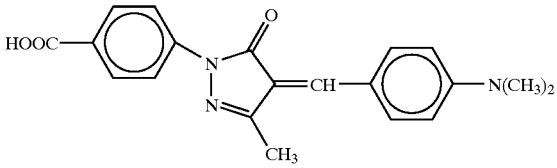
(II-2)
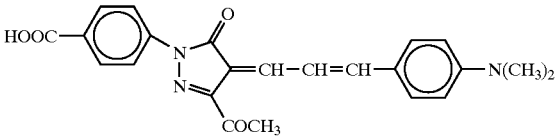
(II-3)
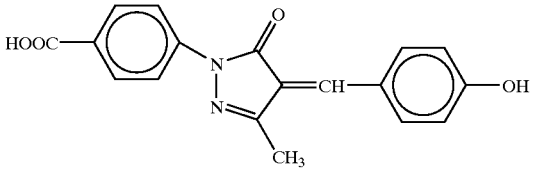
(II-4)
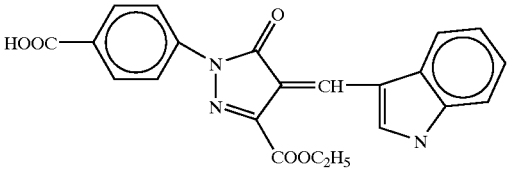
(II-5)
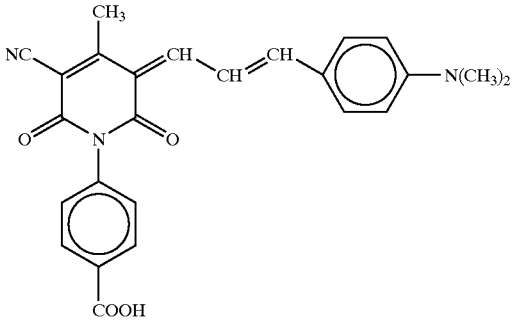
(II-6)
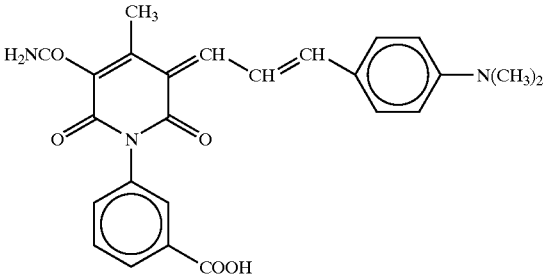
(II-7)
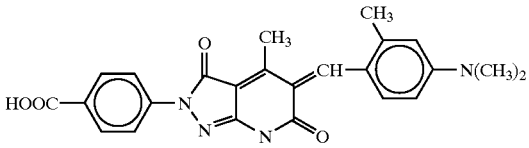
(II-8)
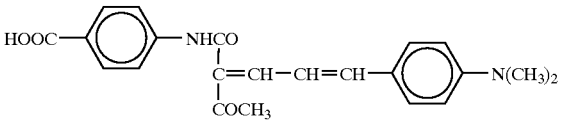

-continued
(II-9)
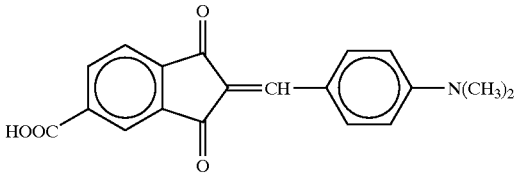
(II-10)
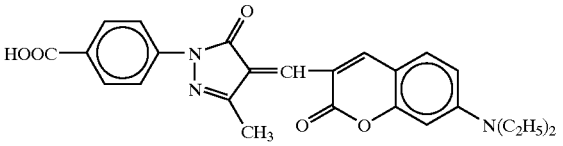
(II-11)
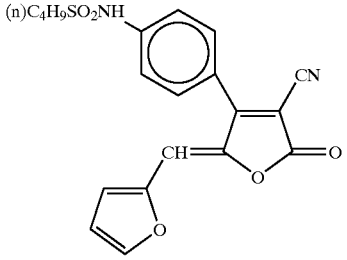
(II-12)
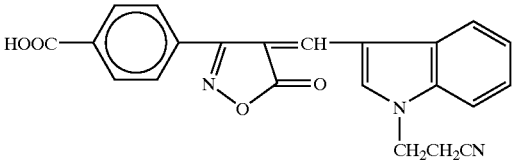
(II-13)
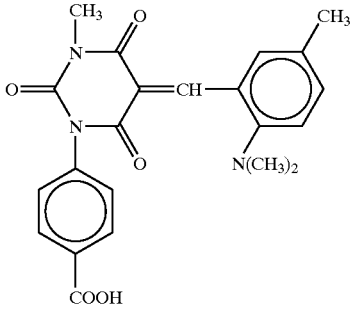
(II-14)
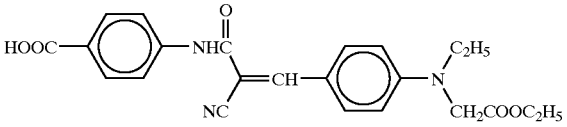
(II-15)
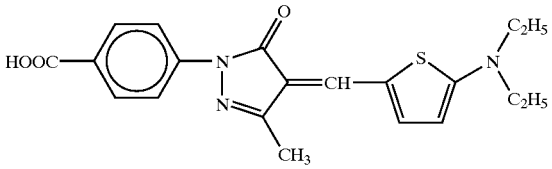
(II-16)
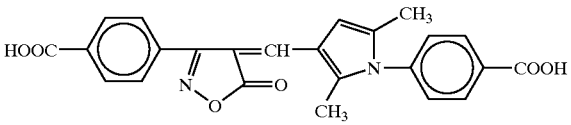
(II-17)
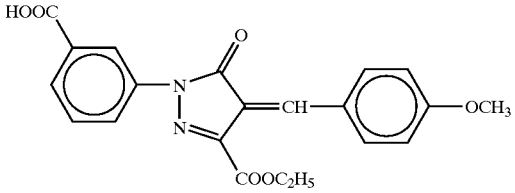
(II-18)
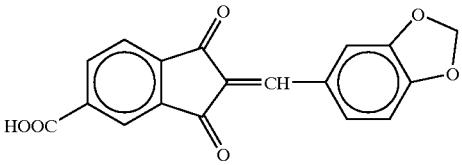
(II-19)
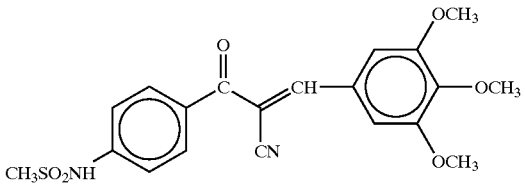
(II-20)
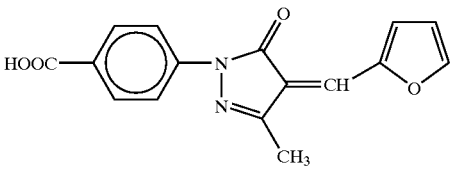

-continued
(II-21)
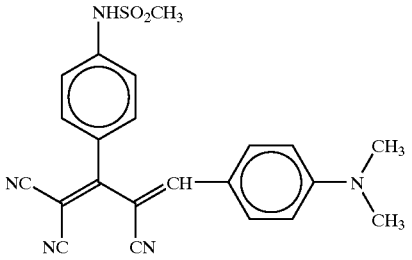
(II-22)
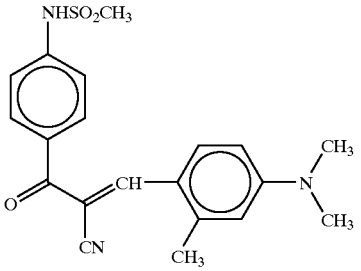
(II-23)
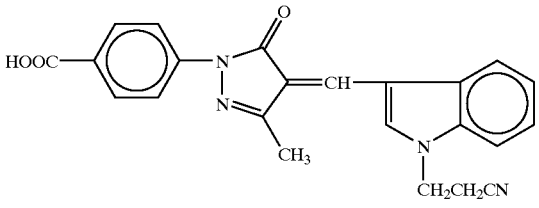
(II-24)
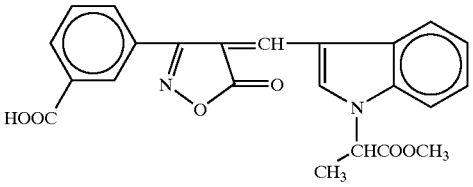
(III-1)
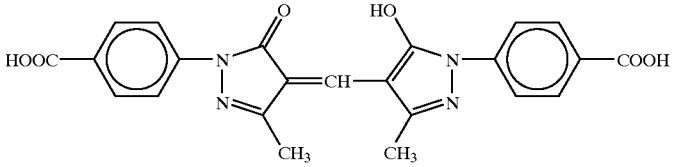
(III-2)
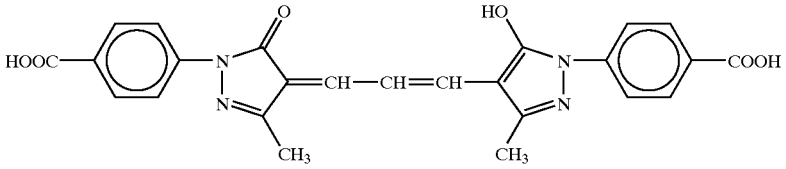
(III-3)
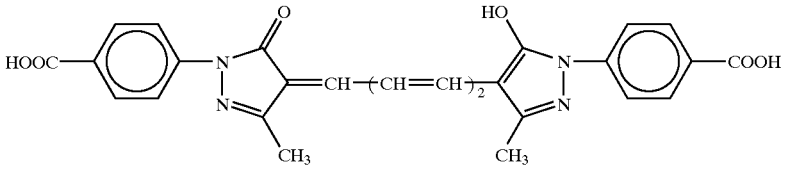
(III-4)
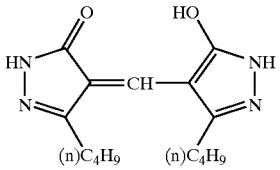
(III-5)
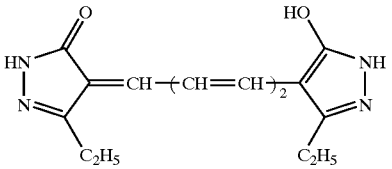
(III-6)
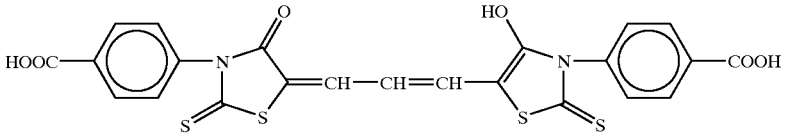

-continued
(III-7)
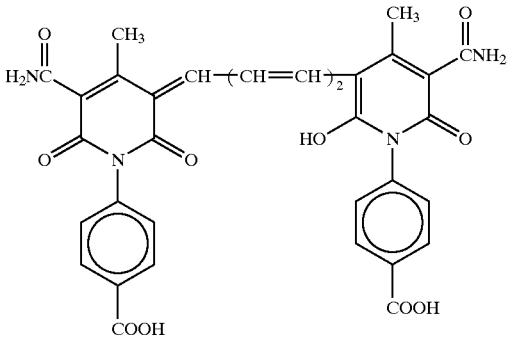
(III-8)
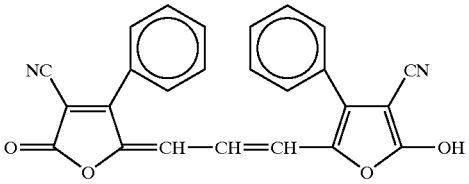
(III-9)
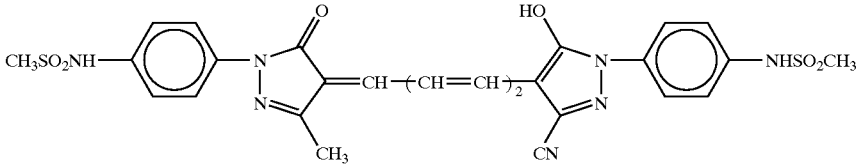
(III-10)
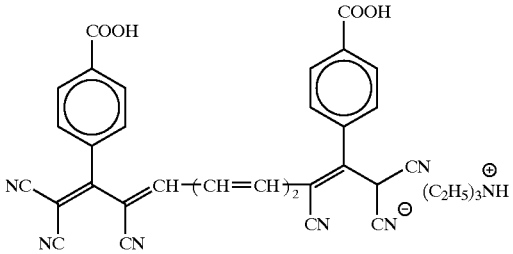
(III-11)
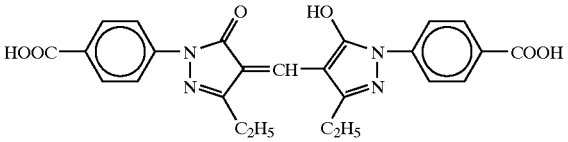
(III-12)
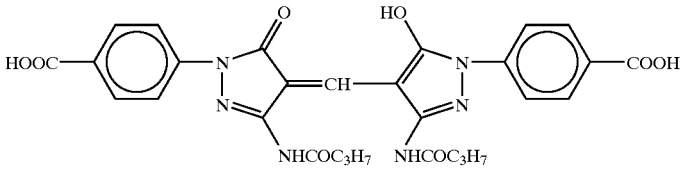
(III-13)
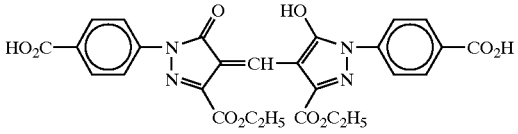
(III-14)
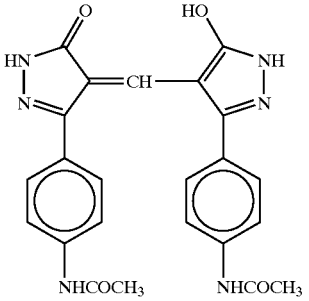
(III-15)
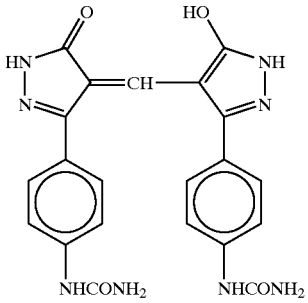
(III-16)
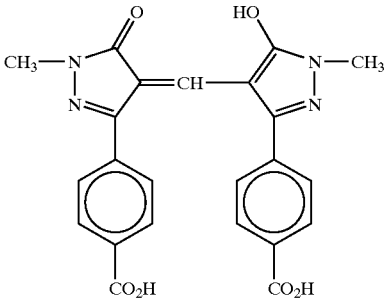

-continued
(III-17)
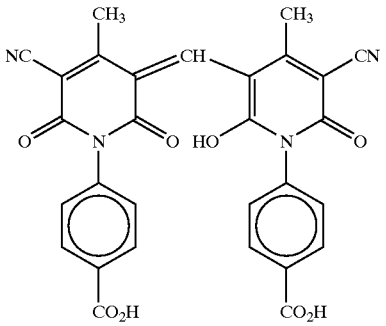
(III-18)
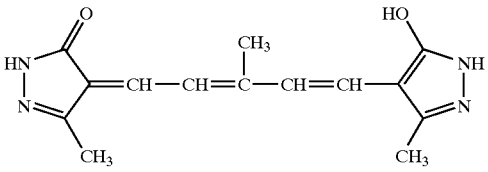
(III-19)
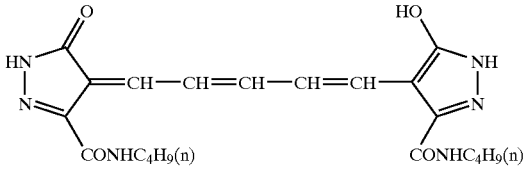
(III-20)
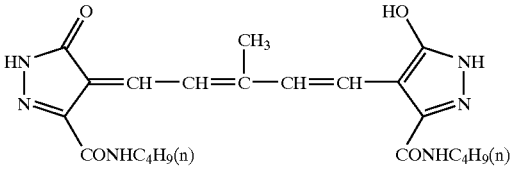
(III-21)
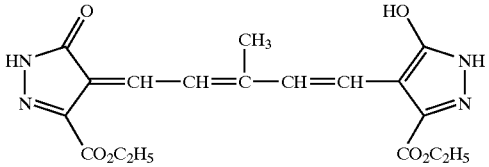
(III-22)
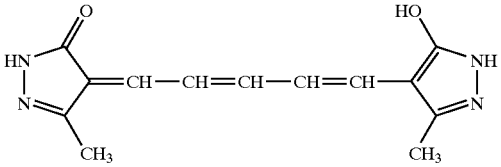
(III-23)
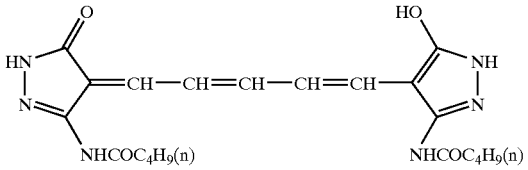
(III-24)
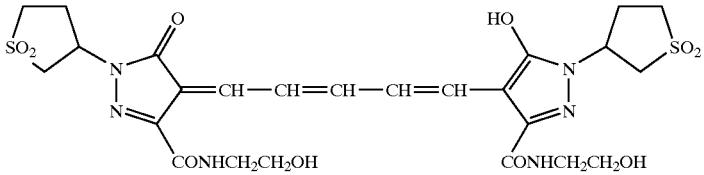
TABLE 1
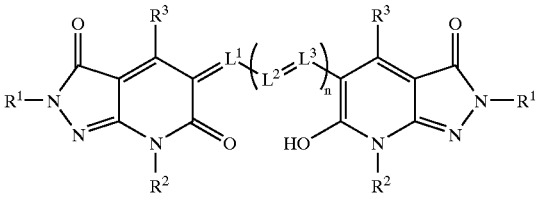
| $R^1$ | $R^2$ | $R^3$ | $=L^1-(L^2=L^3)_n-$ |
|---|---|---|---|
| IV-1 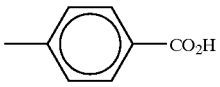 | H | $CH_3$ | =CH—CH=CH— |

TABLE 1-continued
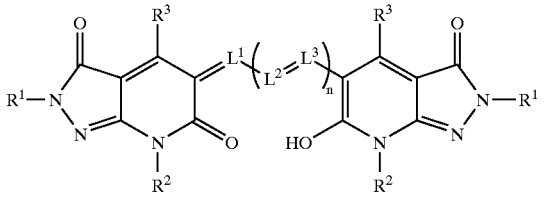
| | $R^1$ | $R^2$ | $R^3$ | $=L^1-(L^2=L^3)_n-$ |
|---|---|---|---|---|
| IV-2 | 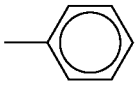 | H | $CH_3$ | =CH—CH=CH— |
| IV-3 | $CH_3$ | H | $CH_3$ | =CH—CH=CH— |
| IV-4 | 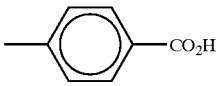 | $CH_3$ | $CH_3$ | =CH—CH=CH— |
| IV-5 | 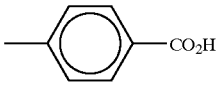 | 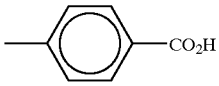 | $CH_3$ | =CH—CH=CH— |
| IV-6 | 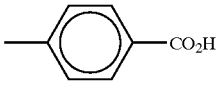 | $CH_3$ | $—CO_2C_2H_5$ | =CH—CH=CH— |
TABLE 2
| | $R^1$ | $R^2$ | $R^3$ | $=L^1-(L^2=L^3)_n-$ |
|---|---|---|---|---|
| IV-7 | 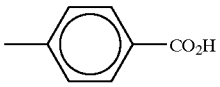 | $CH_3$ | $—CO_2H$ | =CH—CH=CH— |
| IV-8 | $CH_3$ | 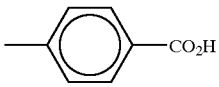 | $CH_3$ | =CH—CH=CH— |
| IV-9 | $CH_3$ | 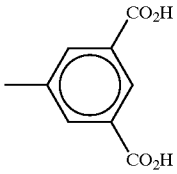 | $CH_3$ | =CH—CH=CH— |
| IV-10 | $CH_3$ | $CH_3$ | $CH_3$ | =CH—CH=CH— |
| IV-11 | 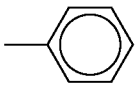 | 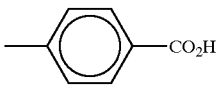 | $CH_3$ | =CH—CH=CH— |
| IV-12 | 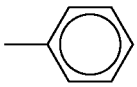 | 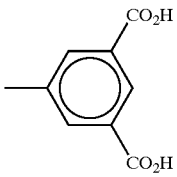 | $CH_3$ | =CH—CH=CH— |

TABLE 3
| | $R^1$ | $R^2$ | $R^3$ | $=L^1-(L^2=L^3)_n-$ |
|---|---|---|---|---|
| IV-13 | 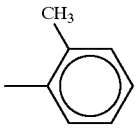 | 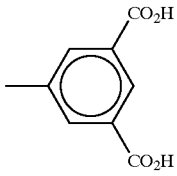 | $CH_3$ | =CH—CH=CH— |
| IV-14 | 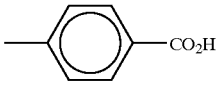 | H | $CH_3$ | 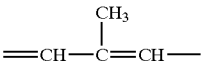 |
| IV-15 | 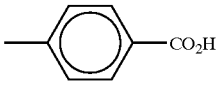 | H | $—CO_2CH_2CH_3$ | =CH—CH=CH— |
| IV-16 | 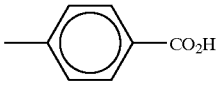 | H | $CO_2H$ | =CH—CH=CH— |
| IV-17 | 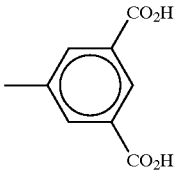 | H | $CH_3$ | =CH—CH=CH— |
| IV-18 | 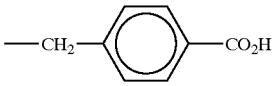 | H | $CH_3$ | 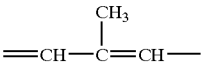 |
TABLE 4
| | $R^1$ | $R^2$ | $R^3$ | $=L^1-(L^2=L^3)_n-$ |
|---|---|---|---|---|
| IV-19 | 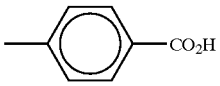 | $—CH_2CH_2—OH$ | H | =CH—CH=CH— |
| IV-20 | 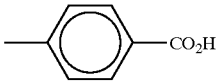 | $—CH_2CO_2H$ | $CH_3$ | 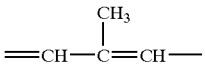 |
| IV-21 | 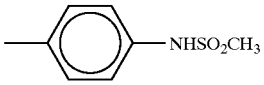 | H | $CH_3$ | =CH—CH=CH— |
| IV-22 | 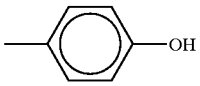 | H | $CH_3$ | =CH—CH=CH— |
| IV-23 | $—CH_2CH_2OH$ | H | $CH_3$ | =CH—CH=CH— |
| IV-24 | $CH_3$ | $—CH_2CH_2OH$ | $CH_3$ | =CH—CH=CH— |
| IV-25 | H | 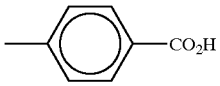 | $CH_3$ | =CH—CH=CH— |
| IV-26 | H | H | $—CO_2H$ | =CH—CH=CH— |

TABLE 5
| | $R^1$ | $R^2$ | $R^3$ | $=L^1-(L^2=L^3)_n-$ |
|---|---|---|---|---|
| IV-27 | 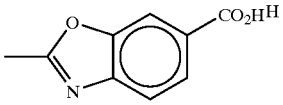 | | $C_2H_5$ | =CH—CH=CH— |
| IV-28 | 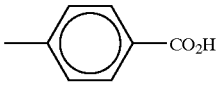 | $—SO_2CH_3$ | $—CO_2CH_3$ | 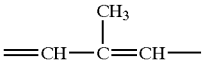 |
| IV-29 | 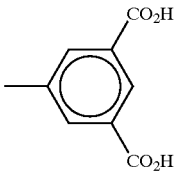 | $—COCH_3$ | $CH_3$ | =CH—CH=CH— |
| IV-30 | H | 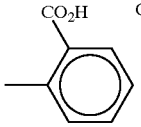 | $CH_3$ | =CH—CH=CH— |
| IV-31 | 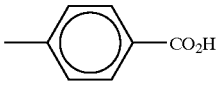 | 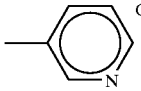 | $CH_3$ | 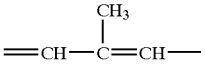 |
| IV-32 | 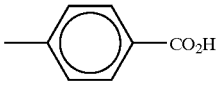 | $CH_3$ | CN | =CH—CH=CH— |
| IV-33 | 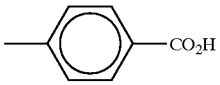 | H | H | =CH—CH=CH— |
| IV-34 | 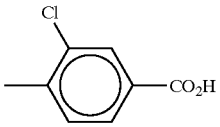 | H | $—OC_2H_5$ | =CH—CH=CH— |
TABLE 6
| | $R^1$ | $R^2$ | $R^3$ | $=L^1-(L^2=L^3)_n-$ |
|---|---|---|---|---|
| IV-35 | 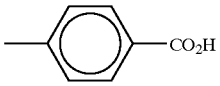 | H | $(n)C_4H_9—$ | =CH—CH=CH— |
| IV-36 | 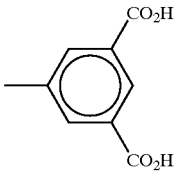 | $CH_3$ | $—NHCH_3$ | =CH—CH=CH— |
| IV-37 | 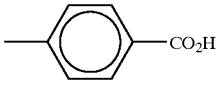 | $—COCH_3$ | $—NHCOCH_3$ | =CH—CH=CH— |

TABLE 6-continued

| | $R^1$ | $R^2$ | $R^3$ | $=L^1-(L^2=L^3)_n-$ |
|---|---|---|---|---|
| IV-38 | 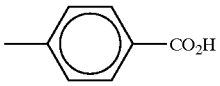 | $-CO_2CH_3$ | $-NHSO_2CH_3$ | $=CH-CH=CH-$ |
| IV-39 | 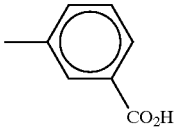 | $-CH_2CH_2OH$ | $CH_3$ | $=CH-CH=CH-$ |
| IV-40 | $-CH_2CH_2CN$ | H | $CH_3$ | $=CH-CH=CH-$ |
| IV-41 | 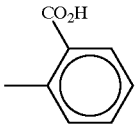 | H | $CH_3$ | $=CH-CH=CH-$ |
| IV-42 | 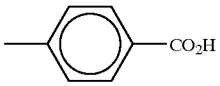 | H | $C_2H_5$ | $=CH-CH=CH-$ |

TABLE 7

| | $R^1$ | $R^2$ | $R^3$ | $=L^1-(L^2=L^3)_n-$ |
|---|---|---|---|---|
| IV-43 | 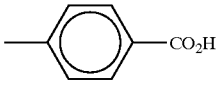 | $-CH_2CH_2OCH_3$ | $CH_3$ | $=CH-C(C_2H_5)=CH-$ |
| IV-44 | 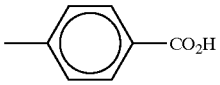 | H | $CH_3$ | $=CH-C(Cl)=CH-$ |
| IV-45 | 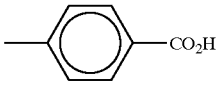 | H | $CO_2H$ | $=CH-C(CH_3)=CH-$ |
| IV-46 | 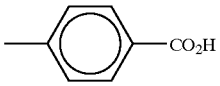 | H | $CO_2H$ | $=CH-C(Cl)=CH-$ |
| IV-47 | $-CH_2CH_2CN$ | 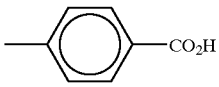 | $CH_3$ | $=CH-CH=CH-$ |
| IV-48 | $-CH_2CH_2CN$ | 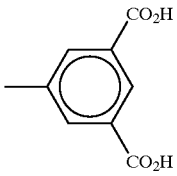 | $CH_3$ | $=CH-CH=CH-$ |
| IV-49 | 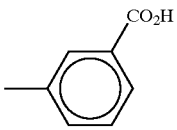 | H | $CH_3$ | $=CH-CH=CH-$ |

TABLE 7-continued

| | $R^1$ | $R^2$ | $R^3$ | $=L^1-(L^2=L^3)_n-$ |
|---|---|---|---|---|
| IV-50 | 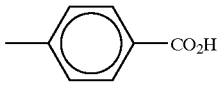 | H | $CH_3$ | =CH—CH=CH—CH=CH— |
| IV-51 | $-CH_3$ | 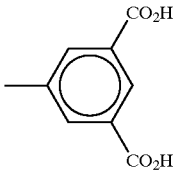 | $CH_3$ | =CH—CH=CH—CH=CH— |

The dye for use in the present invention may be synthesized in accordance with the methods described, for example, in International Patent Publication WO88/04794, EP-A-274723, EP-A-276566, EP-A-299435, JP-A-52-92716, JP-A-55-155350, JP-A-55-155351, JP-A-61-205934, JP-A-48-68623, U.S. Pat. Nos. 2,527,583, 3,486,897, 3,746,539, 3,933,798, 4,130,429 and 4,040,841, JP-A-3-282244, JP-A-3-7931, JP-A-3-167546.

The solid fine particle dispersion of dye for use in the present invention can be prepared by a known method. The production method thereof is described in detail in *Kinosei Ganryo Oyo Gijutsu* (*Application Technique of Functional Pigments*), CMC (1991) and the like.

Media dispersion is one of the methods commonly used. In this method, dye powder or a wet cake thereof as a dye wetted with water or an organic solvent is formed into an aqueous slurry and then mechanically pulverized in the presence of a dispersion media (e.g., steel ball, ceramic ball, glass bead, alumina bead, zirconia silicate bead, zirconia bead, Ottawa sand) using a known pulverizer (e.g., ball mill, vibrating mill, planetary ball mill, vertical sand mill, roller mill, pin mill, co-ball mill, Keddy mill, horizontal sand mill, attritor). The bead preferably has an average particle size of from 0.3 to 2 mm, more preferably from 0.3 to 1 mm, still more preferably from 0.3 to 0.5 mm. Other than these, a pulverization method using a jet mill, a roll mill, a homogenizer, a colloid mill, a dissolver or a ultrasonic disperser may also be employed.

Furthermore, a method of dissolving the dye in a uniform solution and thereafter precipitating solid fine particles by adding a poor solvent disclosed in U.S. Pat. No. 2,870,012 or a method of dissolving the dye in an alkali solution and then precipitating solid fine particles by decreasing the pH disclosed, for example, in JP-A-3-182743 may also be used.

The solid fine particle dispersion is preferably prepared in the presence of a dispersion aid. Examples of heretofore known dispersion aids include anion-type dispersants such as alkylphenoxyethoxy sulfonate, alkyl-benzene sulfonate, alkylnaphthalene sulfonate, alkyl-sulfuric acid ester salt, alkylsulfosuccininate, sodium oleyl methyltauride, formaldehyde polycondensate of naphthalenesulfonic acid, polyacrylic acid, polymethacrylic acid, maleic acid-acrylic acid copolymer, carboxymethyl cellulose and sulfuric aid cellulose; nonion-type dispersants, cation-type dispersants and betaine-type dispersants, such as polyoxyethylene alkyl ether, sorbitan fatty acid ester and polyoxyethylene sorbitan fatty acid ester. In particular, the polyalkylene oxide represented by the following formula [V-a] or [V-b] is preferred:

[V-a]

$$HO-(CH_2CH_2O)_a-(CH_2\underset{\underset{CH_3}{|}}{C}HO)_b-(CH_2CH_2O)_a-H$$

[V-b]

$$HO-(CH_2\underset{\underset{CH_3}{|}}{C}HO)_b-(CH_2CH_2O)_a-(CH_2\underset{\underset{CH_3}{|}}{C}HO)_b-H$$

wherein a and b each represents a value of from 5 to 500. The values a and b each is preferably from 10 to 200, more preferably from 50 to 150. With a and b in this range, the coated surface is advantageously improved in the uniformity.

In the above-described dispersion aid, the ratio of the polyethylene oxide moiety is in terms of the weight ratio preferably from 0.3 to 0.9, more preferably from 0.7 to 0.9, still more preferably from 0.8 to 0.9. The dispersion aid preferably has an average molecular weight of from 1,000 to 30,000, more preferably from 5,000 to 40,000, still more preferably from 8,000 to 20,000. The above-described dispersion aid preferably has HLB (hydrophilicity lipophilicity balance) of from 7 to 30, more preferably from 12 to 30, still more preferably from 18 to 30. With HLB in this range, the coated surface is advantageously improved in the uniformity.

These compounds are available as a commercial product, for example, under a trade name of Pluronic from BASF.

Specific examples of the compounds represented by formulae [V-a] and [V-b] for use in the present invention are set forth below.

TABLE 8

[V-a]

$$HO-(CH_2CH_2O)_a-(CH_2\underset{\underset{CH_3}{|}}{C}HO)_b-(CH_2CH_2O)_a-H$$

| No. | Weight Ratio of Polyethylene Oxide | Average Molecular Weight | HLB |
|---|---|---|---|
| V-1 | 0.5 | 1900 | ≧18 |
| V-2 | 0.8 | 4700 | ≧20 |
| V-3 | 0.3 | 1850 | 7–12 |
| V-4 | 0.4 | 2200 | 12–18 |
| V-5 | 0.4 | 2900 | 12–18 |
| V-6 | 0.5 | 3400 | 12–18 |
| V-7 | 0.8 | 8400 | ≧20 |
| V-8 | 0.7 | 6600 | ≧20 |
| V-9 | 0.4 | 4200 | 12–18 |

TABLE 8-continued

| | | | |
|---|---|---|---|
| V-10 | 0.5 | 4600 | 12–18 |
| V-11 | 0.7 | 7700 | ≧20 |
| V-12 | 0.8 | 11400 | ≧20 |
| V-13 | 0.8 | 13000 | ≧20 |
| V-14 | 0.3 | 4950 | 7–12 |
| V-15 | 0.4 | 5900 | 12–18 |
| V-16 | 0.5 | 6500 | 12–18 |
| V-17 | 0.8 | 14600 | ≧20 |
| V-18 | 0.3 | 5750 | 7–12 |
| V-19 | 0.7 | 12600 | ≧18 |

[V-b]

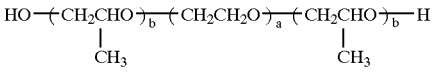

| No. | Weight Ratio of Polyethylene Oxide | Average Molecular Weight | HLB |
|---|---|---|---|
| V-20 | 0.5 | 1950 | 12–18 |
| V-21 | 0.4 | 2650 | 7–12 |
| V-22 | 0.4 | 3600 | 7–12 |
| V-23 | 0.8 | 8600 | 12–18 |

In the present invention, the amount of the dispersion aid used to the dye of the present invention is in terms of the weight ratio preferably from 0.05 to 0.5, more preferably from 0.1 to 0.3. With the amount of dispersion aid used in this range, the coated surface is advantageously improved in the uniformity.

For the purpose of stabilizing the dispersion or reducing the viscosity, a hydrophilic colloid such as polyvinyl alcohol, polyvinyl pyrrolidone, polyethylene glycol, polysaccharide and gelatin, may be allowed to be present together at the preparation of solid fine particle dispersion. In the present invention, a compound represented by formula [VI] which will be described later is preferably allowed to be present together.

The solid fine particle dispersion of dye of the present invention is preferably heat treated before, during or after the dispersion by a method described, as described in JP-A-5-216166.

The dye for use in the present invention is preferably heat treated at 40° C. or more before integrating it into a light-sensitive material. For the heat treatment preferably applied to the dye dispersion used in the present invention, a method of heating the dye powder in a solvent, thus, performing the heat treatment before finely dispersing the dye in the solid form, a method of dispersing the dye in water or other solvent in the presence of a dispersant while not cooling or by raising a temperature, and a method of heat treating the solution after dispersion or the coating solution may be used. Among these, a method of heat treating the dye after the dispersion is preferred.

In the case where a plurality of solid fine particle dispersions each containing the dye of formula (I] are used in a specific layer, it may suffice if at least one solid fine particle dispersion of dye is heat treated.

At the dispersion or during the processing after the dispersion, the pH may be any as long as the condition allows the dispersion to be stably present. However, the pH is preferably from 2.0 to 8.0, more preferably from 2.0 to 6.5, still more preferably from 2.5 to less than 4.5. When the pH during the heat treatment is in this range, the coated matter is advantageously improved in the film (i.e., layer) strength.

The pH of the dispersion may be adjusted, for example, by using sulfuric acid, hydrochloric acid, acetic acid, citric acid, phosphoric acid, oxalic acid, carbonic acid, sodium hydrogencarbonate, sodium carbonate, sodium hydroxide, potassium hydroxide or a buffer solution comprising such an acid or salt.

The heat treatment temperature varies depending on the step where the heat treatment is performed, the size and shape of the powder or particle, the heat treatment conditions or the solvent and cannot be indiscriminately specified and any temperature of 40° C. or more may be used as long as the dye is not decomposed. However, in the case of heat treating the dye in the powder form, the heat treatment temperature is suitably from 40 to 200° C., preferably from 50 to 150° C., more preferably from 90 to 150° C.; in the case of heat treating the dye in a solvent, it is from 40 to 150° C., preferably from 90 to 150° C.; in the case of heat treating the dye during dispersion, the temperature is suitably from 40 to 90° C., preferably 50 to 90° C.; and in the case of heat treating a dispersion solution after the dispersion, it is suitably from 40 to 100° C., preferably from 50 to 95° C. If the heat treatment temperature is less than 40° C., the effect is disadvantageously low.

In the case where the heat treatment is performed in a solvent, the kind of solvent is not particularly limited as long as it does not substantially dissolve the dye. Examples of the solvent include water, alcohols (e.g., methanol, ethanol, isopropyl alcohol, butanol, isoamyl alcohol, octanol, ethylene glycol, diethylene glycol, ethyl cellosolve), ketones (e.g., acetone, methyl ethyl ketone), esters (e.g., ethyl acetate, butyl acetate), alkyl-carboxylic acids (e.g., acetic acid, propionic acid), nitrites (e.g., acetonitrile), ethers (e.g., dimethoxy-ethane, dioxane, tetrahydrofuran) and amides (e.g., dimethylformamide).

Even in the case of a solvent which dissolves the dye when used alone, the solvent may be used by mixing it with water or other solvent and thereby adjusting the pH to a value where the dye is not substantially dissolved. The heat treatment time cannot be also indiscriminately specified. If the temperature is low, a long time is necessary, whereas if the temperature is high, the heat treatment may be accomplished within a short time. The heat treatment time may be freely selected so that heat treatment can be realized within the range of not adversely affecting the production process but usually, it is preferably from 1 hour to 4 days.

A layer containing dye fine particles may be provided in the photographic light-sensitive material by dispersing the fine particles obtained as above in an appropriate binder to prepare a nearly uniform solid dispersion of particles and then coating the dispersion on a desired support.

The binder is not particularly limited as long as it is a hydrophilic colloid which can be used in a light-sensitive emulsion layer or a light-insensitive layer, however, gelatin or a synthetic polymer such as polyvinyl alcohol and polyacrylamide is usually used.

The fine particles in the solid dispersion has an average particle size of from 0.005 to 10 μm, preferably from 0.01 to 1 μm, still more preferably from 0.01 to 0.7 μm. The average particle size in this range is advantageous in the non-coagulating property of fine particles and the light absorption efficiency.

The solid fine particle dispersion of the dye represented by formula [I] for use in the present invention may be used either by itself or in combination with a plurality of solid fine particle dispersions.

The solid fine particle may be added to only one hydrophilic colloid layer or to a plurality of hydrophilic colloid layers. For example, a sole solid fine particle dispersion may be added to only one layer, a sole solid fine particle dispersion may be added in parts to a plurality of layers, a plurality of solid fine particle dispersions may be added at once to only one layer, or respective solid fine particle dispersions may be added to separate layers. However, the present invention is by no means limited thereto.

The solid fine particle dispersion may be added to a silver halide light-sensitive emulsion layer in an amount necessary for the prevention of irradiation in addition to the incorporation in an amount necessary for an antihalation layer.

The hydrophilic colloid layer containing the solid fine particle dispersion of dye represented by formula [I] for use in the present invention is provided between the support and a silver halide emulsion layer most adjacent to the support. Between the support and a silver halide emulsion layer most adjacent to the support, another light-insensitive hydrophilic colloid layer may be provided other than the hydrophilic colloid layer containing the solid fine particle dispersion.

In the present invention, the solid fine particle dispersion of dye is contained in a light-insensitive colloid layer according to the hue of dye, however, in the case of a light-sensitive material where a plurality of light-insensitive layers are provided, the solid fine particle dispersion may be added to these multiple layers.

The dye concentration in the solid fine particle dispersion for use in the present invention is suitably from 0.1 to 50 wt %, preferably from 2 to 30 wt %. The dye concentration in this range is advantageous in the point of viscosity of the dispersion. The solid fine particle dye is preferably coated in an amount of from about 0.05 to 0.5 g/m$^2$.

In the present invention, together with the solid fine particle dispersion, a compound represented by the following formula [VI] is preferably incorporated into the same photographic constituent layer.

$$P((S)_m—R)_n \qquad [VI]$$

wherein R represents hydrogen atom, a hydrophobic group or a hydrophobic polymer, P represents a polymer containing at least one of the following constituent layer units A, B and C and having a polymerization degree of from 10 to 3,500, n represents 1 or 2, and m represents 1 or 0:

A:

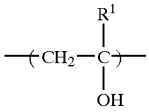

B:

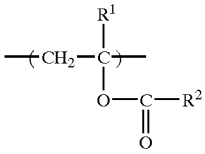

C:

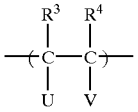

wherein $R^1$ represents —H or an alkyl group having from 1 to 6 carbon atoms, $R^2$ represents —H or an alkyl group having from 1 to 10 carbon atoms, $R^3$ represents —H or —$CH_3$, $R^4$ represents H, —$CH_3$, —$CH_2COOH$ (including ammonium salt and metal salt) or —CN, U represents —H, —COOH (including ammonium salt and metal salt) or —$CONH_2$, V represents —COOH (including ammonium salt and metal salt), —$SO_3H$ (including ammonium salt and metal salt), —$OSO_3H$ (including ammonium salt and metal salt), —$CH_2SO_3H$ (including ammonium salt and metal salt), —$CONHC(CH_3)_2CH_2SO_3H$ (including ammonium salt and metal salt) or —$CONHCH_2CH_2CH_2N^+(CH_3)_3Cl^-$.

Representative examples of the compound represented by formula [VI] include a vinyl alcohol and vinyl ester random or block copolymer of which terminal is modified by an alkyl group or a hydrophobic polymer, and a vinyl alcohol and vinyl ester random or block copolymer further containing a third monomer component having an anionic group such as carboxyl group, of which terminal is modified by an alkyl group or a hydrophobic polymer.

The polyvinyl alcohol (PVA) type polymer has been heretofore used in the photographic field by itself as a protective colloid or in order to improve the film strength, by blending it with a water-soluble protein protective colloid such as gelatin (see, for example, JP-A-63-20349). When the compound represented by formula [VI] is used in combination with the solid fine particle dispersion of dye, the dye and the binder (e.g., gelatin) interact with each other and thereby problems such as difficulty in the coating or in obtaining a coated layer having a desired absorption can be advantageously solved.

The compound represented by formula [VI] which is preferably used in the present invention preferably has a relatively large molecular weight (a molecular weight of 1,000 or more) as compared with the surface active agents heretofore used in the photographic field. Furthermore, the hydrophilic group of conventional surface active agents usually contains one nonionic alkylene oxide group such as ethylene oxide, one anionic group such as carboxyl group, sulfonic group and phosphoric acid group, or one cationic group such as quaternary ammonium group. On the other hand, the hydrophilic group of the compound represented by formula [VI] is necessary to contain one or more structure selected from an OH group-containing monomer unit repeating structure, an anionic group repeating structure and a cationic group repeating structure.

The compound represented by formula [VI] may also be used as a coating aid, an antistatic agent, a surface friction controlling agent or a surface hydrophobitizing agent.

The hydrophobic group represented by R in formula [IV] includes an aliphatic group (e.g., alkyl group, alkenyl group, alkynyl group), an aromatic group (e.g., phenyl group, naphthyl group), an alicyclic group and a substituted form thereof. Examples of the substituent include an aliphatic group, an aromatic group, an alicyclic group, a heterocyclic group, a halogen atom, a hydroxyl group, a cyano group, a nitro group, an N-substituted sulfamoyl group, a carbamoyl group, an acylamino group, an alkylsulfonylamino group, an arylsulfonylamino group, an alkoxy group, an aryloxy group, an aralkyl group and an acyl group.

In the case where the hydrophobic group represented by R in formula [IV] is an alkyl group, the alkyl group is preferably an alkyl group having from 3 to 70 carbon atoms, more preferably from 4 to 50 carbon atoms, still more preferably from 8 to 24 carbon atoms.

When R is a substituted or unsubstituted alicyclic group, aromatic hydrocarbon group or hydrophobic polymer, the effect of increasing the dispersion stability is large.

In the case where R in formula [VI] is a hydrophobic polymer, water-insoluble vinyl polymers or copolymers such as polystyrene and derivatives thereof, polymethacrylic acid esters (e.g., methyl polymethacrylate) and derivatives thereof, polyacrylic acid esters and derivatives thereof, polybutene, polyvinyl acetate and polyvinyl varsatate, water-insoluble polyoxyalkylenes such as polyoxypropylne and polyoxytetramethylene, and water-insoluble polymers such as polyamide and polyester may be used. Among these, polystyrene and derivatives thereof, polymethacrylic acid esters and derivatives thereof, polyacrylic acid esters and derivatives thereof, and polyvinyl chloride are preferred. The hydrophobic polymer preferably has a polymerization degree of from 2 to 500, preferably from 2 to 200, still more preferably from 2 to 100.

Specific examples of the compound represented by formula [VI] where R is a hydrophobic group are set forth below, however, the present invention is by no means limited thereto.

(S-1)

$n\text{-}C_{12}H_{25}$—

(S-2)

$C_{16}H_{33}$—

(S-3)

$C_{12}H_{25}NHCOCH_2$—

(S-4)

$C_{12}H_{25}OCH_2CH_2$—

(S-5)

$(C_{18}H_{37})_2NCH_2CH_2CH_2$—

(S-6)

$C_2H_5SO_2CH_2CH_2$—

(S-7)

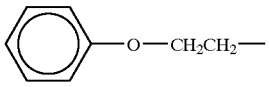

(S-8)

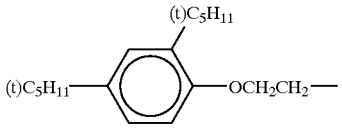

(S-9)

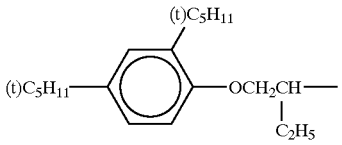

(S-10)

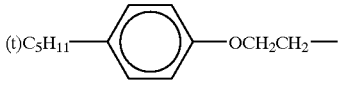

(S-11)

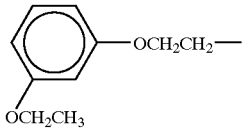

(S-12)

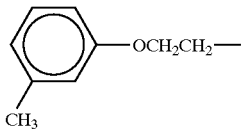

-continued (S-13)

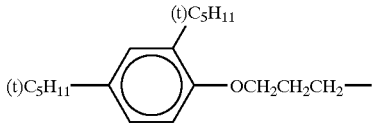

(S-14)

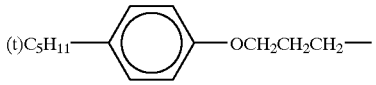

(S-15)

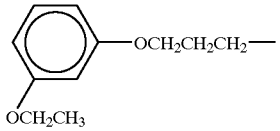

(S-16)

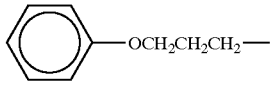

(S-17)

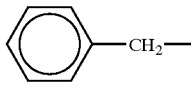

(S-18)

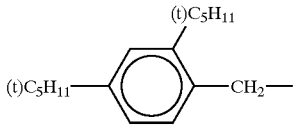

(S-19)

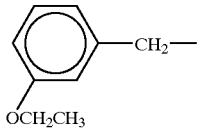

(S-20)

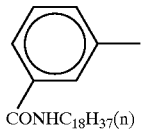

(S-21)

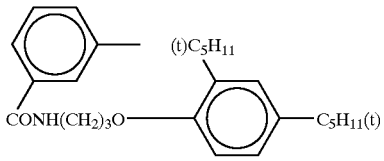

(S-22)

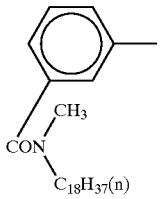

(S-23)

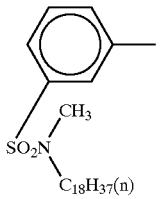

-continued
(S-24)
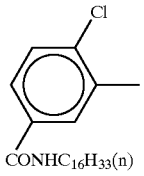
(S-25)
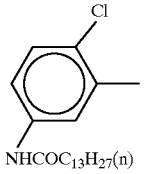
(S-26)
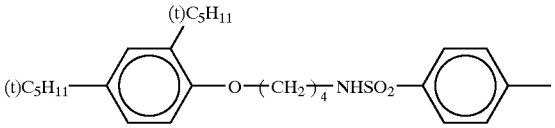
(S-27)
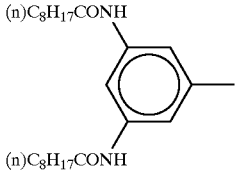
(S-28)
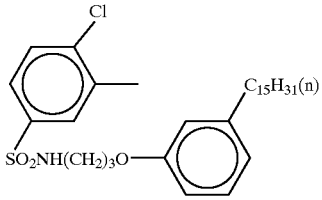
(S--29)
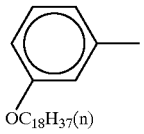
(S-30)
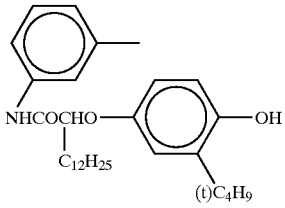
(S-31)
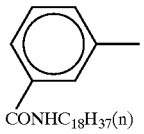
(S-32)
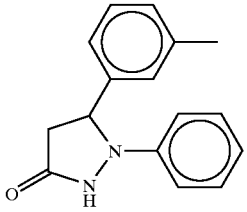
-continued
(S-33)
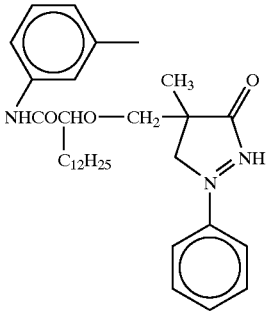
(S-34)
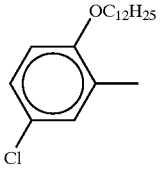
(S-35)
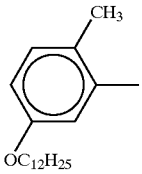
(S-36)
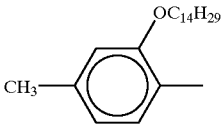
(S-37)
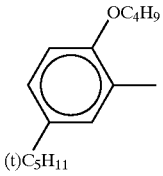
(S-38)
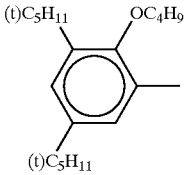
(S-39)
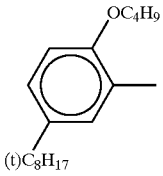
(S-40)
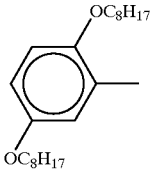

-continued (S-41)

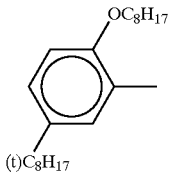

(S-42)

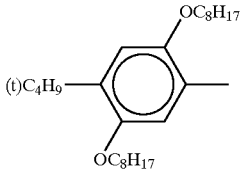

(S-43)

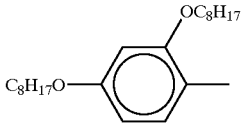

(S-44)

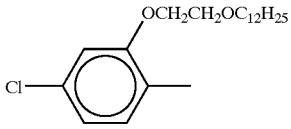

(S-45)

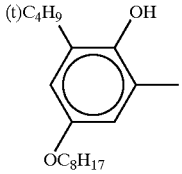

(S-46)

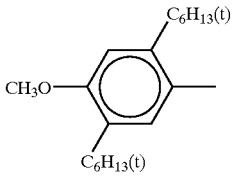

(S-47)

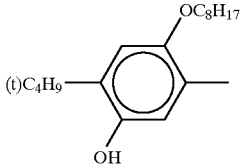

(S-48)

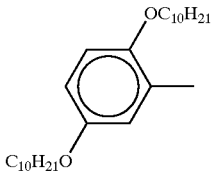

(S-49)

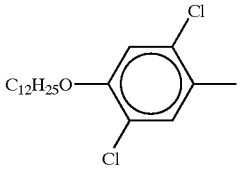

-continued (S-50)

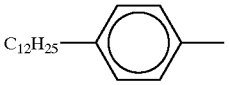

(S-51)

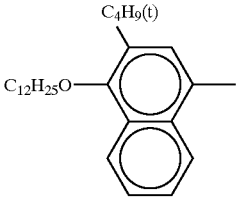

In the compound represented by formula [VI], P is a polymer containing at least one of the above-described structural units A, B and C.

Specific examples of the structural unit A include vinyl alcohol, a-methylvinyl alcohol and α-propylvinyl alcohol.

Specific examples of the structural unit B include vinyl acetate, vinyl formate, vinyl propionate and α-substitution product thereof.

Specific examples of the structural unit C include monomer units which undergo ion dissociation in water, such as acrylic acid, methacrylic acid and crotonic acid (these each including ammonium salt and metal salt such as Na and K); maleic acid and itaconic acid (these each including monoalkyl ester, ammonium salt and metal salt such as Na and K); vinylphosphonic acid, vinylsulfuric acid, acrylsulfonic acid and methacrylsulfonic acid; 2-acrylamide-3-methylpropanesulfonic acid and 2-methacrylamide-3-methyl-propanesulfonic acid (these each including ammonium salt and metal salt such as Na and K); acrylamidopropyl-trimethylammonium chloride and methacrylamidopropyl-trimethylammonium chloride.

Among these, the structural unit A is preferably a vinyl alcohol unit, the structural unit B is preferably a vinyl acetate unit, and the structural unit C is preferably a carboxylic acid (including ammonium salt and metal salt such as Na and K) or a sulfonic acid (including ammonium salt and metal salt such as Na and K).

The contents of structural units A, B and C are not particularly limited, however, in the case where the content of structural unit C is 1 mol % or less, the content of structural unit A is preferably from 50 to 100 mol % so that the polymer represented by formula [VI] can be soluble or dispersible in water.

The compound represented by formula [VI] which is preferably used in the present invention includes compounds over a wide range from water-soluble compounds to water-dispersible compounds. As long as the compound represented by formula [VI] which is preferably used in the present invention is water-soluble or water-dispersible, P may contain a structural unit other than the structural units A, B and C. Examples of such a structural unit include ethylene, propylene, isobutene, acrylonitrile, acrylamide, methacrylamide, N-vinylpyrrolidone, vinyl chloride and vinyl fluoride units.

The polymer represented by P has a polymerization degree of from 10 to 3,500, preferably from 10 to 2,000, more preferably from 10 to 1,000, still more preferably from 10 to 500.

The lower alkyl group represented by $R^2$ in the structural unit A or B includes an alkyl group having from 1 to 10 carbon atoms. Among these, a methyl group is preferred. The alkyl group may be substituted by a hydroxyl group, an amido group, a carboxyl group, a sulfonic acid group, a sulfinic acid group or a sulfonamido group.

As the binder for a hydrophilic colloid layer, gelatin is most commonly used in view of photographic property, production suitability and physical property. In the case where the compound represented by formula [VI] is used by mixing in a ratio of 1 wt % or more to the gelatin, the compound preferably has a composition compatible with gelatin. To satisfy this, the compound has a composition such that the content of structural unit B is 50 mol % or less and the structural unit C contains a carboxyl group, where when one carboxyl group is present per unit, the content of structural unit C is 5 mol % or more, preferably 10 mol % or more, more preferably 15 mol % or more, and when n in number of carboxyl groups are present per unit, the content is preferably 1/n of the content above. In view of compatibility with gelatin, the compound represented by formula [VI] is more preferably a polymer having a composition such that the structural unit A is vinyl alcohol and the content thereof is 50 mol % or more, the structural unit B is vinyl acetate and the content thereof is 40 mol % or less, and the structural unit C is an itaconic acid (including ammonium salt or metal salt such as Na and K) and the content thereof is 2 mol % or more.

The photographic elements usually vary depending on the multi-layered structure of hydrophilic binder but depending on the layer structure, the compound represented by formula [VI] may be used alone as the binder of a certain layer. In such a case, a compound not having a sufficiently high compatibility with gelatin may also be used.

The compound represented by formula [VI] varies in the optimum chemical composition of P and R constituting the compound, the molecular weight and the like depending on the use of the light-sensitive material of the present invention, however, for any purpose, the compound preferably has a composition where P and R satisfy the condition that $0.001 \leqq R/P \leqq 2$, more preferably $0.01 \leqq R/P \leqq 1$.

Specific examples of the compound represented by formula [VI] for use in the present invention are shown in Table A, however, the present invention is by no means limited thereto.

TABLE A

| | | | P | | | | |
|---|---|---|---|---|---|---|---|
| Compound No. | R | Polymerization Degree | Content of A*1 (mol %) | Content of B*2 (mol %) | Content of C (mol %) | Polymerization Degree | n*3 |
| VI-1 | (S-1) | — | 98 | 2 | — | 300 | 1 |
| VI-2 | (S-1) | — | 88 | 12 | — | 300 | 1 |
| VI-3 | (S-1) | — | 98 | 2 | — | 200 | 1 |
| VI-4 | (n)$C_4H_9$ | — | 90 | 10 | — | 78 | 1 |
| VI-5 | (t)$C_8H_{17}$ | — | 88 | 12 | — | 88 | 1 |
| VI-6 | (n)$C_{30}H_{61}$ | — | 88 | 12 | — | 750 | 1 |
| VI-7 | (n)$C_{18}H_{37}$ | — | 98 | 2 | — | 260 | 1 |
| VI-8 | $C_{12}H_{25}$ (branched) | — | 98 | 2 | — | 300 | 1 |
| VI-9 | polymethyl methacrylate | 22 | 94.5 | 2.5 | 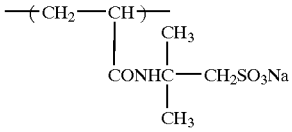 3.0 | 110 | 1 |
| VI-10 | polystyrene | 20 | 93.6 | 1.4 | 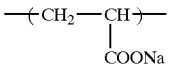 5.0 | 150 | 1 |
| VI-11 | polyoxypropylne | 55 | 79.1 | 15.9 | 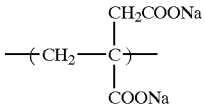 5.0 | 440 | 1 |
| VI-12 | polystyrene | 10 | 89.7 | 0.3 | 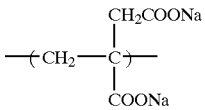 10.0 | 45 | 2 |
| VI-13 | polystyrene | 10 | 0 | 70.0 | 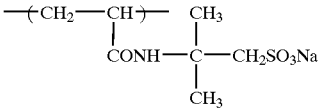 30.0 | 105 | 1 |
| VI-14 | polyoxypropylene | 50 | 95.6 | 2.4 | 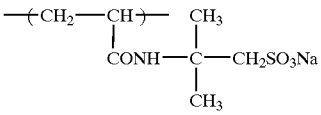 2.0 | 110 | 2 |

TABLE A-continued

| | | | | | | | | |
|---|---|---|---|---|---|---|---|---|
| VI-15 | polystyrene | 20 | 95.4 | 1.6 | $-(CH_2-C(CH_2COONa)(COONa))-$ | 30.0 | 85 | 2 |
| VI-16 | polystyrene | 20 | 88 | 2 | $-(CH_2-C(CH_2COONa)(COONa))-$ | 5.0 | 300 | 1 |
| VI-17 | methyl polymethacrylate | 30 | 88 | 2 | $-(CH_2-C(CH_2COONa)(COONa))-$ | 7.5 | 300 | 1 |
| VI-18 | n-butyl polyacrylate | 30 | 88 | 2 | $-(CH_2-C(CH_2COONa)(COONa))-$ | 10.0 | 300 | 1 |
| VI-20 | (S-1) | — | 88 | 2 | $-(CH_2-C(CH_2COONa)(COONa))-$ | 10.0 | 400 | 1 |
| VI-21 | (S-1) | — | 88 | 2 | $-(CH_2-C(CH_2COONa)(COONa))-$ | 7.5 | 300 | 1 |
| VI-22 | (S-1) | — | 88 | 2 | $-(CH_2-C(CH_2COONa)(COONa))-$ | 5.0 | 300 | 1 |
| VI-23 | n-butyl polymethacrylate | 10 | 98 | 2 | — | | 300 | 1 |
| VI-24 | polystyrene | 20 | 98 | 2 | — | | 300 | 1 |
| VI-25 | (S-7) | — | 98 | 2 | — | | 180 | 1 |
| VI-26 | (S-8) | — | 98 | 2 | — | | 110 | 1 |
| VI-27 | (S-10) | — | 98 | 2 | — | | 190 | 1 |
| VI-28 | (S-18) | — | 98 | 2 | — | | 88 | 1 |
| VI-29 | (S-27) | — | 98 | 2 | — | | 200 | 1 |
| VI-30 | (S-50) | — | 98 | 2 | — | | 200 | 1 |
| VI-31 | (S-39) | — | 93 | 2 | $-(CH_2CH(CH_2COONa))-$ COOH | 5.0 | 400 | 1 |
| VI-32 | (S-50) | — | 93 | 2 | $-(CH_2CH(CH_2COONa))-$ COOH | | 400 | 1 |

| | | | | P | | | | | |
|---|---|---|---|---|---|---|---|---|---|
| | Compound No. | R | Polymerization Degree | Content of A*1 (mol %) | Content of B*2 (mol %) | Content of C (mol %) | Polymerization Degree | n*3 | m*3 |
| | VI-33 | (S-1) | — | 93 | 2 | $-(CH(COONa)-CH(COONa))-$ | 5.0 | 300 | 1 | 1 |

TABLE A-continued

| | | | | | | | | | |
|---|---|---|---|---|---|---|---|---|---|
| VI-34 | (S-39) | — | 93 | 2 | $-(CH(COONa)-CH(COONa))-$ | | 300 | 1 | 1 |
| VI-35 | (S-50) | — | 93 | 2 | $-(CH(COONa)-CH(COONa))-$ | | 300 | 1 | 1 |
| VI-36 | Polystyrene | 20 | 93 | 2 | $-(CH(COONa)-CH(COONa))-$ | | 200 | 1 | 1 |
| VI-37 | H | — | 97 | 2 | $-(CH_2-CH(COOH))-$ | 1 | 400 | 1 | 0 |
| VI-38 | H | — | 88 | 12 | — | | 300 | 1 | 0 |
| VI-39 | H | — | 88 | 10 | $-(CH_2-CH(COOH))-$ | 2 | 300 | 1 | 0 |

*1 $-(CH_2-CH(OH))-$

*2 $-(CH_2-CH(OCOCH_3))-$

*3 $P-((S)_m-R)_n$

In the present invention, the amount of the compound represented by formula [VI] used varies depending on the physical properties and the amount of solid fine particle dispersion used, however, it is usually from 0.001 to 10 $g/m^2$, preferably from 0.002 to 5 $g/m^2$. With the amount of the compound used in this range, the coated surface is advantageously improved in the uniformity.

In the present invention, the compound represented by formula [VI] may be also used as a dispersant in the preparation of the dispersion, may be added after the dispersion or may be added immediately before the coating.

The compound represented by formula [VI] may be synthesized by the method described, for example, in JP-A-62-288643, JP-A-61-254237, JP-A-61-254238, JP-A-61-254239 and JP-A-61-254240. When R in formula [IV] is an alkyl group, the polymer may also be available as a commercial product (for example, MP-103, MP-203, MP-102, produced by Kuraray K.K.).

The non-decolorizable coloring material for use in the present invention is not dissolved out or decolorized at the development and substantially free of changes in the light absorbing property of the layer between before and after the processing. The kind of the coloring material is not particularly limited and various dyes and pigments including known substances may be used.

Examples of known dyes include oxonol dyes, azomethine dyes, azo dyes, benzoquinone dyes, naphthoquinone dyes, anthraquinone dyes, arylidene dyes, styryl dyes, diphenylmethane dyes, triphenylmethane dyes, xanthene dyes, acridine dyes, azine dyes, oxazine dyes, thiazine dyes, perinone dyes, merocyanine dyes, cyanine dyes, indoaniline dyes, phthalocyanine dyes, indigo dyes and thioindigo dyes.

Examples of the pigment include organic pigments such as azo pigments (e.g., insoluble monoazo pigment, insoluble bisazo pigment, azolake pigment, condensed azo pigment, metal complex azo pigment), phthalocyanine pigments, dyed lake pigments (e.g., acidic dye lake, basic dye lake), condensed polycyclic pigments (e.g., quinacridone pigment, thioindigo pigment, perylene pigment, anthraquinone-base pigment, perinone pigment, dioxazine pigment, isoindolenone pigment, diketopyrropyrrole pigment) and other pigments (e.g., nitroso pigment, aryzaline lake pigment, alkali blue).

Specific compounds are described in *Shinpan Senryo Binran* (*New Version of Dye Handbook*), Maruzene (1970), *Color Index*, The Society of Dyers and Coloriests, *Shikizai Kogaku Handbook* (*Dye Engineering Handbook*), compiled by Shiki-Zai Kyokai, Asakura Shoten (1989), and *Kaitei Shinpan Ganryo Binran* (*Revised New Version of Pigment Handbook*).

Specific examples of preferred dyes and pigments are set fourth below, however, the present invention is by no means limited thereto.

D-1
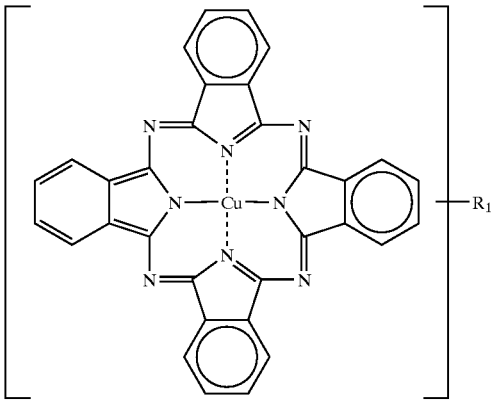
R= —$SO_2NHC_8H_{17}$
D-2
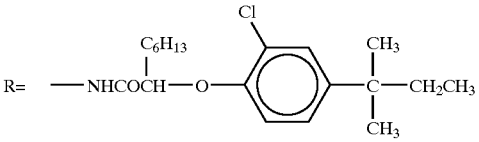
D-3
R= —$SO_2NH(CH_2)_3CH(CH_3)_2$
D-4
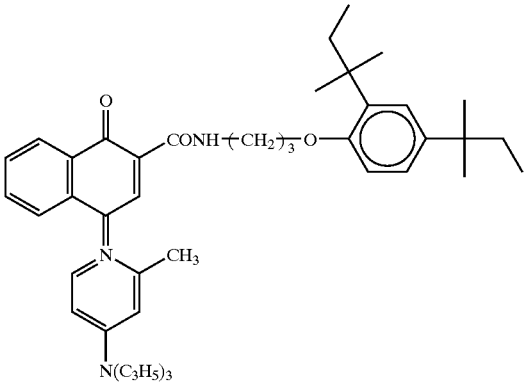
D-5
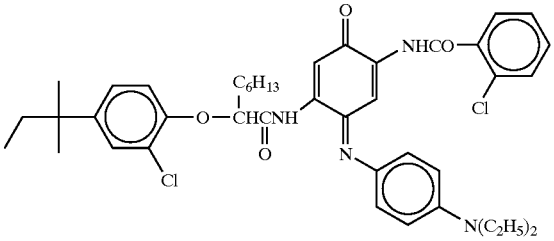
D-6
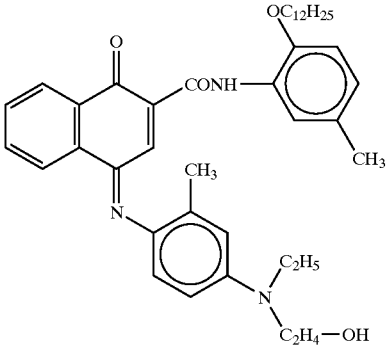
D-7
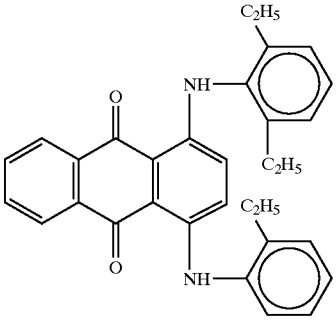
D-8
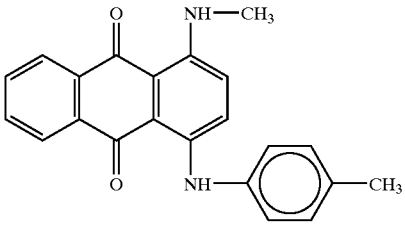
D-9
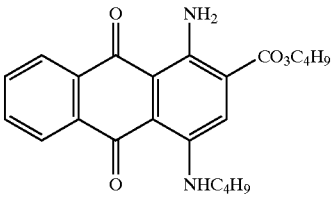

-continued
D-10
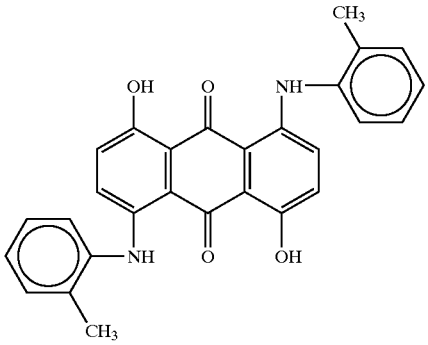
D-11
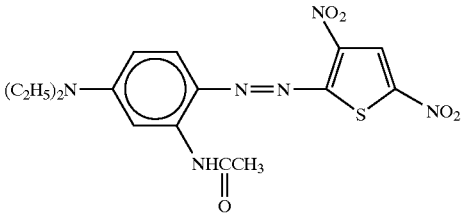
D-12
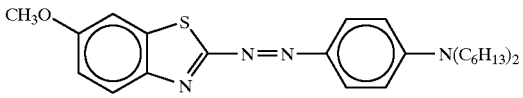
D-13
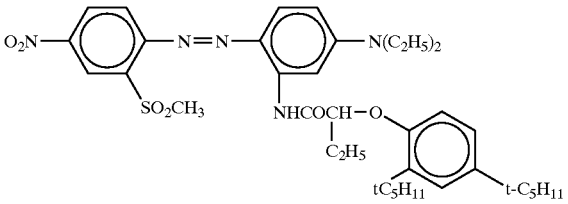
D-14
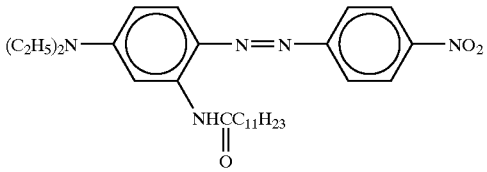
D-15
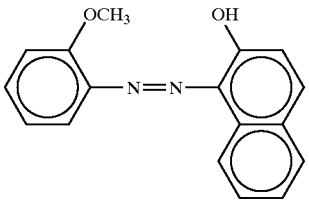
D-16
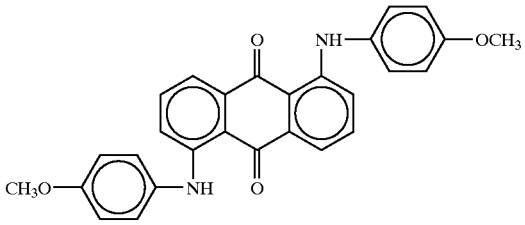
D-17
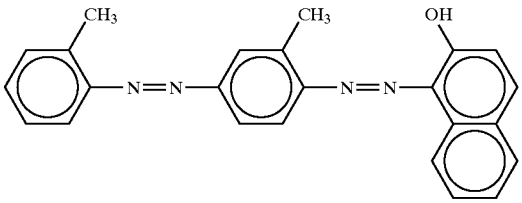
D-18
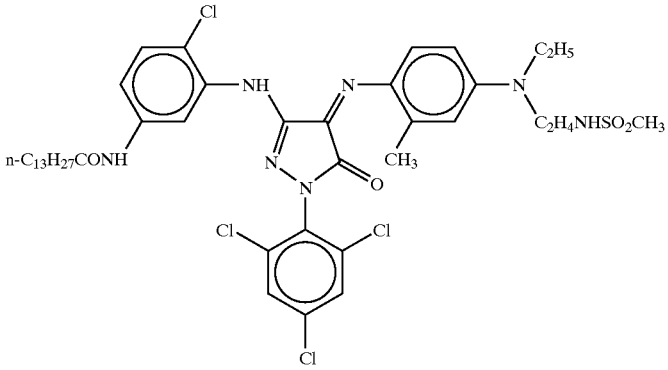

-continued
D-19
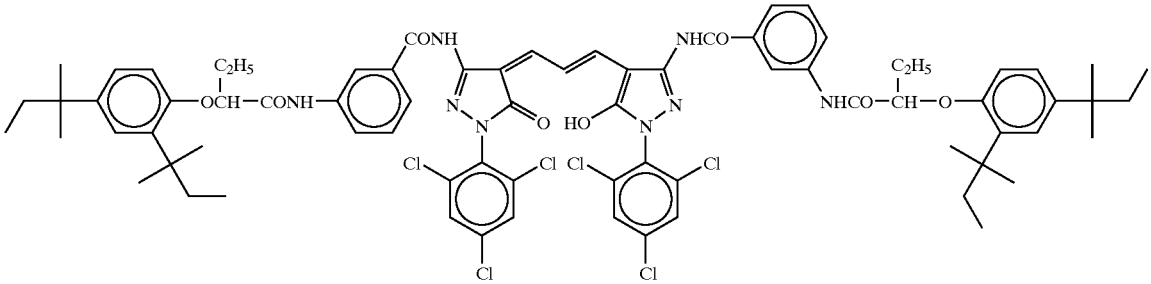
D-20
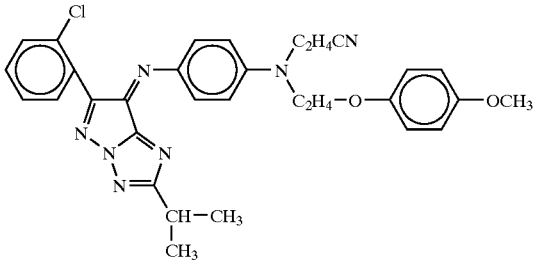
D-21
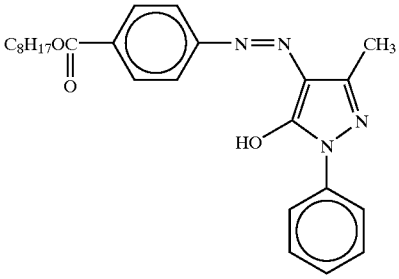
D-22
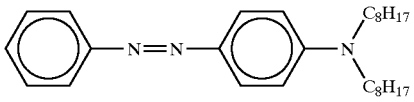
D-23
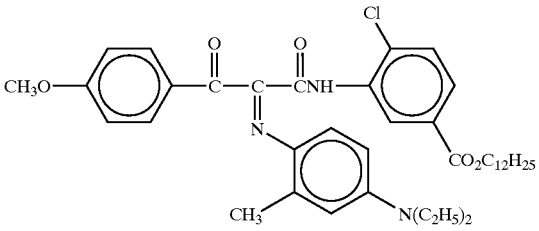
D-24
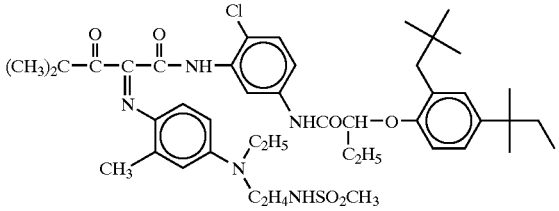
D-25
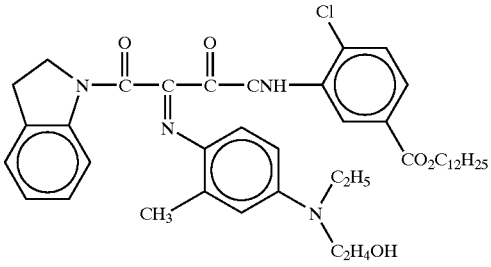
D-26
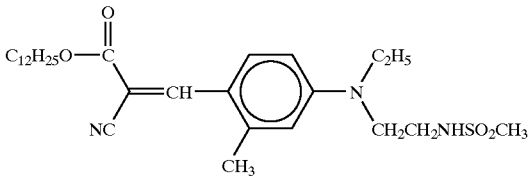
D-27
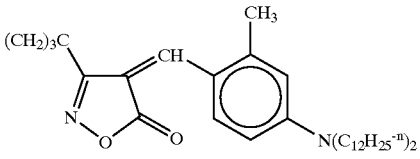
D-28
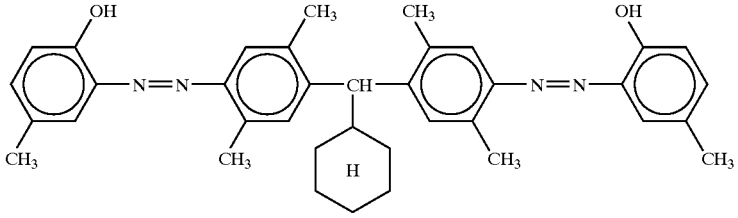

-continued
D-29
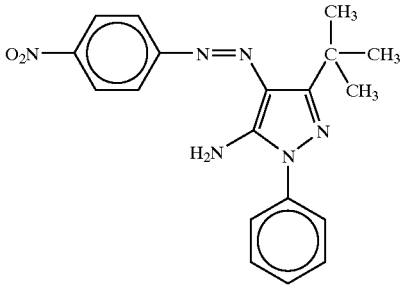
D-30
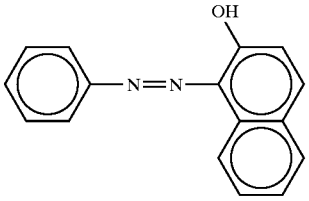
D-31
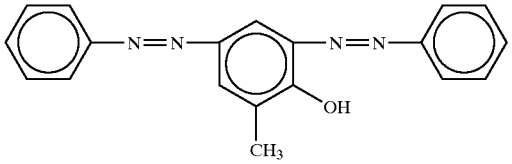
D-32
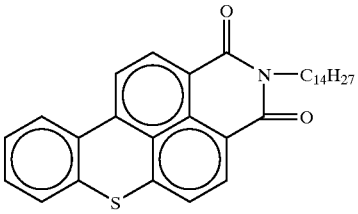
D-33
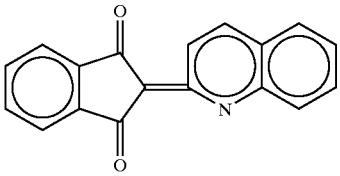
D-34
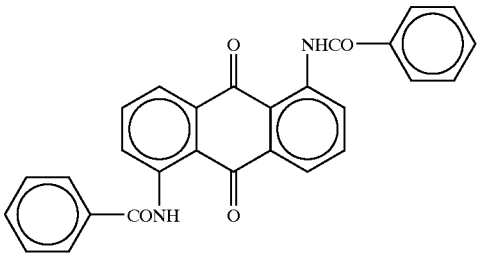
D-35
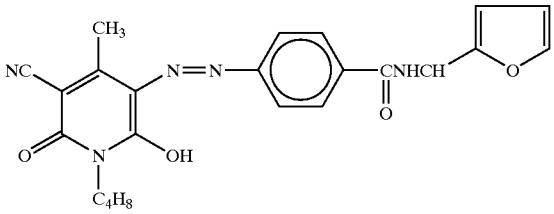
P-1: M=Cu α type, P-2: M=Cu β type, P-3: M=Cu ϵ type,
P-4: no metal, P-5: M=Al
---
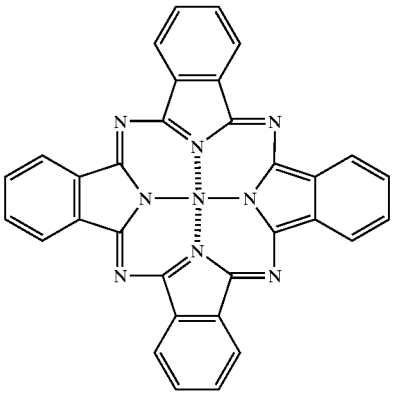
P-1: M = Cu α type,
P-2: M = Cu β type,
P-3: M = Cu ϵ type, -continued
P-4: no metal,
P-5: M = Al
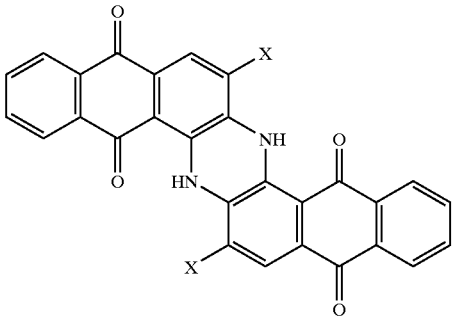
P-6 X = H
P-7 X = Cl
P-8
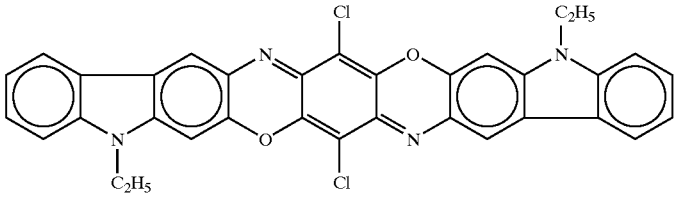
P-9
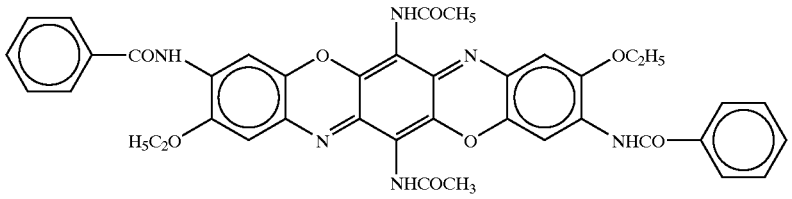
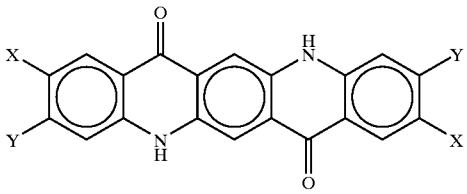
P-10 X = $CH_3$ Y = H
P-11 X = Cl Y = H
P-12 X = H Y = Cl
P-13
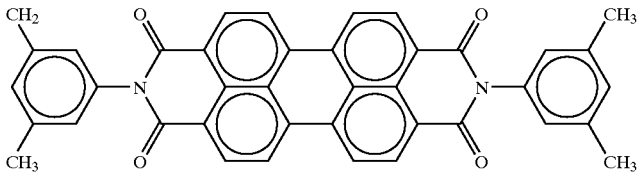
P-14

-continued
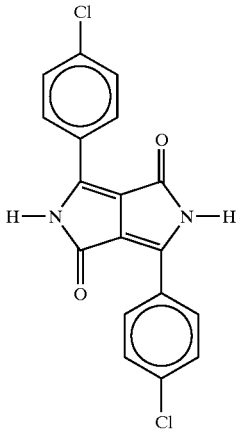
P-15
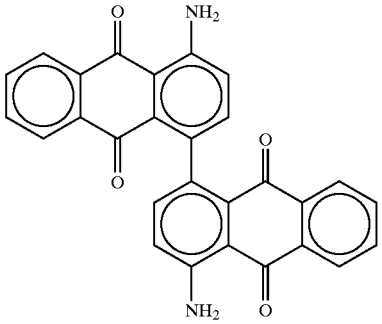
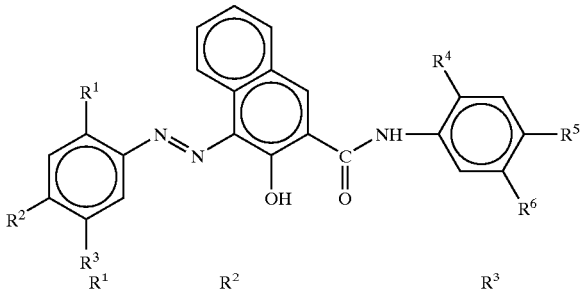
| | $R^1$ | $R^2$ | $R^3$ | $R^4$ | $R^5$ | $R^6$ |
|---|---|---|---|---|---|---|
| P-16 | $OCH_3$ | H | 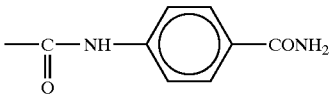 | $OCH_3$ | $OCH_3$ | Cl |
| P-17 | H | $CONH_2$ | H | $OC_2H_4$ | H | H |
| P-18 | $OCH_3$ | H | 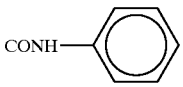 | $OCH_3$ | Cl | $OCH_3$ |
| P-19 | Cl | Cl | Cl | $CH_3$ | H | H |
P-20
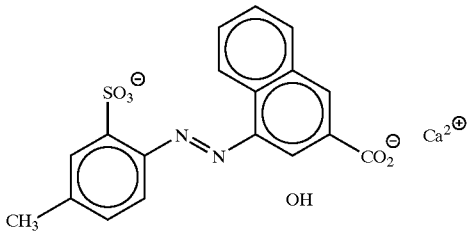

-continued
P-21
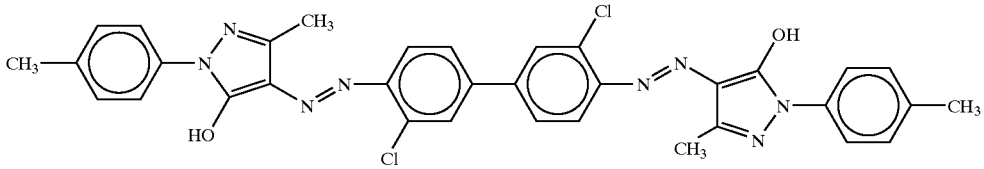
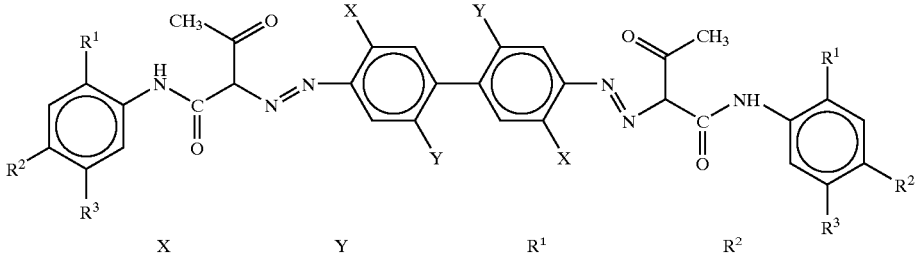
| | X | Y | $R^1$ | $R^2$ | $R^3$ |
|---|---|---|---|---|---|
| P-22 | Cl | H | $OCH_2$ | Cl | $OCH_3$ |
| P-23 | Cl | H | $OCH_3$ | H | H |
| P-24 | Cl | Cl | $CH_3$ | Cl | H |
| P-25 | Cl | H | H | H | H |
P-26
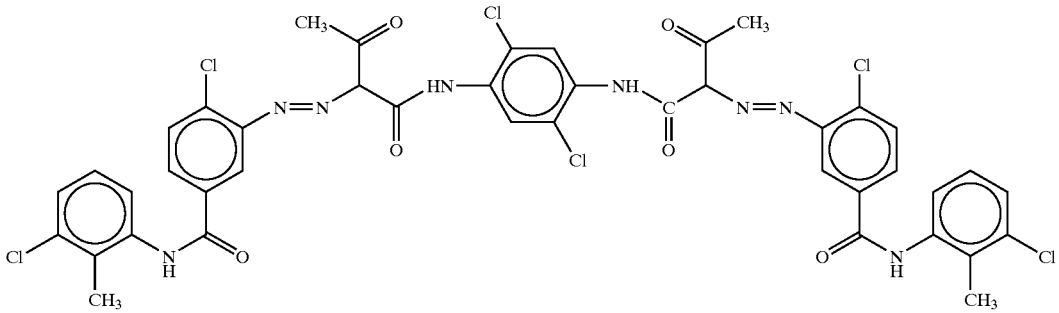
P-27
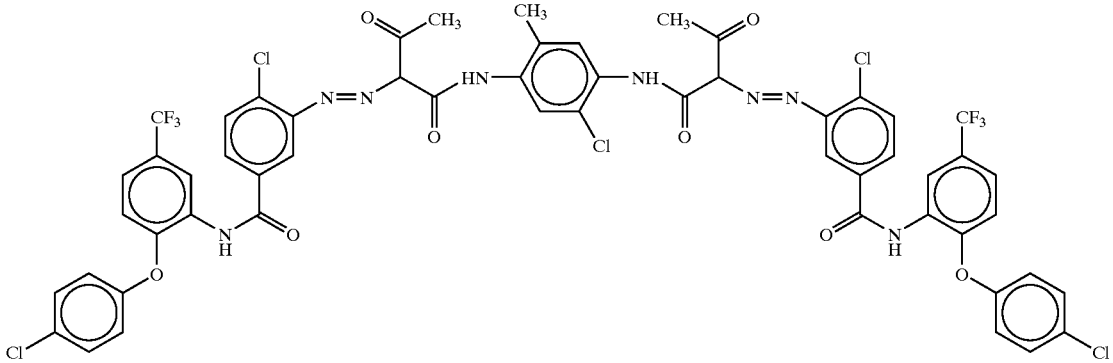
P-28
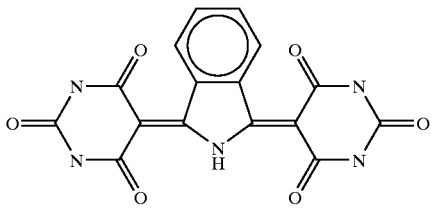

-continued

P-29

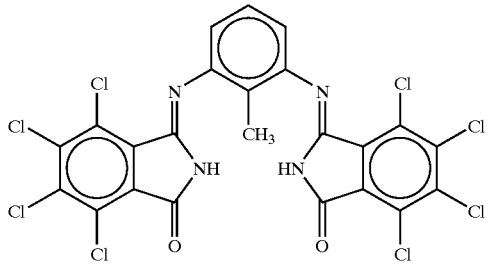

P-30

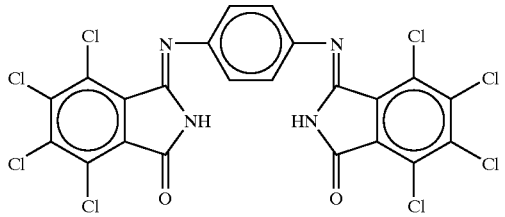

The dye for use in the present invention is added to a photographic material by the following methods.

(1) A method of dissolving the compound in an oil, namely, in a high boiling point solvent substantially insoluble in water and having a boiling point of about 160° C. or more, and adding the solution to a hydrophilic colloid solution to thereby disperse the dye. Examples of the high boiling point solvent which can be used include phthalic acid alkyl esters (e.g., dibutyl phthalate, dioctyl phthalate), phosphoric acid esters (e.g., diphenyl phosphate, triphenyl phosphate, tricresyl phosphate, dioctyl butyl phosphate), citric acid esters (e.g., tributyl acetylcitrate), benzoic acid esters (e.g., octyl benzoate), alkylamides (e.g., diethyllaurylamide), fatty acid esters (e.g., dibutoxyethyl succinate, diethyl azelate) and trimesinic acid esters (e.g., tributyl trimesinate) described in U.S. Pat. No. 2,322,027. Also, an organic solvent having a boiling point of from about 30 to about 150° C., such as lower alkyl acetate (e.g., ethyl acetate, butyl acetate), ethyl propionate, secondary butyl alcohol, methyl isobutyl ketone, β-ethoxyethyl acetate and methyl cellosolve acetate, a solvent readily soluble in water, and an alcohol such as methanol and ethanol may be used.

The ratio of the dye to the high boiling point solvent used is preferably from 10/1 to 1/10 (by weight).

(2) A method of using a polymer, namely a water-insoluble and organic solvent-soluble polymer in place of or in combination with the high boiling point solvent in the method (1) above.

This method is described, for example, in JP-A-5-45794, JP-A-5-45789 and JP-A-5-158190.

(3) A method of incorporating the compound of the present invention and other additives as a polymer latex composition for filling a photographic emulsion layer or other hydrophilic layer.

Examples of the polymer latex include polyurethane polymer and polymers polymerized from vinyl monomer [appropriate examples of the vinyl monomer acrylic acid esters (e.g., methyl acrylate, ethyl acrylate, butyl acrylate, hexyl acrylate, octyl acrylate, dodecyl acrylate, glycidyl acrylate), α-substituted acrylic acid esters (e.g., methyl acrylate, butyl methacrylate, octyl methacrylate, glycidyl methacrylate), acrylamides (e.g., butyl acrylamide, hexyl acrylamide), α-substituted acrylamides (e.g., butyl methacrylamide, dibutyl methacrylamide), vinyl esters (e.g., vinyl acetate, vinyl butyrate), vinyl halides (e.g., vinyl chloride), vinylidene halides (e.g., vinylidene chloride), vinyl ethers (e.g., vinyl methyl ether, vinyl octyl ether), styrenes, X-substituted styrenes (e.g., α-methylstyrene), nucleus-substituted styrenes (e.g., hydroxystyrene, chlorostyrene, methylstyrene), ethylene, propylene, butylene, butadiene and acrylonitrile; these may be used individually, in combination of two or more thereof or in combination with another vinyl monomer as a minor component; and other examples of the vinyl monomer include itaconic acid, acrylic acid, methacrylic acid, hydroxyalkyl acrylate, hydroxyalkyl methacrylate, sulfoalkyl acrylate, sulfoalkyl methacrylate and styrenesulfonic acid].

The filling polymer latex may be produced in accordance with the method described, for example, in JP-B-51-39853, JP-A-51-59943, JP-A-53-137131, JP-A-54-32552, JP-A-54-107941, JP-A-55-133465, JP-A-56-19043, JP-A-56-19047, JP-A-56-126830 and JP-A-58-149038.

The ratio of the compound to the polymer latex used is preferably from 10/1 to 1/10 (by weight).

(4) A method of using a hydrophilic polymer in place of or in combination with the high boiling point solvent in the method (1) above. This method is described, for example, in U.S. Pat. No. 3,619,195 and West German Patent 1,957,467.

(5) A method of dissolving the compound using a surface active agent.

As the surface active agent, an oligomer and a polymer are useful.

These polymers are described in detail in JP-A-60-158437, pages 19 to 27. Surface active gents described in JP-A-53-138726 are particularly preferred.

To the colloid dispersion obtained above, a hydrosol of a hydrophilic polymer described, for example, in JP-B-51-39835 (the term "JP-B" as used herein means an "examined published Japanese patent publication") may be added.

The hydrophilic colloid is representatively gelatin but any other conventionally known hydrophilic colloid which can be used in the photographic field may be used.

The pigment for use in the present invention may be either an untreated pigment or a pigment subjected to surface treatment. The pigment may be surface treated by a method of coating resin or wax on the surface, a method of attaching a surface active agent, or a method of bonding a reactive substance (e.g., silane coupling agent, epoxy compound, polyisocyanate). These are described in *Kinzoku Sekken no Seishitsu to Oyo* (*Properties and Applications of Metal Soap*), Saiwai Shobo, *Insatsu Ink Gijutsu* (*Printing Ink Technology*), CMC Shuppan (1984), and *Saishin Ganryo Oyo Gijutsu* (*Newest Application Technology of Pigment*), CMC Shuppan (1986).

In the present invention, the pigment is used after dispersing it in a binder. According to the binder and pigment used, various dispersants such as surface active agent-type low molecular dispersant and high molecular-type dispersant may be used. However, in the case of using the pigment in a hydrophobic binder, a high molecular-type dispersant is preferably used in view of dispersion stability. Examples of the dispersant include those described in JP-A-3-69949 and European Patent 549,486.

The pigment which can be used in the present invention preferably has a particle size after the dispersion of from 0.01 to 10 $\mu$m, more preferably from 0.05 to 1 $\mu$m.

As the method for dispersing the pigment in a binder, a known dispersion technique for use in the production of ink or toner may be used. Examples of the dispersing machine include sand mill, attritor, pearl mill, supermill, ball mill, impeller, disperser, KD mill, colloid mill, Dynatron, three-roll mill and pressure kneader. These are described in detail in *Saishin Ganryo Oyo Gijutsu* (*Newest Application Technology of Pigment*), CMC Shuppan (1986).

The amount of the dye or pigment coated greatly varies depending on the absorbance or the like, however, it is generally from 1 to 200 mg/m$^2$, preferably from 5 to 100 mg/m$^2$, more preferably from 10 to 50 mg/m$^2$.

The compound represented by formula (XI) is described in detail below.

The aliphatic group represented by $R_1$, $R_2$, $R_3$, $R_4$, $R_5$, $R_6$, $R_7$, $R_8$, or $R_9$ is preferably an unsubstituted alkyl group (e.g., methyl, n-butyl, isopropyl, sec-butyl, n-hexyl), a substituted alkyl group {the substituent is preferably a halogen atom (e.g., F, Cl, Br) (such as 2-chloromethyl, trifluoromethyl, difluoromethyl and 1,1,2,2-tetrafluoro-ethyl), a phenyl group (such as benzyl, phenethyl, 4-chlorobenzyl, 4-methoxybenzyl, 2-sulfobenzyl, 4-sulfobenzyl, 4-sulfophenethyl and 4-sulfopropyloxybenzyl), a hydroxy group (such as 2-hydroxyethyl and 3-hydroxypropyl), a cyano group (such as 2-cyanoethyl), a carboxyl group (such as carboxymethyl, 2-carboxyethyl and 4-carboxybutyl), a sulfo group (such as sulfomethyl, 2-sulfoethyl, 3-sulfopropyl, 4-sulfobutyl and 6-sulfohexyl), an alkoxy group (such as 2-methoxyethyl, 2-(2-hydroxyethoxy)ethyl and 2-ethoxyethyl), an amino group (such as dimethylamino and diethylamino) or an ester group (such as ethoxycarbonylmethyl and 2-methoxycarbonylethyl)} or a cycloalkyl group (e.g., cyclopentyl and cyclohexyl).

The aromatic group represented by $R_1$, $R_2$, $R_3$, $R_4$, $R_5$, $R_6$, $R_7$, $R_8$ or $R_9$ is preferably an unsubstituted aryl group (e.g., phenyl, naphthyl) or a substituted aryl group {the substituent is preferably a sulfo group (such as 3-sulfophenyl, 4-sulfophenyl, 2,5-disulfophenyl, 3,5-disulfophenyl and 2,4-disulfophenyl), a carboxy group (such as 2-carboxyphenyl and 4-carboxyphenyl), an alkoxy group (such as 4-methoxyphenyl, 4-(3-sulfopropyloxy)phenyl and 4-methoxy-3-sulfophenyl), an alkyl group (such as p-tolyl, 2-methyl-4-sulfophenyl), a hydroxy group (such as 3-hydroxyphenyl and 4-hydroxyphenyl), an amino group (such as 4-dimethylaminophenyl, 4-diethylaminophenyl and 3-[N-methyl-N-(2-sulfoethyl)amino]phenyl), a cyano group (such as 4-cyanophenyl) or an ester group (such as 4-ethoxycarbonylphenyl)}.

The heterocyclic group represented by $R_1$, $R_2$, $R_3$, $R_4$, $R_5$ or $R_6$ is preferably a 5- or 6-membered heterocyclic group containing at least one nitrogen atom (such as 2-pyridyl, 5-sulfobenzimidazol-2-yl, 5-carboxybenzothiazol-2-yl, morpholino, piperidino).

Examples of the 5- or 6-membered ring formed by connecting $R_7$ and $R_8$ or $R_8$ and $R_9$ include a piperidine ring, a pyrrolidine ring, a morpholine ring and a pyrrolidone ring.

The methine group represented by $L_1$, $L_2$ or $L_3$ is preferably an unsubstituted methine group but may have a substituent (e.g., methyl, ethyl, sulfoethyl, chlorine atom, cyano).

$M^{n+}$ is a n-valence cation (n is 1, 2 or 3) (e.g., $H^+$, $Na^+$, $K^+$, $Ca^{2+}$, $NH_4^+$, $NH(C_2H_5)_3^+$, $(^nC_4H_9)_4N^+$, pyridinium cation, $(C_6H_5)_4P^+$, $(HOCH_2)_4P^+$).

When the compound represented by formula (XI) has a sulfo group or a carboxy group, these groups each may form a free acid or a base (e.g., inorganic salt such as Na, K and $NH_4$ salts, organic amine salt such as triethylammonium and pyridinium salts).

Among the compounds represented by formula (XI), preferred are compounds where $R_1$, $R_2$, $R_3$, $R_4$, $R_5$ and $R_6$ each is a sulfo group, a carboxyl group or a group having at least one sulfo or carboxyl group, more preferred are compounds where $R_2$ and $R_5$ each is a cyano group or a substituted or unsubstituted carbamoyl group and $R_1$ and $R_4$ each is a group having at least one sulfo or carboxyl group, and still more preferred are compounds where $R_2$ and $R_5$ each is a cyano group or a substituted or unsubstituted carbamoyl group, $R_1$ and $R_4$ each represents an aliphatic or aromatic group having at least one sulfo or carboxy group, and $R_3$ and $R_6$ each represents an aliphatic group or an aromatic group.

Specific examples of the compound represented by formula (XI) are set forth below, however, the present invention is by no means limited thereto.

XI-1
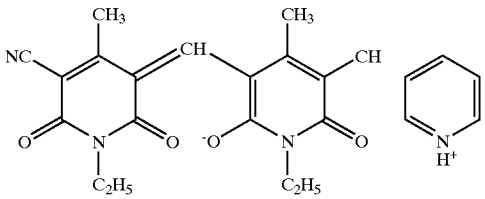
XI-2
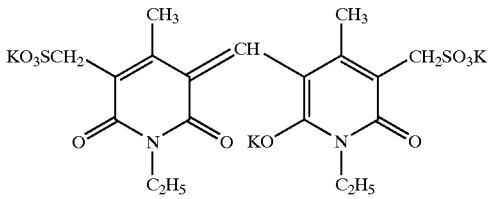
XI-3
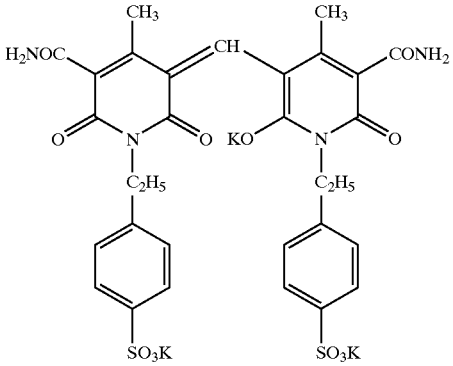
XI-4
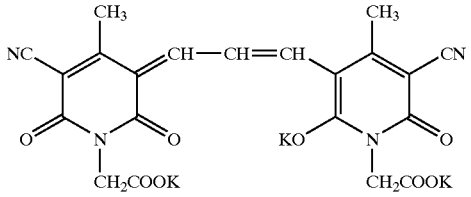
XI-5
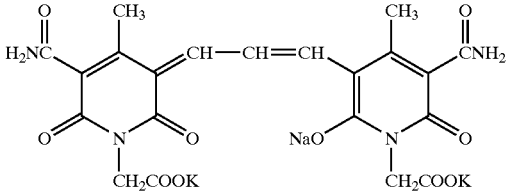
XI-6
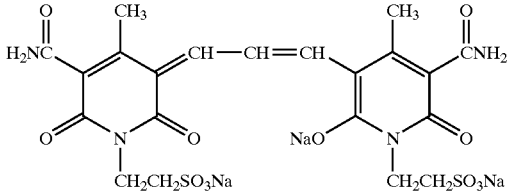
XI-7
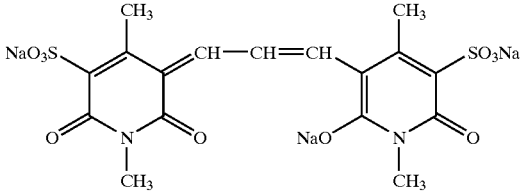
XI-8
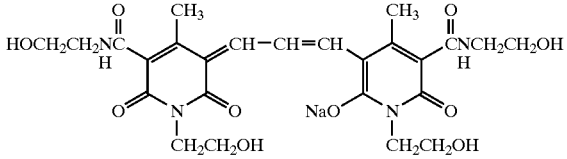
XI-9
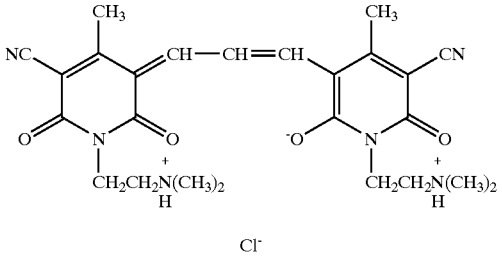
XI-10
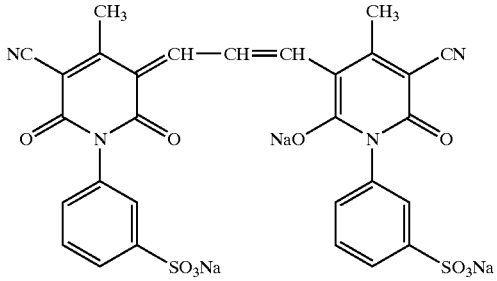
XI-11
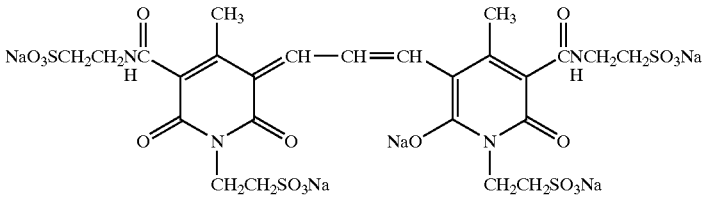

-continued
XI-12
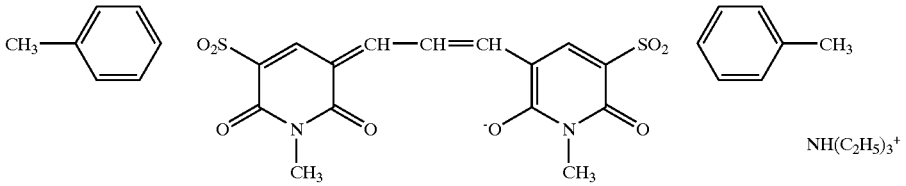
XI-13
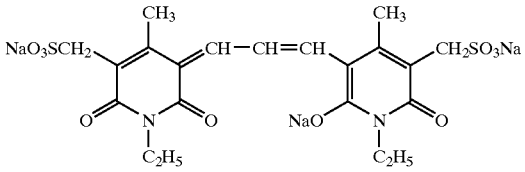
XI-14
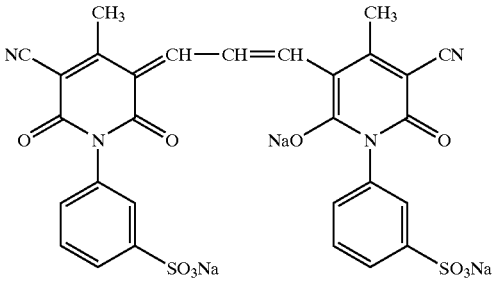
XI-15
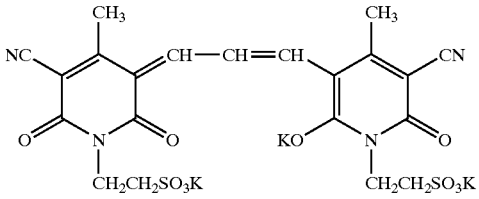
XI-16
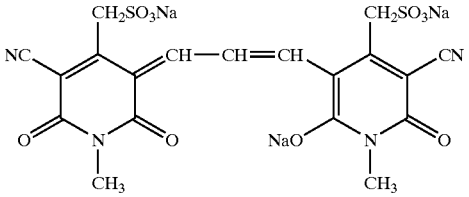
XI-17
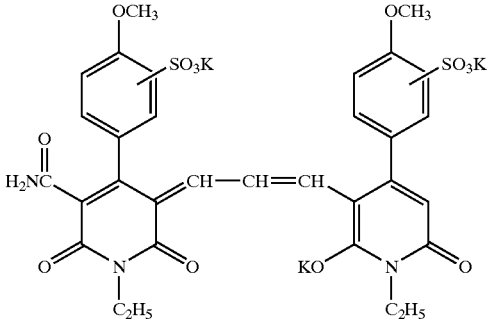
XI-18
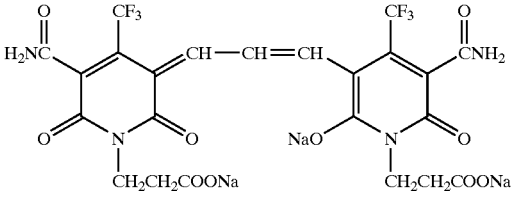
XI-19
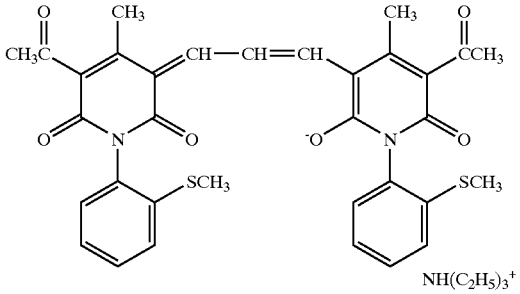
XI-20
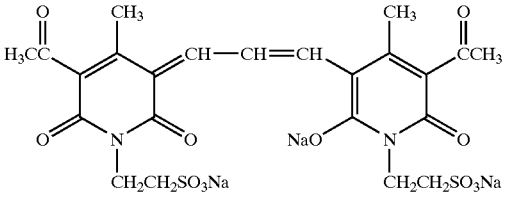

-continued
XI-21
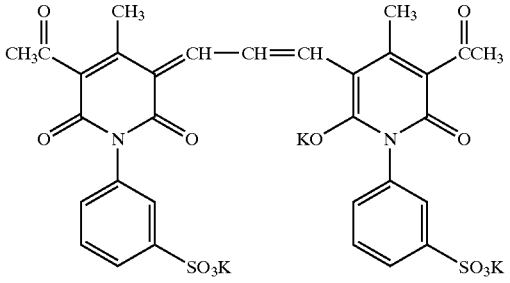
XI-22
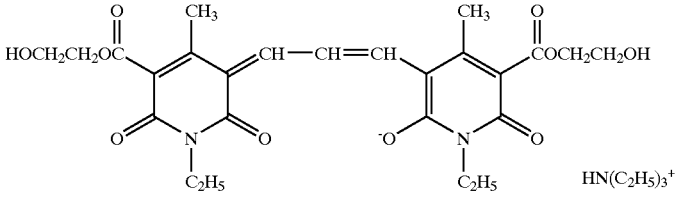
XI-23
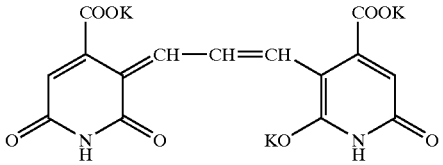
XI-24
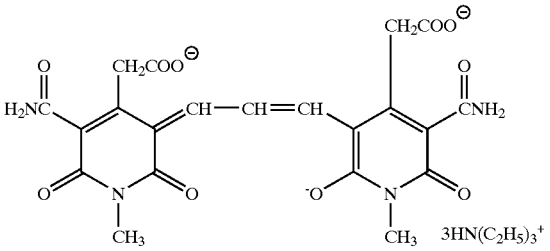
XI-25
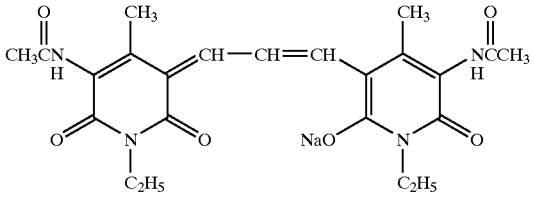
XI-26
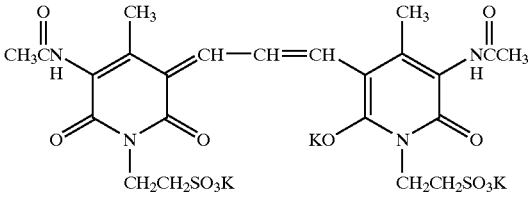
XI-27
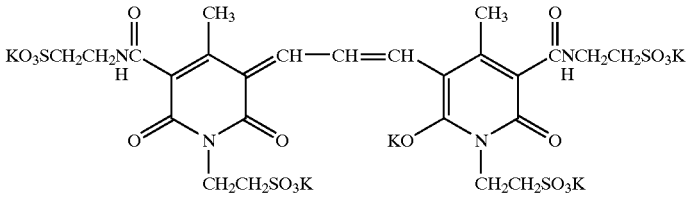
XI-28
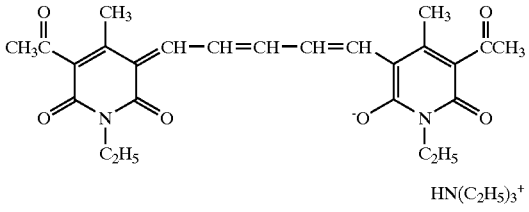
XI-29
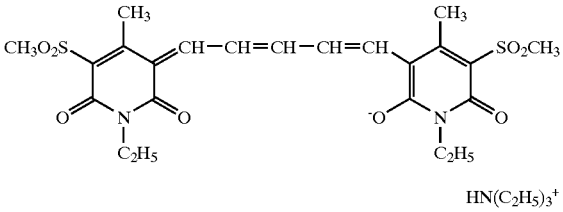

-continued
XI-30
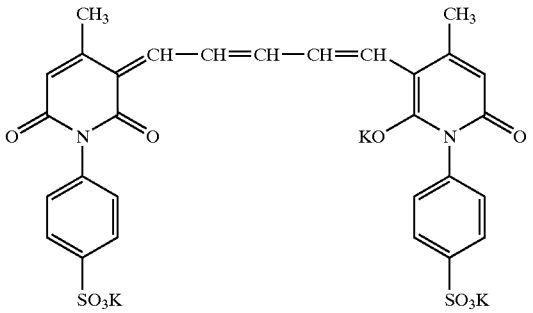
XI-31
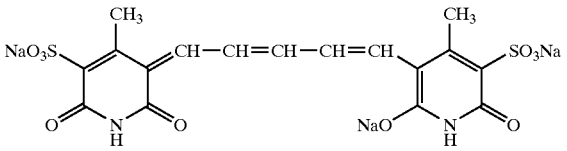
XI-32
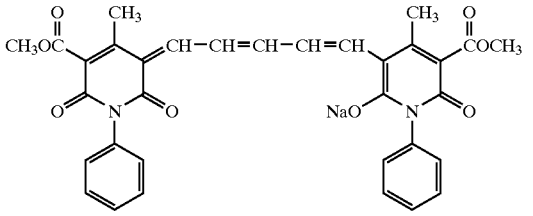
XI-33
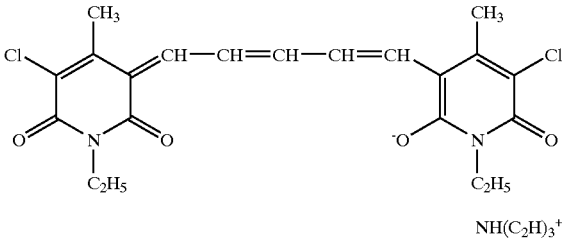
XI-34
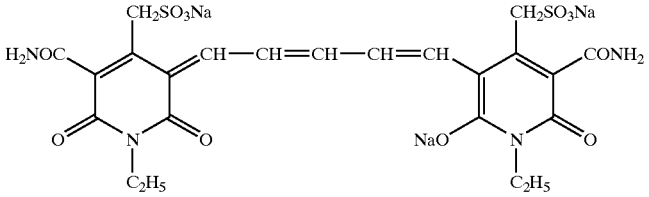
IX-35
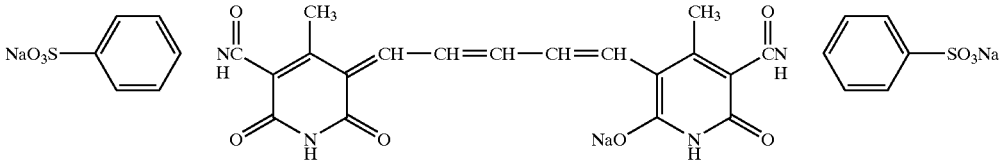
IX-36
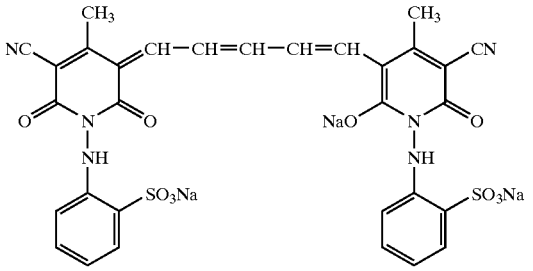
IX-37
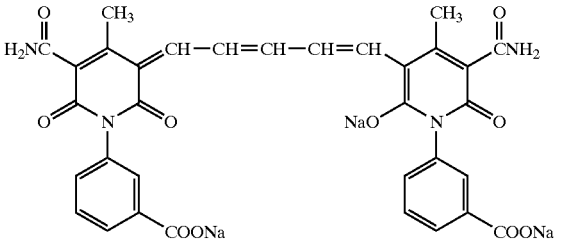
IX-38
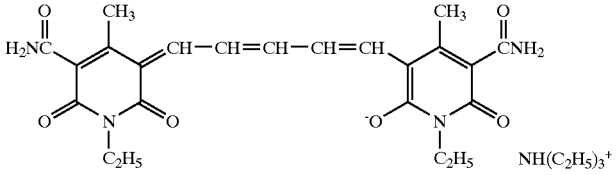

-continued
IX-39
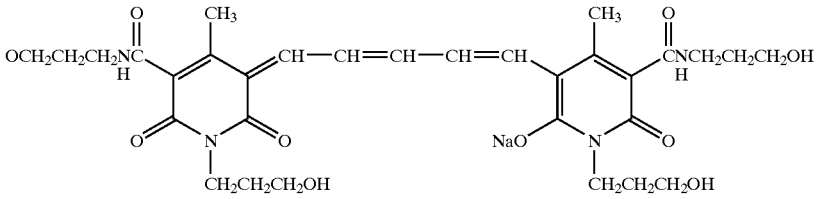
IX-40
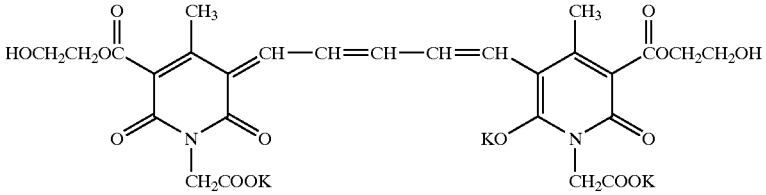
XI-41
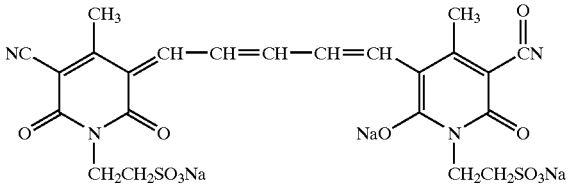
XI-42
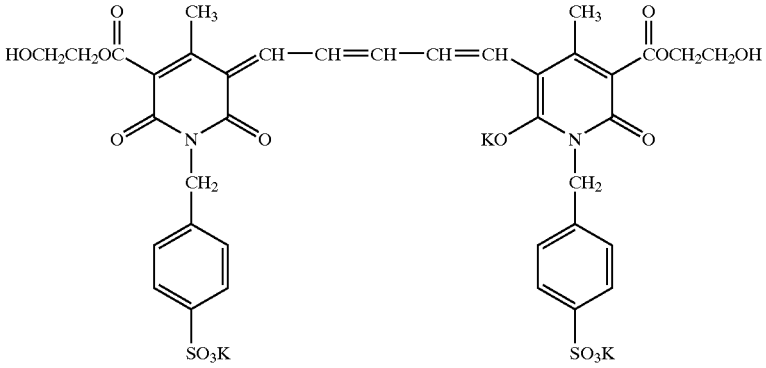
XI-43
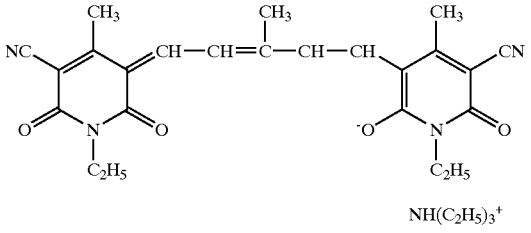
XI-44
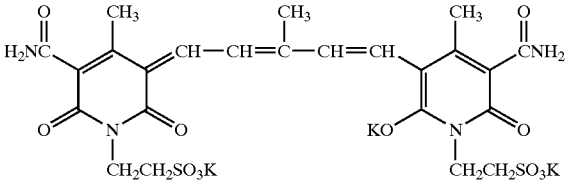
XI-45
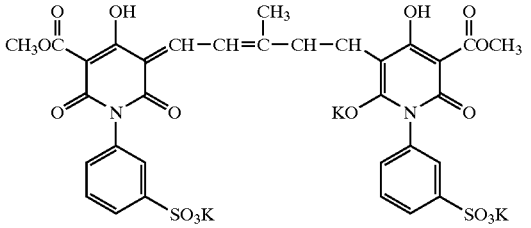
XI-46
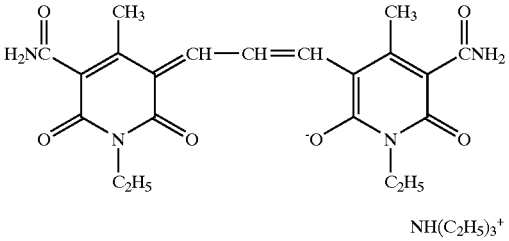

-continued

XI-47

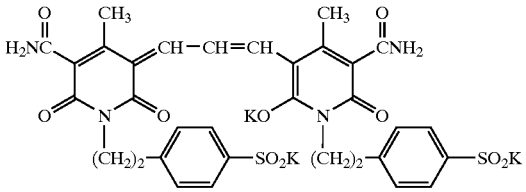

XI-48

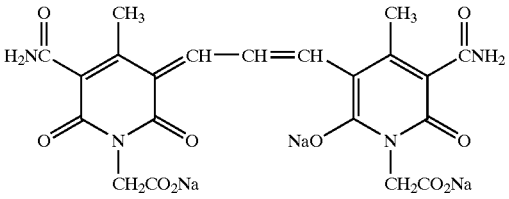

XI-49

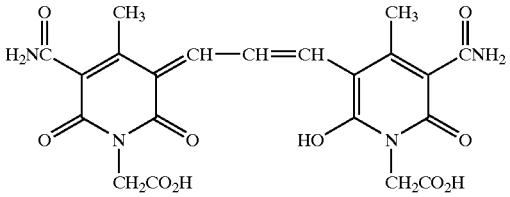

The compound represented by formula (XI) can be synthesized by the method described in U.S. Pat. Nos. 1,278,621, 1,512,863 and 1,579,899. Furthermore, the hydroxypyridines used for the synthesis of the compound represented by formula (XI) can be synthesized by the method described in Crysberg (compiler), *Fukusokan-Shiki Kagobutsu-Pyridine Oyobi Sono Yudotai-Dai* 3 *Bu* (*Heterocyclic Compounds-Pyridine and Derivatives Thereof-Part* 3), Interscience (1962), *J. Am. Chem. Soc.*, Vol. 65, page 449 (1943), *J. Chem. Tec. Biotechnol.*, Vol. 36, page 410 (1986), *Tetrahedron*, Vol. 22, page 445 (1966), JP-B-61-52827, West German Patents 2,162,612, 2,349,709 and 2,902,486, and U.S. Pat. No. 3,763,170.

In the case where the compound represented by formula (X) is used as a filter dye, an irradiation preventing dye or an antihalation dye, the compound may be used in an amount capable of providing an effect but it is preferably used in an amount such that the optical density becomes from 0.05 to 3.0. The time for adding the compound may be any step before the coating.

The compound represented by formula (XI) may be dispersed in an emulsion layer or other hydrophilic colloid layers (e.g., interlayer, protective layer, antihalation layer, filter layer) by various known methods.

Examples of these known methods are described below.

1) A method of directly dissolving or dispersing the compound of the present invention in an emulsion layer or a hydrophilic colloid layer, or a method of dissolving or dispersing the compound in an aqueous solution or a solvent and using the solution in an emulsion layer or a hydrophilic colloid layer. Also, the compound may be dissolved in an appropriate solvent such as methyl alcohol, ethyl alcohol, propyl alcohol, methyl cellosolve, alcohol halide described in JP-A-48-9715 and U.S. Pat. No. 3,756,830, acetone, water, pyridine or a mixed solvent thereof and added in the form of a solution to an emulsion.

2) A method of allowing a hydrophilic polymer having a charge opposite to the dye ion to be present in a layer as a mordant and causing localization of the compound in a specific layer by the interaction between the polymer and the dye molecule.

The polymer mordant is a polymer containing secondary and tertiary amino groups, a polymer having a nitrogen-containing heterocyclic moiety, or a polymer containing a quaternary cation group thereof, and preferably has a molecular weight of 5,000 or more, more preferably 10,000 or more.

Examples thereof include vinyl a pyridine polymer and a vinyl pyridinium cation polymer described in U.S. Pat. No. 2,548,564; vinylimidazolium cation polymer disclosed in U.S. Pat. No. 4,124,386; a polymer mordant crosslinkable with gelatin or the like disclosed in U.S. Pat. No. 3,625,694; an aqueous sol-type mordant disclosed in U.S. Pat. No. 3,958,995 and JP-A-54-1155228; a water-insoluble mordant disclosed in U.S. Pat. No. 3,398,088; a reactive mordant capable of covalent bonding with a dye disclosed in U.S. Pat. No. 4,168,976; a polymer derived from an ethylenically unsaturated compound having a dialkylaminoalkylester residue described in British Patent 685,475; a reaction product of polyvinyl alkyl ketone and aminoguanidine described in British Patent 850,281; and a polymer derived from 2-methyl-1-vinylimidazole described in U.S. Pat. No. 3,445,231.

3) A method of dissolving the compound using a surface active agent.

As the surface active agent, either an oligomer or a polymer is useful.

This polymer is described in detail in JP-A-60-158437, pages 19 to 27.

In addition, a hydrosol of a hydrophilic polymer described, for example, in JP-B-51-39835 may be added to the hydrophilic colloid dispersion obtained as above.

With respect to the processing of a silver halide color photographic light-sensitive material for movie of the present invention, a positive light-sensitive material may be processed through the following processing steps which have been heretofore employed. In the case of a positive light-sensitive material for movie of the present invention where an antihalation layer comprising a solid fine particle dispersion of dye is provided in place of a carbon resin back layer, the steps of (1) prebath and (2) water washing necessary for the removal of the resin back layer can be dispensed with. When the process is shortened as such, the effect of attaining both the sharpness and the improvement of white background staining is more outstanding.

The standard process (exclusive of the drying step) of a conventional positive light-sensitive material for movie consists of:

(1) prebath, (2) water washing bath, (3) color development bath, (4) stopping bath, (5) water washing bath, (6) first fixing bath, (7) water washing bath, (8) bleach accelerating bath, (9) bleaching bath,

(10) water washing bath,

(11) sound development (spread development),

(12) water washing

(13) second fixing bath,

(14) water washing bath, and

(15) stabilizing bath.

Photographic layers and the like of the silver halide photographic light-sensitive material of the present invention is described below.

The silver halide photographic light-sensitive material of the present invention can be applied to general uses such as color negative film, reversal film, cinematic color negative film, color positive film and cinematic positive film, and also to color light-sensitive material for movie.

Particularly, the preferred embodiment (10) is applied not only for the silver halide color photographic light-sensitive material for movie, but also for the silver halide color photographic light-sensitive material having the transmission type support.

A typical example of the color light-sensitive material of the present invention is a silver halide photographic light-sensitive material comprising a transparent support having thereon at least one light-sensitive layer comprising a plurality of silver halide emulsion layers substantially different in the light sensitivity.

The silver halide for use in the light-sensitive material for camera use is preferably silver iodobromide, silver iodochloride or silver iodochlorobromide containing from about 0.5 to about 30 mol % of silver iodide, more preferably silver iodobromide or silver iodochlorobromide containing from about 2 to about 10 mol % of silver iodide. The silver halide for use in a cinematic color positive film is preferably silver chlorobromide or silver chloride. Particularly, a silver halide preferably having a silver chloride content of 90 mol % or more, more preferably 98 mol % or more, with a balance of silver bromide (or silver iodide) is preferred.

The silver halide grain in the photographic emulsion may have a regular crystal form such as cubic, octahedral or tetradecahedral form, may have an irregular crystal form such as spherical or tabular form, may have a crystal defect such as twined plane, or may have a composite form thereof.

The silver halide may be a fine grain having a grain size of about 0.2 $\mu$m or less or may be a large size grain having a projected area diameter of about 10 $\mu$M. Furthermore, either a polydisperse emulsion or a monodisperse emulsion may be used.

The silver halide photographic emulsion which can be used in the present invention can be prepared by the methods described, for example, in "Emulsion Preparation and Types" of *Research Disclosure* (*RD*), No. 17643, pp. 22–23 (December, 1978), ibid., No. 18716, page 648 (November, 1979), ibid., No. 307105, pp. 863–865 (November, 1989), P. Glafkides, *Chimie et Physique Photographique*, Paul Montel (1967), G. F. Duffin, *Photographic Emulsion Chemistry*, The Focal Press (1966), and V. L. Zelikman et al, *Making and Coating Photographic Emulsion*, The Focal Press (1964).

The monodisperse emulsions described in U.S. Pat. Nos. 3,574,628 and 3,655,394 and British Patent 1,413,748 are also preferably used.

A tabular grain having an aspect ratio of about 3 or more may also be used in the present invention. The tabular grain may be prepared by the method described in Gutoff, *Photographic Science and Engineering*, Vol. 14, pp. 248–257 (1970), U.S. Pat. Nos. 4,434,226, 4,414,310, 4,433,048 and 4,439,520, and British Patent 2,112,157.

The crystal structure of the grain may be homogeneous, may comprise halogen compositions different between the inside and the surface or may have a layer structure. Furthermore, the grain may be joined with silver halide having a different composition by epitaxial conjunction or may be joined with a compound other than silver halide, such as silver rhodanate or lead oxide. A mixture of grains having various crystal forms may also be used.

The above-described emulsion may be a surface latent image-type emulsion forming a latent image mainly on the surface, an internal latent image-type emulsion forming a latent image inside the grain, or an emulsion of a type where a latent image is formed both on the surface of and inside the grain, however, the emulsion needs be a negative type emulsion. As one of internal latent image-type emulsions, a core/shell internal latent image-type emulsion described in JP-A-63-264740 may also be used and the preparation method of this emulsion is described in JP-A-59-133542. In this emulsion, the shell thickness varies depending upon the development processing and the like, but it is preferably from 3 to 40 nm, more preferably from 5 to 20 nm.

The silver halide emulsion is usually subjected to physical ripening, chemical ripening and spectral sensitization before use. The additives used in these steps are described in RD No. 17643, RD No. 18716 and RD No. 307105 and the pertinent portions thereof are summarized in the table set forth later.

The light-sensitive material of the present invention may use a mixture of two or more kinds of emulsions different at least in one property of the light-sensitive silver halide emulsion, such as the grain size, the grain size distribution, the halogen composition, the grain shape or the sensitivity, in the same layer.

It is preferred to apply a silver halide grain of which surface is fogged described in U.S. Pat. No. 4,082,553, a silver halide grain of which inside is fogged described in U.S. Pat. No. 4,626,498 and JP-A-59-214852 or a colloidal silver to a light-sensitive silver halide emulsion layer and/or a substantially light-insensitive hydrophilic colloid layer. The term "silver halide grain of which inside or surface is fogged" as used herein means a silver halide grain which can achieve uniform (non-imagewise) development irrespective of an unexposed area or an exposed area of a light-sensitive material. The preparation method of such a grain is described in U.S. Pat. No. 4,626,498 and JP-A-59-214852. The silver halide forming the inside nucleus of a core/shell type silver halide grain of which inside is fogged may have a different halogen composition. The silver halide for the grain of which inside or surface is fogged may be any of silver chloride, silver chlorobromide, silver iodobromide and silver chloroiodobromide. The fogged silver halide grain preferably has an average grain size of from 0.01 to 0.75 $\mu$m, more preferably from 0.05 to 0.6 $\mu$m. The grain may have a regular form and a polydisperse emulsion may be used but a monodisperse emulsion (an emulsion in which at least 95% by weight or by number of silver halide grains have a grain size within an average grain size ±40%) is preferred.

In the light-sensitive material of the present invention, the amount of silver coated is preferably 6.0 g/m$^2$ or less, most preferably 4.5 g/m$^2$ or less.

To any one of photographic constituent layers comprising a silver halide light-sensitive emulsion layer and a light-insensitive hydrophilic colloid layer (e.g., interlayer, protective layer) provided on a support, preferably to a silver halide emulsion layer, a 1-aryl-5-mercaptotetrazole compound is preferably added in an amount of from $1.0\times10^{-5}$ to $5.0\times10^{-2}$ mol, more preferably from $1.0\times10^{-4}$ to $1.0\times10^{-2}$ mol, per mol of silver halide. By adding the compound in this range, staining on the surface of a processed color photograph after continuous processing can be more reduced.

The 1-aryl-5-mercaptotetrazole compound is preferably a compound where the aryl group at the 1-position is an unsubstituted or substituted phenyl group. Specific preferred examples of the substituent include an acylamino group (e.g., acetylamino, —$NHCOC_5H_{11}$(n)), a ureido group (e.g., methylureido), an alkoxy group (e.g., methoxy), a carboxylic acid group, an amino group and a sulfamoyl group. A plurality (from 2 to 3 in number) of these groups may be bonded to the phenyl group. The substitution position is preferably the meta or para-position.

Specific examples thereof include 1-(m-methylureidophenyl)-5-mercaptotetrazole and 1-(m-acetylaminophenyl)-5-mercaptotetrazole.

Photographic additives which can be used in the present invention are described in the following *Research Disclosures* (*RD*) and the pertinent parts thereof are shown in the table below.

| Additive | RD-17643 | RD-18716 | RD-307105 |
|---|---|---|---|
| 1. Chemical sensitizers | p. 23 | p. 648, right column | p. 866 |
| 2. Sensitivity increasing agents | | p. 648, right column | |
| 3. Spectral sensitizers, Supersensitizers | pp. 23–24 | p. 648, right column to p. 649, right column | pp. 866–868 |
| 4. Brightening agents | p. 24 | p. 648, right column | p. 868 |
| 5. Light absorbents, Filter dyes, Ultraviolet absorbing agents | pp. 25–26 | p. 649, right column to p. 650, left column | p. 873 |
| 6. Binders | p. 26 | p. 651, left column | pp. 873–874 |
| 7. Plasticizers, Lubricants | p. 27 | p. 650, right column | p. 876 |
| 8. Coating aids, Surface active agents | pp. 26–27 | p. 650, right column | p. 875–876 |
| 9. Antistatic agents | p. 27 | p. 650, right column | pp. 876–877 |
| 10. Matting agents | | | pp. 878–879 |

Various dye-forming couplers may be used for the light-sensitive material of the present invention but the following couplers are particularly preferred.

Yellow Coupler:

Couplers represented by formulae (I) and (II) of EP 502424A; couplers represented by formulae (1) and (2) (particularly, Y-28 at page 18) of EP 513496A; couplers represented by formula (I) in claim 1 of JP-A-5-307248; couplers represented by formula (I) in column 1, lines 45 to 55 of U.S. Pat. No. 5,066,576; couplers represented by formula (I) in paragraph 0008 of JP-A-4-274425; couplers (particularly, D-35 at page 18) described in claim 1 at page 40 of EP 498381A1; couplers represented by formula (Y) at page 4 (particularly, Y-1 (page 17) and Y-54 (page 41)) of EP 447969A1; couplers represented by formulae (II) to (IV) in column 7, lines 36 to 58 (particularly, II-17, II-19 (column 17) and II-24 (column 19)) of U.S. Pat. No. 4,476,219.

Magenta Coupler:

L-57 (page 11, right lower column), L-68 (page 12, right lower column) and L-77 (page 13, right lower column) of JP-A-3-39737; A-4-63 (page 134), A-4-73 and A-4-75 (page 139) of European Patent 456257; M-4, M-6 (page 26) and M-7 (page 27) of European Patent 486965; M-45 in paragraph 0024 of JP-A-6-43611; M-1 in paragraph 0036 of JP-A-5-204106; and M-22 in paragraph 0237 of JP-A-4-362631.

Cyan Coupler (Couplers which can be used in Combination with the Cyan Coupler of the Present Invention):

CX-1, CX-3, CX-4, CX-5, CX-11, CX-12, CX-14 and CX-15 (pages 14 to 16) of JP-A-4-204843; C-7, C-10 (page 35), C-34, C-35 (page 37), (I-1) and (I-17) (pages 42 and 43) of JP-A-4-43345; couplers represented by formulae (Ia) and (Ib) in claim 1 of JP-A-6-67385.

Polymer Coupler:

P-1 and P-5 (page 11) of JP-A-2-44345.

Infrared Coupler for Forming Sound Track

Couplers described in JP-A-63-143546 and in patents cited therein.

As the coupler which provides a color forming dye having an appropriate diffusibility, those described in U.S. Pat. No. 4,366,237, British Patent 2,125,570, EP 96873B and German Patent 3,234,533 are preferred.

As the coupler for correcting unnecessary absorption of a color forming dye, yellow colored cyan couplers represented by formulae (CI), (CII), (CIII) and (CIV) described at page 5 of EP 456257A1 (particularly, YC-86 at page 84); Yellow Colored Magenta couplers ExM-7 (page 202), EX-1 (page 249) and EX-7 (page 251) described in EP 456257A1; Magenta Colored Cyan Couplers CC-9 (column 8) and CC-13 (column 10) described in U.S. Pat. No. 4,833,069; and colorless masking couplers represented by formula (2) (column 8) of U.S. Pat. No. 4,837,136 and formula [C-1] in claim 1 of WO92/11575 (particularly, compounds described in pages 36 to 45) are preferred.

Compounds (including couplers) which release a photographically useful compound residue upon reaction with an oxidation product of a developing agent are described below.

Development Inhibitor-Releasing Compound:

Compounds represented by formulae (I), (II), (III) and (IV) described at page 11 of EP 378236A1 (particularly, T-101 (page 30), T-104 (page 31), T-113 (page 36), T-131 (page 45), T-144 (page 51) and T-158 (page 58)); compounds represented by formula (I) described at page 7 of EP 436938A2 (particularly, D-49 (page 51)); compounds represented by formula (1) of JP-A-5-307248 (particularly, (23) in paragraph 0027); and compounds represented by formulae (I), (II) and (III) described at pages 5 and 6 of EP 440195A2 (particularly, 1-(1) at page 29);

Bleaching Accelerator-Releasing Compound:

Compounds represented by formulae (I) and (I') at page 5 of EP 310125A2 (particularly (60) and (61) at page 61); and compounds represented by formula (I) in claim 1 of JP-A-6-59411 (particularly, (7) in paragraph 0022);

Ligand-Releasing Compound:

Compounds represented by LIG-X described in claim 1 of U.S. Pat. No. 4,555,478 (particularly, compounds in column 12, lines 21 to 41);

Leuco Dye-Releasing Compound:

Compounds 1 to 6 in columns 3 to 8 of U.S. Pat. No. 4,749,641;

Fluorescent Dye-Releasing Compound:

Compounds represented by COUP-DYE in claim 1 of U.S. Pat. No. 4,774,181 (particularly, compounds 1 to 11 in columns 7 to 10);

Development Accelerator- or Fogging Agent-Releasing Compound:

Compounds represented by formulae (1), (2) and (3) in column 3 of U.S. Pat. No. 4,656,123 (particularly (I-22) in column 25) and ExZK-2 at page 75, lines 36 to 38 of EP 450637A2;

Compound Which Releases Group Capable of Becoming Dye First When Released:

Compounds represented by formula (I) in claim 1 of U.S. Pat. No. 4,857,447 (particularly, Y-1 to Y-19 in columns 25 to 36).

Preferred additives other than couplers are described below.

Dispersion Medium of Oil-Soluble Organic Compounds:

P-3, P-5, P-16, P-19, P-25, P-30, P-42, P-49, P-54, P-55, P-66, P-81, P-85, P-86 and P-93 of JP-A-62-215272 (pages 140 to 144);

Latex for Impregnation of Oil-Soluble Organic Compound:

Latexes described in U.S. Pat. No. 4,199,363;

Developing Agent Oxidation Product Scavenger:

Compounds represented by formula (I) in column 2, lines 54 to 62 of U.S. Pat. No. 4,978,606 (particularly, 1-(1), I-(2), 1-(6)- and 1-(12) (columns 4 to 5)) and compounds represented by the formulae in column 2, lines 5 to 10 of U.S. Pat. No. 4,923,787 (particularly, Compound 1 (column 3));

Stain Inhibitor:

Compounds represented by formulae (I) to (III) at page 4, lines 30 to 33 of EP 298321A1 (particularly, I-47, I-72, III-1 and III-27 (pages 24 to 48));

Color Fading Inhibitor:

A-6, A-7, A-20, A-21, A-23, A-24, A-25, A-26, A-30, A-37, A-40, A-42, A-48, A-63, A-90, A-92, A-94 and A-164 (pages 69 to 118) of EP 298321A; II-1 to III-23 in columns 25 to 38 of U.S. Pat. No. 5,122,444 (particularly, III-10); I-1 to III-4 at pages 8 to 12 of EP 471347A (particularly, II-2); and A-1 to A-48 in columns 32 to 40 of U.S. Pat. No. 5,139,931 (particularly, A-39 and A-42);

Material Which Reduces Amount of Coloration Reinforcing Agent or Color Mixing Inhibitor Used:

I-1 to II-15 at pages 5 to 24 of EP 411324A (particularly, I-46);

Formalin Scavenger:

SCV-1 to SCV-28 at pages 24 to 29 of EP 477932A (particularly SCV-8);

Hardening Agent:

H-1, H-4, H-6, H-8 and H-14 at page 17 of JP-A-1-214845; compounds (H-1 to H-54) represented by formulae (VII) to (XII) in columns 13 to 23 of U.S. Pat. No. 4,618,573, Compounds (H-1 to H-76) represented by formula (6) at page 8, right lower column of JP-A-2-214852 (particularly, H-14); and compounds described in claim 1 of U.S. Pat. No. 3,325,287;

Development Inhibitor Precursor:

P-24, P-37 and P-39 (pages 6 to 7) of JP-A-62-168139; and compounds described in claim 1 of U.S. Pat. No. 5,019,492 (particularly, 28 and 29 in column 7);

Antiseptic, Antifungal:

I-1 to III-43 in columns 3 to 15 of U.S. Pat. No. 4,923,790 (particularly, II-1, II-9, II-10, II-18 and III-25);

Stabilizer, Antifoggant:

I-1 to (14) in columns 6 to 16 of U.S. Pat. No. 4,923,793 (particularly, I-1, I-60, (2) and (13)); and compounds 1 to 65 in columns 25 to 32 of U.S. Pat. No. 4,952,483 (particularly, 36);

Chemical Sensitizer:

triphenylphosphine, selenide and Compound 50 of JP-A-5-40324;

Dye:

a-1 to b-20 at pages 15 to 18 (particularly, a-1, a-12, a-18, a-27, a-35, a-36 and b-5) and V-1 to V-23 at pages 27 to 29 (particularly, V-1) of JP-A-3-156450; F-I-1 to F-II-43 at pages 33 to 55 of EP 445627A (particularly, F-I-11 and F-II-8); III-1 to III-36 at pages 17 to 28 (particularly, III-1 and III-3) of EP 457153A; fine crystal dispersion products of Dye-1 to Dye-124 at pages 8 to 26 of WO88/04794; compounds 1 to 22 at pages 6 to 11 of EP 319999A (particularly, Compound 1); compounds D-1 to D-87 (pages 3 to 28) represented by formulae (1) to (3) of EP 519306A; compounds 1 to 22 (columns 3 to 10) represented by formula (I) of U.S. Pat. No. 4,268,622; and compounds (1) to (31) (columns 2 to 9) represented by formula (I) of U.S. Pat. No. 4,923,788;

UV Absorbent:

Compounds (18b) to (18r) represented by formula (1) and 101 to 427 (pages 6 to 9) of JP-A-46-3335; compounds (3) to (66) (pages 10 to 44) represented by formula (I) and compounds HBT-1 to HBT-10 (page 14) represented by formula (III) of EP 520938A; and compounds (1) to (31) (columns 2 to 9) represented by formula (1) of EP 521823A.

In the light-sensitive material of the present invention, the total thickness of all hydrophilic colloid layers on the side having emulsion layers is preferably 28 μm or less, more preferably 23 μm or less, still more preferably 18 μm or less and particularly preferably 16 μm or less. The layer swelling speed $T_{1/2}$ is preferably 30 seconds or less, more preferably 20 seconds or less. $T_{1/2}$ is defined as the time required for the layer thickness to reach a half (½) of a saturation layer thickness which corresponds to 90% of the maximum swollen thickness achieved at the processing with a color developer at 30° C. for 3 minutes and 15 seconds. The layer thickness (i.e., the film thickness) means a layer thickness determined at 25° C. and 55% RH (relative humidity) under humidity conditioning for 2 days. $T_{1/2}$ can be measured by means of a swellometer described in A. Green et al, *Photogr. Sci. Eng., Vol.* 19, 2, pp. 124–129. The $T_{1/2}$ can be adjusted by adding a hardening agent to gelatin used as a binder or changing the aging conditions after coating. The swelling ratio is preferably from 150 to 400%. The swelling ratio can be obtained from the maximum swollen layer thickness under the above-described conditions according to the formula: (maximum swollen layer thickness−layer thickness)/layer thickness.

The support is described below. Examples of the plastic film support include films of polyethylene terephthalate, polyethylene naphthalate, cellulose triacetate, cellulose acetate butyrate, cellulose acetate propionate, polycarbonate, polystyrene and polyethylene.

Among these, polyethylene terephthalate film is preferred, and a polyethylene terephthalate film subjected to biaxial stretching and heat setting is more preferred in view of stability and toughness.

The thickness of the support is not particularly limited but it is generally from 15 to 500 μm, preferably from 40 to 200 μm in view of easy handleability and availability for general purposes, most preferably from 100 to 150 Sm. The transparent support means that the support transmits 90% or more of visible light. The support may contain dyed silicate, alumina sol, chromium salt or zirconium salt if it is added in an amount of not substantially inhibiting the transmittance of light.

The plastic film support is generally subjected to a surface treatment described below so as to firmly bond a light-sensitive layer to the surface of support. Furthermore, the surface on which an antistatic layer (back layer) is formed is also generally subjected to a surface treatment.

(1) A method of subjecting the support to a surface activation treatment such as chemical treatment, mechanical treatment, corona discharge treatment, flame treatment, ultraviolet ray treatment, high frequency treatment, glow discharge treatment, active plasma treatment, laser treatment, mixed acid treatment or ozone oxygen treatment, and then directly coating a photographic emulsion (a coating solution for forming a light-sensitive layer) thereon with good adhesive strength, and (2) a method of once surface treating the support as above, then providing an undercoat layer and coating thereon a photographic emulsion layer, may be used.

Among these, the method (2) is more effective and being widely used. The above-described surface treatments each is considered to form some or less a polar group on the surface of support which is originally hydrophobic, remove a thin layer which is a disadvantageous factor for the adhesion on the surface, and increase the crosslinking density on the surface, and thereby increase the adhesive strength. By virtue of these actions, the component contained in the coating solution for an undercoat layer is increased in the affinity for the polar group or the adhered surface is intensified in the fastness. As a result, the adhesion between the undercoat layer and the support surface is improved.

On the surface of the plastic film support on the side where a light-sensitive layer is not provided, a light-insensitive layer containing an electrically conductive metal oxide particles for use in the present invention (antistatic layer according to the present invention) is provided.

In the present invention, the binder used for the light-insensitive layer is preferably acrylic resin, vinyl resin, polyurethane resin or polyester resin. In the present invention, the light-insensitive layer is preferably hardened. For the hardening, an azilidine-base, triazine-base, vinyl sulfone-base, aldehyde-base, cyano-acrylate-base, peptide-base, epoxy-type or melamine-type hardening agent is used. Among these, a melamine-type compound is preferred, because the electrically conductive metal oxide particle can be firmly fixed.

Examples of the material for the electrically conductive metal oxide particle include ZnO, $TiO_2$, $SnO_2$, $Al_2O_3$, $In_2O_3$, MgO, BaO, $MoO_3$, $V_2O_5$, a composite oxide thereof, and a metal oxide comprising such a metal oxide and further containing a foreign atom.

The metal oxide is preferably $Sno_2$, ZnO, $Al_2O_3$, $TiO_2$, $In_2O_3$, MgO or $V_2O_5$, more preferably $SnO_2$, ZnO, $In_2O_3$, $TiO_2$ or $V_2O_5$, still more preferably $SnO_2$ or $V_2O_5$. Examples of the metal oxide containing a slight amount of foreign atom include Zno doped with Al or In, $TiO_2$ doped with Nb or Ta, $In_2O_3$ doped with Sn, and $SnO_2$ doped with Sb, Nb or a halogen element, each foreign element being doped in an amount of from 0.01 to 30 mol % (preferably from 0.1 to 10 mol %). If the amount of foreign element added is less than 0.01 mol %, a sufficiently high electrical conductivity may not be imparted to the oxide or composite oxide, whereas if it exceeds 30 mol %, the grain is increased in the blacking degree to tint the antistatic layer black and this is disadvantageous for the light-sensitive material. Therefore, the material of the electrically conductive metal oxide particle is preferably a metal oxide or a composite metal oxide containing a slight amount of foreign element. A metal oxide having an oxygen defect in the crystal structure may also be preferably used.

The electrically conductive metal oxide particle is necessary to have a volume ratio of 50% or less, preferably from 3 to 30%, to the light-insensitive layer as a whole. The electrically conductive metal oxide particle is preferably coated in an amount described in JP-A-10-62905, namely, preferably from 1 to 300 mg/$m^2$, more preferably from 2 to 200 mg/$m^2$, most preferably from 100 to 250 mg/$m^2$.

If the volume ratio exceeds 50%, the surface of the processed color photograph is readily stained, whereas if it is less than 3%, a sufficiently high antistatic ability may not be attained.

The electrically conductive metal oxide particle preferably has a smaller particle size so as to reduce light scattering as much as possible, however, the particle size must be determined using the ratio of refractive index between the particle and the binder as a parameter. This can be obtained according to the Mie's theory. In general, the average particle size is from 0.001 to 0.5 Sm, preferably from 0.003 to 0.2 $\mu$m. The average particle size as used herein means a value including not only the primary particle size of electrically conducting metal oxide particle but also a particle size of higher-order structure.

Fine particles of the metal oxide may be added by themselves to a coating solution for forming an antistatic layer and dispersed therein, however, the fine particles are preferably added in the form of a dispersion solution prepared by dispersing the particles in a solvent (if desired, containing a dispersant and a binder) such as water.

The light-insensitive layer preferably contains a hardened matter of the above-described binder and a hardening agent as the binder for dispersing and supporting the electrically conductive metal oxide particles. In the present invention, from the standpoint of maintaining good work environment and preventing air pollution, the binder and the hardening agent both are preferably water-soluble or used in the form of a water dispersion such as emulsion. Furthermore, in order to enable crosslinking reaction with the hardening agent, the binder preferably contains any one group of a methylol group, a hydroxyl group, a carboxyl group and a glycidyl group, more preferably a hydroxyl group or a carboxyl group, still more preferably a carboxyl group. The content of hydroxyl group or carboxyl group in the binder is preferably from 0.0001 to 1 equivalent/kg, more preferably from 0.001 to 1 equivalent/kg.

Resins preferably used as the binder are described below.

Examples of the acrylic resin include acrylic acid; acrylic acid esters such as alkyl acrylate; acrylamide; acrylonitrile; methacrylic acid; methacrylic acid esters such as alkyl methacrylate; and homopolymers of any one monomer of methacrylamide and methacrylonitrile and copolymers obtained by the polymerization of two or more of these monomers. Among these, preferred are homopolymers of any one monomer of acrylic acid esters such as alkyl acrylate, and methacrylic acid esters such as alkyl methacrylate, and copolymers obtained by the polymerization of two or more of these monomers. Examples thereof include homopolymers of any one monomer of acrylic acid esters and methacrylic acid esters each containing an alkyl group having from 1 to 6 carbon atoms, and copolymers obtained by the polymerization of two or more of these monomers.

The acrylic resin is preferably a polymer comprising the above-described component and being obtained partially using a monomer having any one of, for example, a methylol group, a hydroxyl group, a carboxyl group and a glycidyl group, so as to enable crosslinking reaction with the hardening agent.

Examples of the vinyl resin include polyvinyl alcohol, acid-modified polyvinyl alcohol, polyvinyl formal, polyvinyl butyral, polyvinyl methyl ether, polyolefin, ethylene/butadiene copolymer, polyvinyl acetate, vinyl chloride/vinyl acetate copolymer, vinyl chloride/(meth)-acrylic acid ester copolymer and ethylene/vinyl acetate-base copolymer (preferably ethylene/vinyl acetate/(meth)-acrylic acid ester copolymer). Among these, preferred are polyvinyl alcohol, acid-modified polyvinyl alcohol, polyvinyl formal, polyolefin, ethylene/butadiene copolymer and ethylene/vinyl acetate-based copolymer (preferably ethylene/vinyl acetate/acrylic acid ester copolymer).

In order to enable crosslinking reaction with the hardening agent, the vinyl resin is a polymer having a hydroxyl group prepared by allowing a vinyl alcohol unit to remain in the polymer in the case of polyvinyl alcohol, acid-modified polyvinyl alcohol, polyvinyl formal, polyvinyl butyral, polyvinyl methyl ether and polyvinyl acetate, or a polymer obtained by partially using a monomer having any one of, for example, a methylol group, a hydroxyl group, a carboxyl group and a glycidyl group in the case of other polymers.

Examples of the polyurethane resin include polyurethanes derived from any one of a polyhydroxy compound (e.g., ethylene glycol, propylene glycol, glycerin, trimethylolpropane), an aliphatic polyester-based polyol obtained by the reaction of the polyhydroxy compound and a polybasic acid, a polyether polyol (e.g., poly(oxypropylene ether)polyol, poly(oxyethylene-propylene ether)polyol), a polycarbonate-based polyol and a polyethylene terephthalate polyol, and polyurethanes derived from a mixture thereof and polyisocyanate.

In this polyurethane resin, the hydroxyl group remained unreacted after the reaction of, for example, polyol and polyisocyanate may be used as a functional group crosslinkable with the hardening agent.

As the polyester resin, a polymer obtained by the reaction of a polyhydroxy compound (e.g., ethylene glycol, propylene glycol, glycerin, trimethylolpropane) and a polybasic acid is commonly used.

In the polyester resin, a hydroxyl group or a carboxyl group remained unreacted after the completion of reaction of, for example, polyol with polybasic acid may be used as a functional group crosslinkable with the hardening agent. Of course, a third component having a functional group such as hydroxyl group may be added.

Among the above-described polymers, acrylic resin and polyurethane resin are preferred, and acrylic resin is more preferred.

Examples of the melamine compound which is preferably used as the hardening agent include compounds containing two or more (preferably three or more) methylol groups and/or alkoxymethyl groups within the melamine molecule, melamine resins as a condensed polymer thereof, and melamine-urea resins.

Examples of the initial condensate of melamine and formalin include dimethylolmelamine, trimethylolmelamine, tetramethylolmelamine, pentamethylolmelamine and hexamethylolmelamine. Specific examples of the commercial product therefor include Sumitex Resin M-3, Sumitex Resin MW, Sumitex Resin MK and Sumitex Resin MC (produced by Sumitomo Chemical Co., Ltd.). However, the present invention is by no means limited thereto.

Examples of the condensed polymer include hexamethylolmelamine resin, trimethylolmelamine resin and trimethyloltrimethoxymethylmelamine resin. Specific examples of the commercial product therefor include MA-1 and MA-204 (produced by Sumitomo Bakelite Co., Ltd.), BECKAMINE MA-S, BECKAMINE APM and BECKAMINE J-101 (produced by Dai-Nippon Ink & Chemicals, Inc.), EUROID 344 (produced by Mitsui Toatsu Chemicals Inc.), OGA RESIN M31 and OGA RESIN PWP-8 (produced by Oga Shinko K.K.), however, the present invention is by no means limited thereto.

The melamine compound preferably has a functional group equivalent of from 50 to 300. The functional group equivalent is expressed by a value obtained by dividing the molecular weight by the number of functional groups within one molecule and the functional group as used here means a methylol group and/or an alkoxymethyl group. If this value exceeds 300, the curing density is small to fail in obtaining a sufficiently high strength and when the amount of melamine compound is increased, the coatability deteriorates. When the curing density is small, scratches are readily generated and when the curing degree is low, the force of holding the electrically conductive metal oxide decreases. If the functional group equivalent is less than 50, the transparency is impaired though a high curing density may be obtained and even when the amount of melamine compound is decreased, no improvement can be attained.

The amount of aqueous melamine compound added is from 0.1 to 100 wt %, preferably from 10 to 90 wt %, based on the polymer.

In the antistatic layer, a matting agent, a surface active agent, a slipping agent or the like may be used in combination, if desired.

Examples of the matting agent include oxides such as silicon oxide, aluminum oxide and magnesium oxide, and polymers or copolymers such as polymethyl methacrylate and polystyrene, each having a particle size of from 0.001 to 10 $\mu$m.

Examples of the surface active agent include known anionic surface active agents, cationic surface active agents, amphoteric surface active agents and nonionic surface active agents.

Examples of the slipping agent include phosphoric acid esters of higher alcohol having from 8 to 22 carbon atoms, and amino salts thereof; palmitic acid, stearic acid, behenic acid and esters thereof; and silicone-based compounds.

The thickness of the antistatic layer is preferably from 0.01 to 1 $\mu$m, more preferably from 0.01 to 0.2 $\mu$m. If the thickness is less than 0.01 $\mu$m, the coating agent is difficult to coat uniformly and uneven coating is readily caused on the product, whereas if it exceeds 1 $\mu$m, the layer may be deteriorated in the antistatic performance or scratch resistance.

On the antistatic layer, a surface layer is preferably provided. The surface layer is provided mainly for improving the slipping property and scratch resistance but also for aiding the function of the antistatic layer of preventing releasing of electrically conductive metal oxide particles.

Examples of the material for the surface layer include (1) waxes, resins and rubbery materials comprising a homopolymer or copolymer of a 1-olefin-based unsaturated hydrocarbon such as ethylene, propylene, 1-butene and 4-methyl-1-pentene (for example, polyethylene, polypropylene, poly-1-butene, poly-4-methyl-1-pentene, ethylene/propylene copolymer, ethylene/1-butene copolymer and propylene/1-butene copolymer), (2) rubbery copolymers of two or more 1-olefins described above and a conjugate or non-conjugate diene (for example, ethylene/propylene/ethylidene norbornene copolymer, ethylene/propylene/1,5-hexadiene copolymer and isobutene/isoprene copolymer), (3) copolymers of a 1-olefin and a conjugate or non-conjugate diene (for example, ethylene/butadiene copolymer and ethylene/ethylidene norbornene copolymer), (4) copolymers of a 1-olefin, particularly ethylene, and a vinyl acetate, and completely or partially saponified products thereof, (5) graft polymers obtained by grafting a conjugate or non-conjugate diene described above or a vinyl acetate to a homopolymer or copolymer of 1-olefin, and completely or partially saponified products thereof, but the present invention is by no means limited thereto. These compounds are described in JP-B-5-41656.

Among the above-described polyolefins, those having a carboxyl group and/or a carboxylate group are preferred. The polyolefin is usually used in the form of an aqueous solution or a water dispersion.

To the surface layer, a water-soluble methyl cellulose having a methyl group-substitution degree of 2.5 or less may be added and the amount of methyl cellulose added is preferably from 0.1 to 40 wt % based on the entire binder. The water-soluble methyl cellulose is described in JP-A-1-210947.

The surface layer may be formed on the antistatic layer for use in the present invention by coating a coating solution (water dispersion or aqueous solution) containing the above-described binder and the like according to a commonly well-known coating method such as dip coating method, air knife coating method, curtain coating method, wire bar coating method, gravure coating method and extrusion coating method.

The thickness of surface layer is preferably from 0.01 to 1 μm, more preferably from 0.01 to 0.2 μm. If the thickness is less than 0.01 μm, the coating agent is difficult to coat uniformly and uneven coating is readily caused on the product, whereas if it exceeds 1 μm, the layer may be deteriorated in the antistatic performance and scratch resistance.

The light-sensitive material of the present invention has a film pH of from 4.5 to 6.5, preferably from 5.5 to 6.4. In the case of a long aged sample, if the film pH exceeds 6.5, the cyan image and the magenta image are greatly sensitized by the irradiation of safe light, whereas if the film pH is less than 4.5, the yellow image density largely fluctuates due to changes in time from the exposure to development of the light-sensitive material. Thus, either case is disadvantageous in practice.

The film pH of the silver halide color photographic light-sensitive material of the present invention is a pH of all photographic layers obtained by coating respective coating solutions on a support and not always coincides with the pH of the coating solution. The film pH may be measured by the method described in JP-A-61-245153. More specifically, according to this method, (1) 0.05 ml of pure water is dropped on the surface of a light-sensitive material on the side where a silver halide emulsion is coated, and (2) after allowing it to stand for 3 minutes, the film pH is measured by a surface pH measuring electrode (GS-165F, manufactured by Toa Denpa K.K.). The film pH may be adjusted, if desired, using an acid (e.g., sulfuric acid, citric acid) or an alkali (e.g., sodium hydroxide, potassium hydroxide).

EXAMPLE

The present invention is described in greater detail below by referring to Examples, however, the present invention should not be construed as being limited thereto.

The compounds used in Examples are described later.

Example I-1

(Preparation of Support)

Two kinds of supports were prepared. In each support, the thickness was 120 μm and the side to be coated with an emulsion was subjected to undercoating.

Support (i):

Polyethylene terephthalate film support, in which a resin layer containing carbon fine particles was provided on the side opposite to the surface to be coated with an emulsion, to have a transmission density of 1.0.

Support (ii):

Polyethylene terephthalate film support, in which an acrylic resin layer containing an electrically conductive polymer shown below (0.05 g/m$^2$) and tin oxide fine particles (0.20 g/m$^2$) was provided on the side opposite to the surface to be coated with an emulsion.

Electrically Conductive Polymer 1:

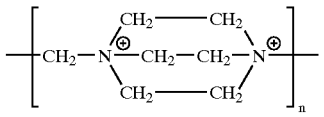

(Preparation of Solid Fine Particle Dispersion of Dye)

A methanol wet cake of Compound (IV-1) was weighed to have a compound net of 240 g, Compound (V-12) as a dispersion aid was weighed to 48 g and water was added thereto to make 4,000 g. Using a "flow-type sand grinder mill (UVM-2)" (manufactured by Imex K.K.) where 1.7 λ of zirconia beads (diameter: 0.5 mm) were filled, the solution obtained above was pulverized at a jetting rate of 0.5 λ/min and a peripheral speed of 10 m/s for 2 hours. The resulting dispersion was diluted to have a compound concentration of 3 wt % and thereto Compound (VI-2) was added at a weight ratio to the dye of 3% (referred to as Dispersion A). This dispersion had an average particle size of 0.45 μm.

Dispersions were prepared in the same as above by varying the kinds of the dye and the dispersion aid and the presence or absence of heat treatment after the preparation of dispersion as shown in Table 1-1 at the preparation of the solid fine particle dispersions of dye. In the case of performing a heat treatment, Compound (VI-2) was added after the heat treatment.

TABLE 1-1

Solid Fin Particle Dispersion Used in Examples

| Dispersion | Dye | Dispersion Aid | Heat Treatment (temperature/time) |
|---|---|---|---|
| A | IV-1 | V-12 | not performed |
| B | Comparison | V-12 | not performed |
| C | Comparison | V-12 | 60° C.-5 d |
| D | IV-1 | V-12 | 90° C.-10 h |
| E | IV-1 | V-12 | 60° C.-5 d |

TABLE 1-1-continued

| Solid Fin Particle Dispersion Used in Examples | | | |
|---|---|---|---|
| Dispersion | Dye | Dispersion Aid | Heat Treatment (temperature/time) |
| F | I-1 | V-12 | 90° C.-10 h |
| G | III-4 | V-12 | 90° C.-10 h |

Comparative Dye

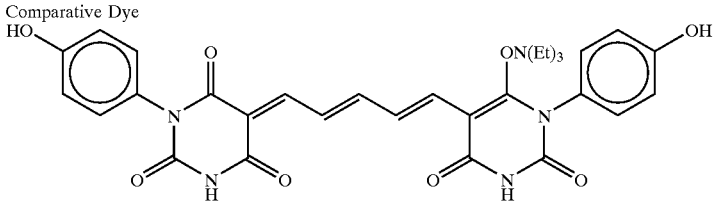

(Preparation of Sample 101)

On a support (i), layers each having the following compositions were multiple-layer coated one on another to manufacture Sample 101 as a multi-layer color light-sensitive material. The coating solutions for respective photographic constituent layers were prepared as follows.

(Preparation of Coating Solution for Third Layer)

116 g of Cyan Coupler (ExC), 8.8 g of Additive (Cpd-7), 9 g of Additive (Cpd-8), 4.8 g of Additive (Cpd-10) and 10 g of Additive (Cpd-13) were dissolved in 79 g of Solvent (Solv-1), 44 g of Solvent (Solv-2), 9 g of Solvent (Solv-3), 4 g of Solvent (Solv-4) and 150 ml of ethyl acetate. The resulting solution was emulsification-dispersed in 1,000 g of a 10% aqueous gelatin solution containing 80 ml of 10% sodium dodecylbenzenesulfonate to prepared Emulsification Dispersion C.

Separately, Silver Chlorobromide Emulsion R (cubic; a 2:8 (by mol as-silver) mixture of Large Size Emulsion R1 and Small Size Emulsion R2 having an average grain size of 0.17 μm and 0.135 μm, respectively; the coefficients of variation in the grain size distribution being 13 and 14, respectively; each emulsion having a halogen composition of Br/Cl=25/75) was prepared. In this emulsion, Red-Sensitive Sensitizing Dye D was added in an amount of $4.0\times10^{-5}$ mol/mol-Ag to Large Size Emulsion R1 and in an amount of $5.0\times10^{-5}$ mol/mol-Ag to Small Size Emulsion R2, Red-Sensitive Sensitizing Dye E was added in an amount of $2.0\times10^{-5}$ mol/mol-Ag to R1 and in an amount of $2.5\times10^{-5}$ mol/mol-Ag to R2, Red-Sensitive Sensitizing Dye F was added in an amount of $1.0\times10^{-5}$ mol/mol-Ag to R1 and in an amount of $1.2\times10^{-5}$ mol/mol-Ag to R2, and Red-Sensitive Dye G was added in an amount of $1.0\times10^{-5}$ mol/mol-Ag to R1 and in an amount of $1.2\times10^{-5}$ mol/mol-Ag to R2. Furthermore, this emulsion was subjected to optimal chemical ripening by adding a sulfur sensitizer and a gold sensitizer.

Emulsification Dispersion C prepared above and this Silver Chlorobromide Emulsion R were mixed and dissolved to prepare a coating solution for the third layer having the composition shown later. The amount of emulsion coated is shown by a coated amount in terms of silver.

The coating solutions for the first to sixth layers were prepared in the same manner as the coating solution for the third layer. In each layer, sodium 1-oxy-3,5-dichloro-s-triazine was used as the gelatin hardening agent.

For the silver chlorobromide emulsion of each light-sensitive emulsion layer, the following spectral sensitizing dyes were used.

Blue-Sensitive Emulsion Layer:

(Sensitizing Dye A)

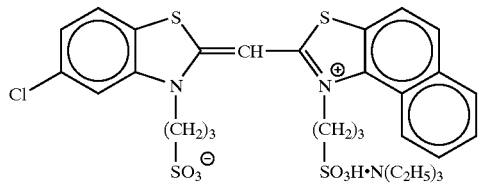

(Sensitizing Dye B)

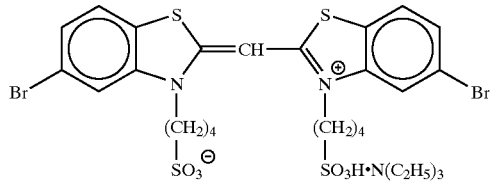

(Sensitizing Dye C)

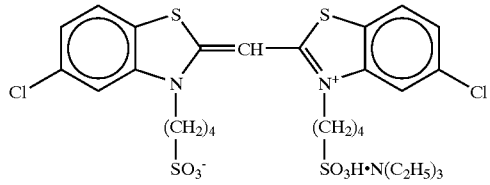

(Sensitizing Dye A was used in an amount of $3.0\times10^{-4}$ mol for Large Size Emulsion B1 and $4.0\times10^{-4}$ mol for Small Size Emulsion B2, Sensitizing Dye B was used in an amount of $3.1\times10^{-5}$ mol for the large size emulsion and $9.8\times10^{-5}$ mol for the small size emulsion, and Sensitizing Dye C was used in an amount of $1.5\times10^{-4}$ mol for the large size emulsion and $2.5\times10^{-4}$ mol for the small size emulsion, per mol of silver halide).

Red-Sensitive Emulsion Layer:

(Sensitizing Dye D)

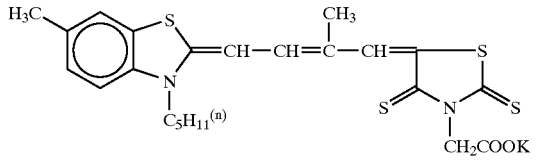

(Sensitizing Dye E)

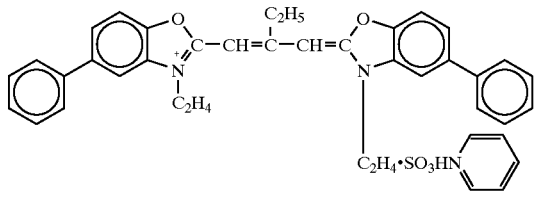

(Sensitizing Dye F)

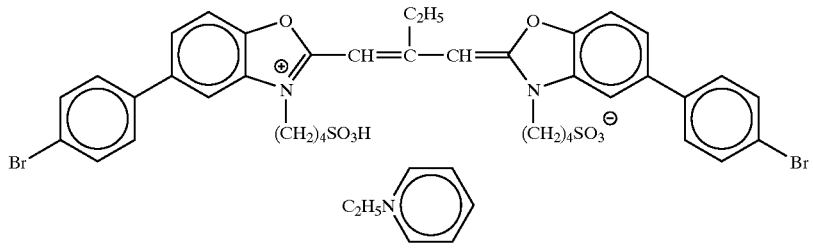

(Sensitizing Dye G)

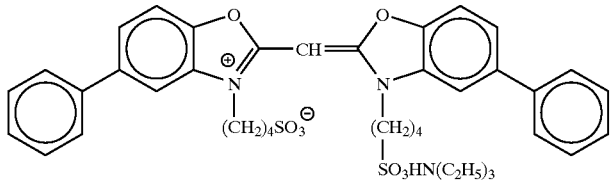

(Sensitizing Dye D was used in an amount of $4.0\times10^{-5}$ mol for Large Size Emulsion R1 and $5.0\times10^{-5}$ mol for Small Size Emulsion R2, Sensitizing Dye E was used in an amount of $2.0\times10^{-5}$ mol for the large size emulsion and $2.5\times10^{-5}$ mol for the small size emulsion, Sensitizing Dye F was used in an amount of $1.0\times10^{-5}$ mol for the large size emulsion and $1.2\times10^{-5}$ mol for the small size emulsion, and Sensitizing Dye G was used in an amount of $1.0\times10^{-6}$ mol for the large size emulsion and $1.2\times10^{-6}$ mol for the small size emulsion, per mol of silver halide).

Green-Sensitive Emulsion Layer:

(Sensitizing Dye H)

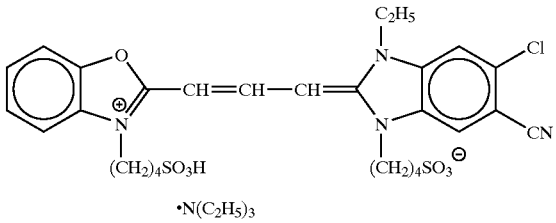

(Sensitizing Dye I)

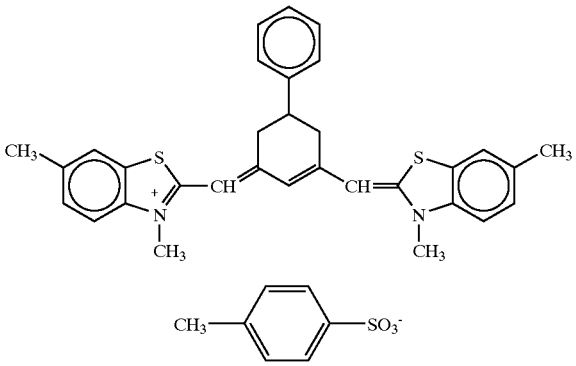

-continued (Sensitizing Dye J)

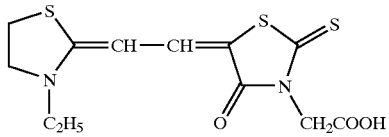

(Sensitizing Dye H was used in an amount of $2.0\times10^{-4}$ mol for Large Size Emulsion G1 and $4.0\times10^{-4}$ mol for Small Size Emulsion G2, Sensitizing Dye I was used in an amount of $1.5\times10^{-4}$ mol for the large size emulsion and $2.7\times10^{-4}$ mol for the small size emulsion, and Sensitizing Dye J was used in an amount of $1.0\times10^{-5}$ mol for the large size emulsion and $1.8\times10^{-5}$ mol for the small size emulsion, per mol of silver halide).

Furthermore, the following compound was added to the red-sensitive emulsion layer in an amount of $9.0\times10^{-4}$ mol per mol of silver halide:

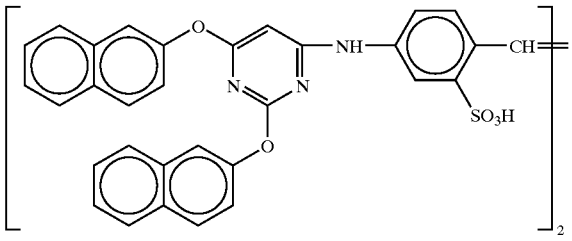

For the purpose of preventing irradiation, the following dyes (in the parentheses, the coated amounts are shown) were added to the emulsion layers.

(F-1)

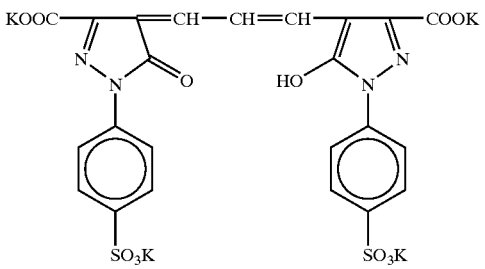

(0.040 g/m$^2$)

(F-2)

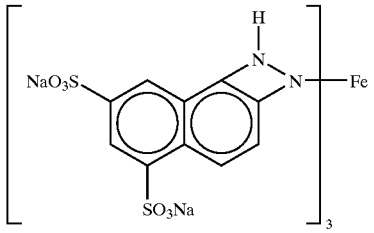

(0.094 g/m$^2$)

(Layer Structure)

The composition of each layer is shown below. The numerals show the coated amount (g/m$^2$). In the case of silver halide emulsions, a coated amount in terms of silver is shown.

Support

Polyethylene terephthalate film (Support (i))

| | |
|---|---|
| First Layer (Blue-Sensitive Emulsion Layer): | |
| Silver chlorobromide emulsion (cubic, average silver halide composition Br/Cl = 0.7 mol %:99.3 mol %, a 1:3 (by mol as silver) mixture of gold-sulfur sensitized Emulsion B1 having an average grain size of 0.6 μm and Emulsion B2 (the same as Emulsion B1 except that the average grain size is 0.4 μm)) | 0.49 |
| Gelatin | 2.10 |
| Yellow Coupler (ExY) | 1.18 |
| (Cpd-1) | 0.0005 |
| (Cpd-2) | 0.03 |
| (Cpd-3) | 0.02 |
| (Cpd-4) | 0.006 |
| (Cpd-5) | 0.019 |
| (Cpd-6) | 0.002 |
| Solvent (Solv-1) | 0.27 |
| Second Layer (Color Mixing Inhibiting Layer): | |
| Gelatin | 0.31 |
| (Cpd-9) | 0.02 |
| (Cpd-3) | 0.04 |
| Solvent (Solv-1) | 0.05 |
| Solvent (Solv-4) | 0.04 |
| Solvent (Solv-5) | 0.01 |
| Solvent (Solv-6) | 0.002 |
| Third Layer (Red-Sensitive Emulsion Layer): | |
| Silver Chlorobromide Emulsion R | 0.46 |
| Gelatin | 2.74 |

-continued

| | |
|---|---|
| Cyan Coupler (ExC) | 0.78 |
| (Cpd-7) | 0.06 |
| (Cpd-8) | 0.06 |
| (Cpd-10) | 0.03 |
| (Cpd-13) | 0.06 |
| Solvent (Solv-1) | 0.53 |
| Solvent (Solv-2) | 0.29 |
| Solvent (Solv-3) | 0.06 |
| Solvent (Solv-4) | 0.02 |
| Fourth Layer (Color Mixing Inhibiting Layer): | |
| Gelatin | 0.31 |
| (Cpd-9) | 0.02 |
| (Cpd-3) | 0.03 |
| Solvent (Solv-1) | 0.05 |
| Solvent (Solv-4) | 0.04 |
| Solvent (Solv-5) | 0.01 |
| Solvent (Solv-6) | 0.002 |
| Fifth Layer (Green-Sensitive Emulsion Layer): | |
| Silver chlorobromide emulsion (cubic, average halogen composition Br/Cl = 25 mol %:75 mol %, a 1:3 (by mol as silver) mixture of gold-sulfur sensitized Emulsion G1 having an average grain size of 0.18 μand Emulsion G2 (the same as Emulsion R1 except that the average grain size is 0.10 μm)) | 0.55 |
| Gelatin | 1.28 |
| Magenta Coupler (ExM) | 0.68 |
| (Cpd-9) | 0.014 |
| (Cpd-5) | 0.001 |
| Solvent (Solv-1) | 0.12 |
| Sixth Layer (Protective Layer): | |
| Gelatin | 0.96 |
| Acryl-modified copolymer of polyvinyl alcohol (modification degree: 17%) | 0.02 |
| (Cpd-12) | 0.04 |

The compounds used here are shown below.

ExY

A 80:10:10 (by mol) mixture of (1), (2) and (3):

(1)

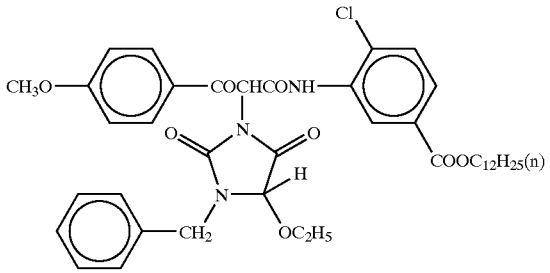

(2)

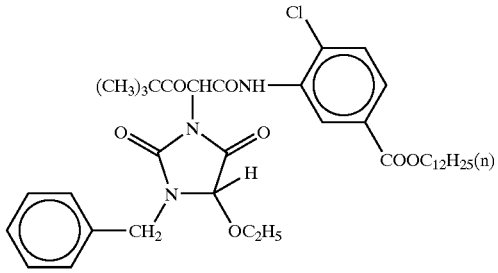

-continued
(3)
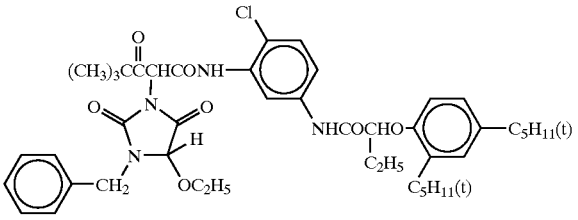
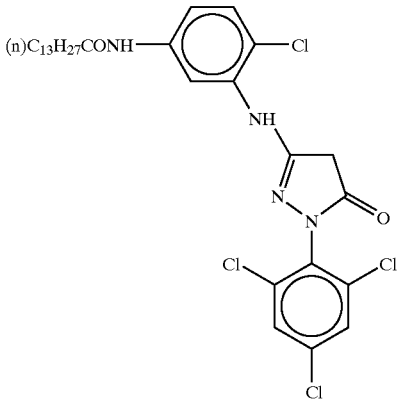
E x M
ExC
A 75:5:20 (by mol) mixture of (1), (2) and (3)
(1)
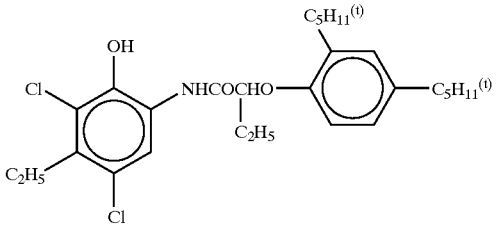
(2)
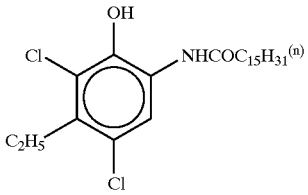
(3)
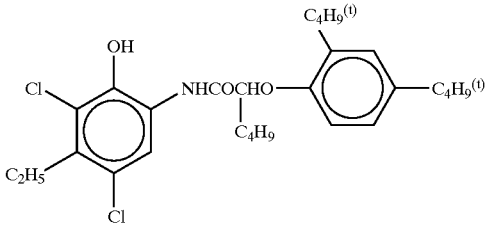
(Cpd-1)
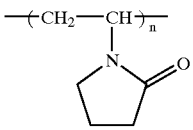
-continued
(Cpd-2)
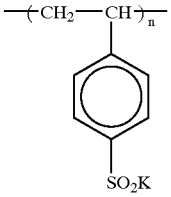
(Cpd-3)
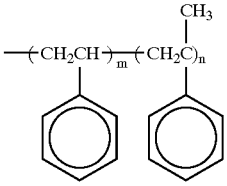
Number average
molecular weight: 500
m/n=10/90
(Cpd-4)
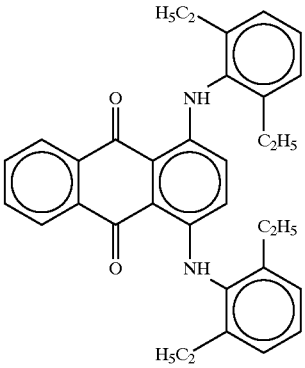
(Cpd-5)
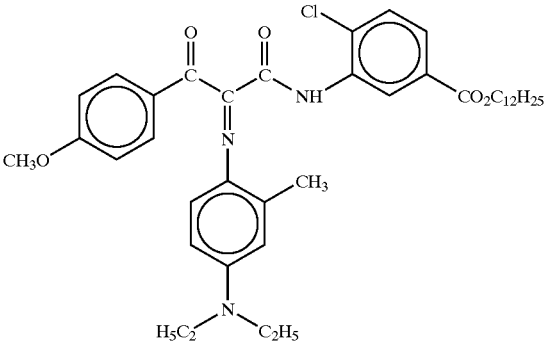
(Cpd-6)
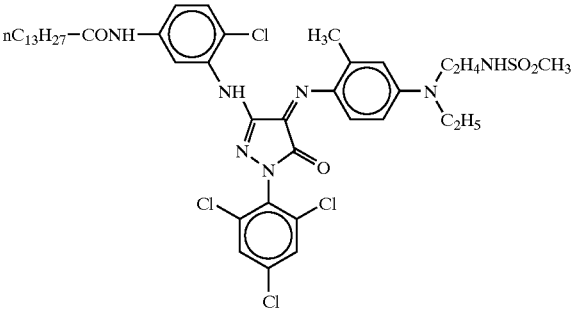

-continued (Cpd-7)

A 2 : 1 : 7 (by weight) mixture of (1), (2) and (3):

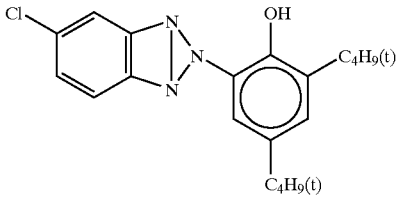

(1)

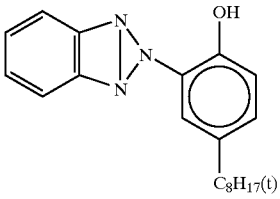

(2)

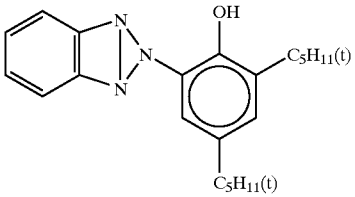

(3)

(Cpd-8)

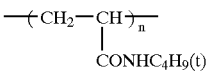

Average molecular weight: about 60,000

(Cpd-9)

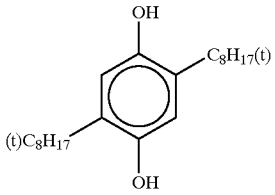

(Cpd-10)

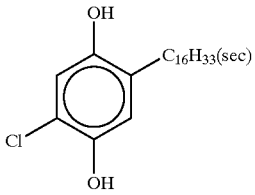

(Cpd-11)

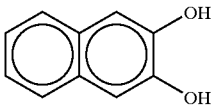

-continued (Cpd-12)

A 7 : 1 (by weight )mixture of

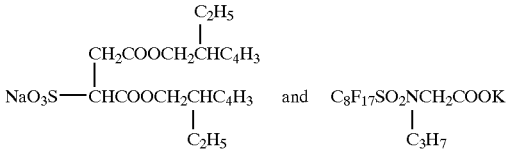

(Cpd-13)

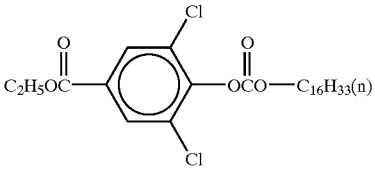

(Solv-1)

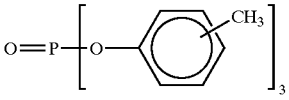

(Solv-2)

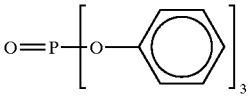

(Solv-3)

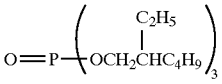

(Solv-4)

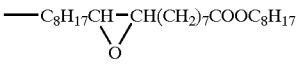

(Solv-5)

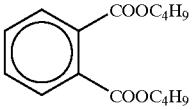

(Solv-6)

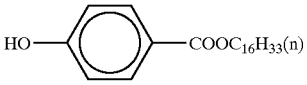

(Preparation of Samples 102 to 120)

Samples 102 to 120 were prepared in the same manner as Sample 101 except for changing the support, the presence or absence of the layer between the support and the first layer and the composition of the layer and also replacing a part of Cyan Coupler ExC used in the third layer by a cyan coupler of the present invention. In either the gelatin layer or the gelatin layer containing the dye solid fine particle dispersion prepared in advance, which was provided between the first layer and the support, the amount of gelatin coated was 0.93 $g/m^1$. Furthermore, the amount of coating solution for the third layer coated was controlled so as to give a constant color density of the cyan dye image.

The used amount of the cyan coupler according to the present invention, the support, the gelatin layer between the support and the first layer, the use or no use of the dye solid fine particle dispersion, and the amount of the dispersion used are shown together with the test results of this Example in Table 1-2 below.

(Preparation of Processing Solutions)

As a standard method for processing a cinematic color positive film, a processing process resulting from excluding the sound development step from the Process ECP-2 publicly opened by Eastman Kodak was prepared. The samples manufactured all were exposed to such an image that about 30% of the coated silver amount is developed. After the completion of exposure, the samples were subjected to a continuos processing (running test) until the replenishing amount in the color development bath reached 2 times the tank volume, thereby presenting a state of the development processing reaching running equilibrium.

Process ECP-2:

<Processing Steps>

| | Name of Step | Processing Temperature (° C.) | Processing Time (sec) | Replenishing Amount (ml, per 35 mm–100 ft |
|---|---|---|---|---|
| 1 | Prebath | 27 ± 1 | 10–20 | 400 |
| 2 | Water washing | 27 ± 1 | jet washing | — |
| 3 | Development | 36.7 ± 0.1 | 180 | 690 |
| 4 | Stopping | 27 ± 1 | 40 | 770 |
| 5 | Water washing | 27 ± 3 | 40 | 1200 |
| 6 | First fixing | 27 ± 1 | 40 | 200 |
| 7 | Water washing | 27 ± 3 | 40 | 1200 |
| 8 | Acceleration of bleaching | 27 ± 1 | 20 | 200 |
| 9 | Bleaching | 27 ± 1 | 40 | 200 |
| 10 | Water washing | 27 ± 3 | 40 | 1200 |
| 11 | Drying | | | |
| 12 | Sound development | room temperature | 10–20 | — (coating) |
| 13 | Water washing | 27 ± 3 | 1–2 | — (spraying) |
| 14 | Second fixing | 27 ± 1 | 40 | 200 |
| 15 | Water washing | 27 ± 3 | 60 | 1200 |
| 16 | Rinsing | 27 ± 3 | 10 | 400 |
| 17 | Drying | | | |

Formulation of Processing Solutions

The processing solutions each had a composition shown below per l.

| Name of Step | Name of Chemicals | Tank Solution | Replenishing Solution |
|---|---|---|---|
| Prebath | Borax | 20 g | 20 g |
| | Sodium sulfate | 100 g | 100 g |
| | sodium hydroxide | 1.0 g | 1.5 g |
| Development | Kodak Anti-Calcium No. 4 | 1.0 ml | 1.4 ml |
| | Sodium sulfite | 4.35 g | 4.50 g |
| | D-3 | 2.95 g | 6.00 g |
| | Sodium carbonate | 17.1 g | 18.0 g |
| | Sodium bromide | 1.72 g | 1.60 g |
| | Sodium hydroxide | — | 0.6 g |
| | Sulfuric acid (7N) | 0.62 ml | — |
| Stopping | Sulfuric acid (7N) | 50 ml | 50 ml |
| Fixing (common in first and second fixing steps | Ammonium thiosulfate (58%) | 100 ml | 170 ml |
| | Sodium sulfite | 2.5 g | 16.0 g |
| | Sodium hydrogensulfite | 10.3 g | 5.8 g |
| | potassium iodide | 0.5 g | 0.7 g |

-continued

| Name of Step | Name of Chemicals | Tank Solution | Replenishing Solution |
|---|---|---|---|
| Acceleration of bleaching | Sodium hydrogenmetasulfite | 3.3 g | 5.6 g |
| | Acetic acid | 5.0 ml | 7.0 ml |
| | PBA-1 (Kodak Persulfate Bleach Accelerator) | 3.3 g | 4.9 g |
| | EDTA-4Na | 0.5 g | 0.7 g |
| Bleaching | Gelatin | 0.35 g | 0.50 g |
| | Sodium persulfate | 33 g | 52 g |
| | Sodium chloride | 15 g | 20 g |
| | Sodium dihydrogenphosphate | 7.0 g | 10.0 g |
| | Phosphoric acid (85%) | 2.5 ml | 2.5 ml |
| Sound development | Natrosal 250HR | 2.0 g | |
| | Sodium hydroxide | 80 g | |
| | Hexyl glycol | 2.0 ml | |
| | Sodium sulfite | 60 g | |
| | Hydroquinone | 60 g | |
| | Ethylenediamine (98%) | 13 ml | |
| Rinsing | Kodak Stabilizer Additive | 0.14 ml | 0.17 ml |
| | Dearcide 702 | 0.7 ml | 0.7 ml |

(Evaluation of Hue)

Each sample was exposed through a red filter and an optical wedge capable of giving change in the optical density by 0.2 per 5 mm, using a sensitometer (Model FWH, color temperature of the light source: 3,200K, manufactured by Fuji Photo Film Co., Ltd.) and then processed with the processing solution after the completion of running test above to obtain cyan color-formed samples. The samples were measured on the color density by Desitometer X-Rite 310 and the Y density in the area giving R density of 1.0 was used as a value for the evaluation of hue. The smaller the value is, the smaller the side absorption of the cyan dye image and the higher the color saturation.

(Evaluation of Red Spot Failure)

Each sample of 0.005 $m^2$ was placed under white light and then processed with the same processing solution as above to prepare full-color samples. The surface on the emulsion surface side of each sample was scratched by a diamond needle having a tip in a 0.01 $\mu$m diameter under a load of 25 g to make cross scratches at intervals of 5 mm on the sample surface. A lubricating oil for motion picture projectors was spread on each sample and then the samples were left standing in an environment of 90° C.-80% RH for 3 days. A gauze was applied to the surface of each sample returned to the room temperature environment and the samples each was left standing as it is for 1 day. Thereafter, the dye adhering to the gauze was extracted with 20 ml of ethyl acetate. The extract was measured on the absorbance on a visible spectrum and the resistance to the red spot failure was evaluated. The results are shown by a relative value to Sample 101. The smaller the value, the smaller the amount of dye dissolved out from the light-sensitive material and the higher the durability.

The contents of each sample and the test results are shown in Table 1-2 below.

TABLE 1-2

Contents and Test results of Samples 102 to 120

| Sample No. | Support | Layer Between Support and 1st Layer: Presence or Absence of Layer | Dye Solid Fine Particle Dispersion: Kind | Dye Solid Fine Particle Dispersion: Amount Used ($g/m^2$) | Cyan Coupler of the Invention: Kind | Cyan Coupler of the Invention: Amount Used (mol %) | Amount of 3rd Layer Coated | Effect: Cyan Hue | Effect: Red Spot | Remarks |
|---|---|---|---|---|---|---|---|---|---|---|
| 101 | (i) | none | — | — | none | 0 | 100 | 0.24 | 1.00 | Comparison |
| 102 | (i) | none | — | — | (1) | 70 | 69 | 0.13 | 2.64 | Comparison |
| 103 | (i) | provided | none | — | none | 0 | 100 | 0.24 | 0.97 | Comparison |
| 104 | (i) | provided | none | — | (1) | 70 | 69 | 0.13 | 0.94 | Invention |
| 105 | (ii) | none | — | — | (1) | 70 | 69 | 0.13 | 2.43 | Comparison |
| 106 | (ii) | provided | none | — | none | 0 | 100 | 0.24 | 0.99 | Comparison |
| 107 | (ii) | provided | none | — | (1) | 70 | 69 | 0.13 | 0.98 | Invention |
| 108 | (ii) | provided | A | 0.16 | (1) | 70 | 69 | 0.13 | 0.82 | Invention |
| 109 | (ii) | provided | B | 0.16 | (1) | 70 | 69 | 0.16 | 0.88 | Invention |
| 110 | (ii) | provided | C | 0.16 | (1) | 70 | 69 | 0.16 | 0.86 | Invention |
| 111 | (ii) | provided | D | 0.16 | (1) | 20 | 87 | 0.19 | 0.76 | Invention |
| 112 | (ii) | provided | D | 0.16 | (1) | 50 | 74 | 0.15 | 0.79 | Invention |
| 113 | (ii) | provided | D | 0.16 | (1) | 70 | 69 | 0.13 | 0.80 | Invention |
| 114 | (ii) | provided | D | 0.16 | (25) | 70 | 73 | 0.15 | 0.84 | Invention |
| 115 | (ii) | provided | D | 0.03 | (1) | 70 | 69 | 0.13 | 0.93 | Invention |
| 116 | (ii) | provided | D | 0.32 | (1) | 70 | 69 | 0.14 | 0.94 | Invention |
| 117 | (ii) | provided | E | 0.16 | (1) | 20 | 87 | 0.13 | 0.78 | Invention |
| 118 | (ii) | provided | E | 0.16 | (1) | 70 | 69 | 0.13 | 0.85 | Invention |
| 119 | (ii) | provided | F | 0.16 | (1) | 70 | 69 | 0.13 | 0.82 | Invention |
| 120 | (ii) | provided | G | 0.16 | (1) | 70 | 69 | 0.13 | 0.83 | Invention |

As a result of evaluation, the samples using the cyan coupler according to the present invention are verified to be excellent samples where a cyan dye image of high saturation color reduced in the side absorption is formed and since the amount of third layer coated can be decreased, the amount of materials used, including silver, can be decreased. However, in samples having no layer between the support and the first layer (Samples 102 and 105), the amount of dye dissolved out is large despite the reduction in the coated amount. In these test results, the dye is dissolved out even in a larger amount than in Sample 101, defeating the fact that the dye produced from the cyan coupler according to the present invention has a high molecular extinction coefficient. On the other hand, in samples where a layer is provided between the support and the first layer, the amount of dye dissolved out is small and this reveals that the red spot failure is improved. From these results, it is seen that only the samples of the present invention can attain improvements both in the hue and the red spot failure.

Example I-2

(Preparation of Sample 201)

Sample 201 having the following composition was prepared in the same manner as in Example I-1. Considering the demand in recent years, Sample 201 is a sample capable of giving a color density about 20% higher than the sample of Example I-1.

(Layer Structure)

The layer structure of Sample 201 is shown below. The numerals show the coated amount ($g/m^2$). In the case of silver halide emulsions, a coated amount in terms of silver is shown.

Support:

Polyethylene terephthalate film (Support (ii) in Example I-1).

| | |
|---|---|
| **First Layer (Gelatin Layer):** | |
| Gelatin | 0.93 |
| **Second Layer (Blue-Sensitive Emulsion Layer):** | |
| Silver chlorobromide emulsion (a 1:3 (by mol as silver) mixture of Silver Chlorobromide Emulsions B1 and B2). | 0.59 |
| Gelatin | 3.15 |
| Yellow Coupler (ExY) | 1.42 |
| (Cpd-1) | 0.0006 |
| (Cpd-2) | 0.04 |
| (Cpd-3) | 0.02 |
| (Cpd-4) | 0.007 |
| (Cpd-5) | 0.023 |
| (Cpd-6) | 0.002 |
| Solvent (Solv-1) | 0.33 |
| **Third Layer (Color Mixing Inhibiting Layer):** | |
| Gelatin | 0.37 |
| (Cpd-9) | 0.02 |
| (Cpd-3) | 0.04 |
| Solvent (Solv-1) | 0.05 |
| Solvent (Solv-4) | 0.04 |
| Solvent (Solv-5) | 0.01 |
| Solvent (Solv-6) | 0.002 |
| **Fourth Layer (Red-Sensitive Emulsion Layer):** | |
| Silver Chlorobromide Emulsion R | 0.56 |
| Gelatin | 3.34 |
| Cyan Coupler (ExC) | 0.95 |
| (Cpd-7) | 0.07 |
| (Cpd-8) | 0.07 |
| (Cpd-10) | 0.04 |
| (Cpd-13) | 0.07 |
| Solvent (Solv-1) | 0.65 |
| Solvent (Solv-2) | 0.35 |

-continued

| | |
|---|---|
| Solvent (Solv-3) | 0.07 |
| Solvent (Solv-4) | 0.02 |
| Fifth Layer (Color Mixing Inhibiting Layer): | |
| Gelatin | 0.37 |
| (Cpd-9) | 0.02 |
| (Cpd-3) | 0.03 |
| Solvent (Solv-1) | 0.05 |
| Solvent (Solv-4) | 0.04 |
| Solvent (Solv-5) | 0.01 |
| Solvent (Solv-6) | 0.002 |
| Sixth Layer (Green-Sensitive Emulsion Layer): | |
| A 1:3 (by mol as silver) mixture of Silver Chlorobromide Emulsions G1 and G2 | 0.63 |
| Gelatin | 1.48 |
| Magenta Coupler (ExM) | 0.78 |
| (Cpd-9) | 0.016 |
| (Cpd-5) | 0.001 |
| Solvent (Solv-1) | 0.14 |
| Seventh Layer (Protective Layer): | |
| Gelatin | 0.96 |
| Acryl-modified copolymer of polyvinyl alcohol (modification degree: 17%) | 0.02 |
| (Cpd-12) | 0.04 |

(Evaluation of Sharpness)

The evaluation of sharpness was performed on the magenta dye image having a large visual influence. Each sample was exposed through a green filter and an optical wedge for the measurement of sharpness and then developed with the processing solution after the completion of running test, through the same processing procedure as above exclusive of the first prebath step and the subsequent water washing step. After the completion of processing, samples were subjected to CTF measurement and the sharpness was evaluated by the spatial frequency (recurrences/mm) giving CTF of 0.8. The larger the value, the higher the sharpness.

Incidentally, samples using the support (i) like Sample 101 cannot be processed by this processing method through the above-described procedure, because the carbon resin back cannot be completely removed and the color developing bath is contaminated with carbon fine particles. Samples using such a support are disadvantageous in view of suitability for simple processing.

(Evaluation of White Background Density)

Samples 201 to 211 before exposure were processed through the same procedure as above (in the evaluation of sharpness) and the density of each processed sample was measured by a densitometer X-Rite 310. The white background density was evaluated by the difference in the measured Y density value based on Sample 201. The smaller the value, the lower the white background density.

The contents of each sample and the evaluation results are shown in the Table 2-1 below.

TABLE 2-1

Contents and Evaluation Results of Samples 201 to 211

| Sample No. | Fine Particle Dispersion in 1st Layer | Kind of Dye Solid: Cyan Coupler of the Invention Kind | Amount Used (mol %) | Amount of 4th Layer Coated (%) | Amount of Dye Coated ($g/m^2$) F-1 | F-2 | Sharpness | White Background Density | Remarks |
|---|---|---|---|---|---|---|---|---|---|
| 201 | none | none | — | 100 | 0.040 | 0.093 | 18 | — | Comparison |
| 202 | D | none | — | 100 | 0.040 | 0.093 | 22 | 0.04 | Comparison |
| 203 | D | none | — | 100 | 0.048 | 0.115 | 34 | 0.09 | Comparison |
| 204 | none | (1) | 70 | 69 | 0.080 | 0.188 | 29 | 0.01 | Invention |
| 205 | D | (1) | 70 | 69 | 0.030 | 0.088 | 39 | −0.04 | Invention |
| 206 | D | (1) | 20 | 87 | 0.030 | 0.091 | 35 | 0.00 | Invention |
| 207 | D | (1) | 50 | 74 | 0.030 | 0.089 | 37 | 0.00 | Invention |
| 208 | D | (25) | 70 | 73 | 0.030 | 0.088 | 36 | −0.02 | Invention |
| 209 | A | (1) | 70 | 69 | 0.030 | 0.088 | 32 | −0.02 | Invention |
| 210 | C | (1) | 70 | 69 | 0.040 | 0.090 | 28 | 0.00 | Invention |
| 211 | E | (1) | 70 | 69 | 0.030 | 0.088 | 38 | −0.03 | Invention |

The compounds used here each had the same structure as in Example I-1.

(Preparation of Samples 202 to 211)

Samples 202 to 211 were prepared in the same manner as Sample 201 except that, similarly to Example I-1, the composition of the first layer was changed and a part of Cyan Coupler ExC used in the fourth layer was replaced by the cyan coupler according to the present invention. When a dye solid fine particle dispersion was used in the first layer, the amount of the dispersion used was 0.16 $g/m^2$. Furthermore, the coated amount of coating solution for the fourth layer was controlled so as to give a constant color density of cyan dye image.

The amount used of the cyan coupler according to the present invention, the use or no use of the dye solid fine particle dispersion in the first layer, and the amount of the dispersion used are shown together with the test results of this Example in Table 2-1 below.

As seen from the evaluation results, samples using conventional cyan couplers must sacrifice the whiteness so as to obtain sufficiently high sharpness (Samples 201 to 203), however, when the coupler according to the present invention is used, both can be simultaneously attained. At this time, when a dye solid fine particle dispersion is used, the sharpness and the whiteness both can be attained at a higher level.

Effects of the Invention

The silver halide color photographic light-sensitive material for movie of the present invention is favored with high color saturation and excellent durability and at the same time, is improved in both the sharpness and the white background density.

Example II-1

(Preparation of Sample 301)

On an undercoated polyethylene terephthalate film support (thickness: 120 μm, a resin layer containing carbon fine particles was provided on the side opposite to the surface to be coated with an emulsion, to give a transmission density of 1.0), layers each having the following compositions were coated one on another to manufacture Sample 301 as a multi-layer color light-sensitive material. The coating solutions for respective photographic constituent layers were prepared as follows.

(Preparation of Coating Solution for Third Layer)

116 g of Cyan Coupler (ExC), 8.8 g of Additive (Cpd-7), 9 g of Additive (Cpd-8), 4.8 g of Additive (Cpd-10) and 10 g of Additive (Cpd-13) were dissolved in 79 g of Solvent (Solv-1), 44 g of Solvent (Solv-2), 9 g of Solvent (Solv-3), 4 g of Solvent (Solv-4) and 150 ml of ethyl acetate. The resulting solution was emulsification-dispersed in 1,000 g of a 10% aqueous gelatin solution containing 80 ml of 10% sodium dodecylbenzenesulfonate to prepared Emulsification Dispersion C.

Separately, Silver Chlorobromide Emulsion R (cubic; a 2:8 (by mol as silver) mixture of Large Size Emulsion R1 and Small Size Emulsion R2 having an average grain size of 0.17 μm and 0.135 μm, respectively; the coefficients of variation in the grain size distribution being 13 and 14, respectively; each emulsion having a halogen composition of Br/Cl=25/75) was prepared. In this emulsion, Red-Sensitizing Dye D was used in an amount of $4.0\times10^{-5}$ mol for the large size emulsion $R_1$ and $5.0\times10^{-5}$ mol for the small size emulsion $R_2$, Sensitizing Dye E was used in an amount of $2.0\times10^{-5}$ mol for the large size emulsion $R_1$ and $2.5\times10^{-5}$ mol for the small size emulsion $R_2$, Sensitizing Dye F was used in an amount of $1.0\times10^{-5}$ mol for the large size emulsion $R_1$ and $1.2\times10^{-5}$ mol for the small size emulsion $R_2$, and Sensitizing Dye G was used in an amount of $1.0\times10^{-6}$ mol for the large size emulsion $R_1$ and $1.2\times10^{-6}$ mol for the small size emulsion $R_2$, per mol of silver halide. Furthermore, this emulsion was subjected to optimal chemical ripening by adding a sulfur sensitizer and a gold sensitizer.

Emulsification Dispersion C prepared above and this Silver Chlorobromide Emulsion R were mixed and dissolved to prepare a coating solution for the third layer having the composition shown later. The amount of emulsion coated is shown by a coated amount in terms of silver.

The coating solutions for the first to sixth layers were prepared in the same manner as the coating solution for the third layer. In each layer, sodium 1-oxy-3,5-dichloro-s-triazine was used as the gelatin hardening agent.

For the silver chlorobromide emulsion of each light-sensitive emulsion layer, the following spectral sensitizing dyes were used.

Blue-Sensitive Emulsion Layer:

(Sensitizing Dye A)

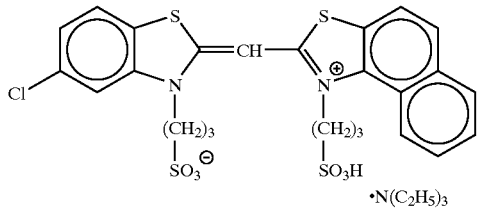

(Sensitizing Dye B)

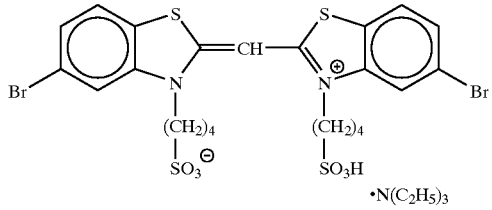

(Sensitizing Dye C)

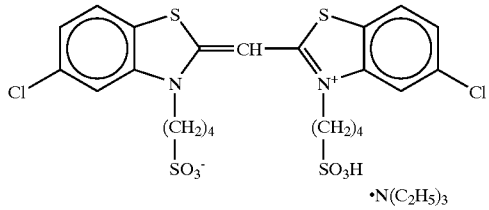

(Sensitizing Dye A was used in an amount of $3.0\times10^{-4}$ mol for the large size emulsion and $4.0\times10^{-4}$ mol for the small size emulsion, Sensitizing Dye B was used in an amount of $3.1\times10^{-5}$ mol for the large size emulsion and $_{9.8\times10}{}^{-5}$ mol for the small size emulsion, and Sensitizing Dye C was used in an amount of $1.5\times10^{-4}$ mol for the large size emulsion and $2.5\times10^{-4}$ mol for the small size emulsion, per mol of silver halide).

Red Sensitive Emulsion Layer:

(Sensitizing Dye D)

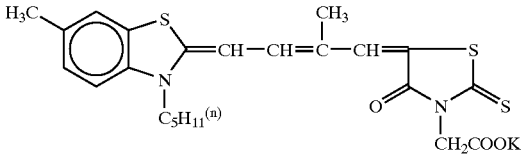

(Sensitizing Dye E)

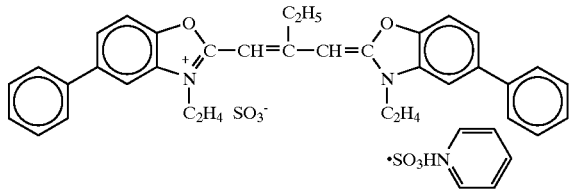

-continued (Sensitizing Dye F)

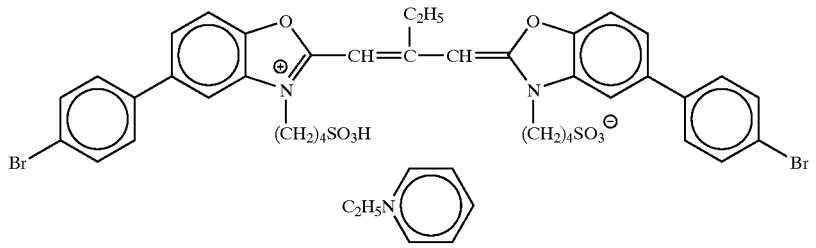

(Sensitizing Dye G)

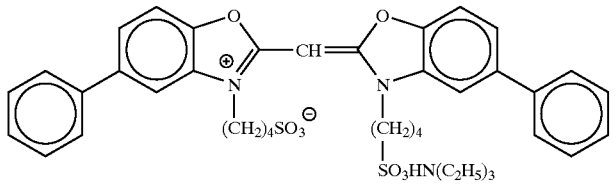

(Sensitizing Dye D was used in an amount of $4.0\times10^{-5}$ mol for the large size emulsion and $5.0\times10^{-5}$ mol for the small size emulsion, Sensitizing Dye E was used in an amount of $2.0\times10^{-5}$ mol for the large size emulsion and $2.5\times10^{-5}$ mol for the small size emulsion, Sensitizing Dye F was used in an amount of $1.0\times10^{-5}$ mol for the large size emulsion and $1.2\times10^{-5}$ mol for the small size emulsion, and Sensitizing Dye G was used in an amount of $1.0\times10^{-6}$ mol for the large size emulsion and $1.2\times10^{-6}$ mol for the small size emulsion, per mol of silver halide).

Green-Sensitive Emulsion Layer:

(Sensitizing Dye H)

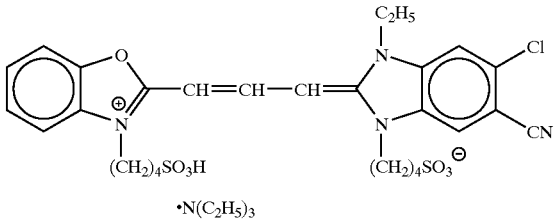

(Sensitizing Dye I)

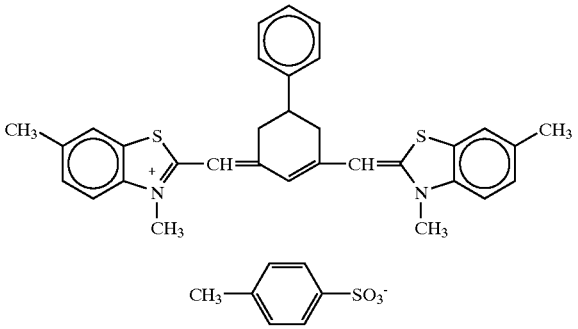

(Sensitizing Dye J)

(Sensitizing Dye B was used in an amount of $2.0\times10^{-4}$ mol for the large size emulsion and $4.0\times10^{-4}$ mol for the small size emulsion, Sensitizing Dye I was used in an amount of $1.5\times10^{-4}$ mol for the large size emulsion and $2.7\times10^{-4}$ mol for the small size emulsion, and Sensitizing Dye J was used in an amount of $1.0\times10^{-5}$ mol for the large size emulsion and $1.8\times10^{-5}$ mol for the small size emulsion, per mol of silver halide).

Furthermore, the following compound was added to the red-sensitive emulsion layer in an amount of $9.0\times10^{-4}$ mol per mol of silver halide:

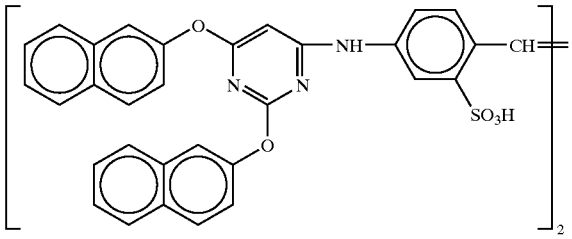

For the purpose of preventing irradiation, the following dyes (in the parentheses, the coated amounts are shown) were added to the emulsion layers.

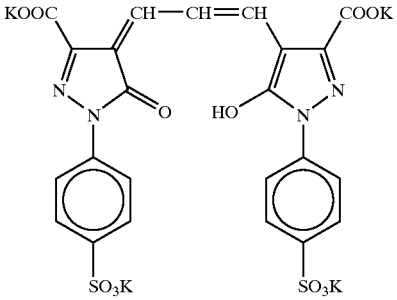

(0.040 g/m$^2$)

-continued

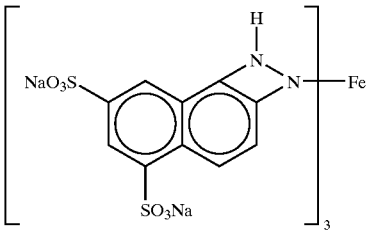

(0.094 g/m$^2$)

(Layer Structure)

The composition of each layer is shown below. The numerals show the coated amount (g/m$^2$). In the case of silver halide emulsions, a coated amount in terms of silver is shown.

Support

Polyethylene terephthalate film (a resin layer containing carbon fine particles was provided on the side opposite to the first layer).

| First Layer (Blue-Sensitive Emulsion Layer): | |
|---|---|
| Silver chlorobromide emulsion (cubic, average silver halide composition Br/Cl = 0.7 mol %:99.3 mol %, a 1:3 (by mol as silver) mixture of gold-sulfur sensitized Emulsion B1 having an average grain size of 0.6 μm and Emulsion B2 (the same as Emulsion B1 except that the average grain size is 0.4 μm)) | 0.49 |
| Gelatin | 2.10 |
| Yellow coupler (ExY) | 1.18 |
| (Cpd-1) | 0.0005 |
| (Cpd-2) | 0.03 |
| (Cpd-3) | 0.02 |
| (Cpd-4) | 0.006 |
| (Cpd-5) | 0.019 |
| (Cpd-6) | 0.002 |
| Solvent (Solv-1) | 0.27 |
| **Second Layer (Color Mixing Inhibiting Layer):** | |
| Gelatin | 0.31 |
| (Cpd-9) | 0.02 |
| (Cpd-3) | 0.04 |
| Solvent (Solv-1) | 0.05 |
| Solvent (Solv-4) | 0.04 |
| Solvent (Solv-5) | 0.01 |
| Solvent (Solv-6) | 0.002 |
| **Third Layer (Red-Sensitive Emulsion Layer):** | |
| Silver Chlorobromide Emulsion R | 0.46 |
| Gelatin | 2.44 |
| Cyan Coupler (ExC) | 0.69 |
| (Cpd-7) | 0.05 |
| (Cpd-8) | 0.05 |
| (Cpd-10) | 0.03 |
| (Cpd-13) | 0.06 |
| Solvent (Solv-1) | 0.47 |
| Solvent (Solv-2) | 0.26 |
| Solvent (Solv-3) | 0.05 |
| Solvent (Solv-4) | 0.02 |
| **Fourth Layer (Color Mixing Inhibiting Layer):** | |
| Gelatin | 0.31 |
| (Cpd-9) | 0.02 |
| (Cpd-3) | 0.03 |
| Solvent (Solv-1) | 0.05 |
| Solvent (Solv-4) | 0.04 |
| Solvent (Solv-5) | 0.01 |
| Solvent (Solv-6) | 0.002 |

-continued

| Fifth Layer (Green-Sensitive Emulsion Layer): | |
|---|---|
| Silver chlorobromide emulsion (cubic, average silver halide composition Br/Cl = 25 mol %:75 mol %, a 1:3 (by mol as silver) mixture of gold-sulfur sensitized Emulsion G1 having an average grain size of 0.18 μm and Emulsion G2 (the same as Emulsion G1 except that the average grain size is 0.10 μm)) | 0.55 |
| Gelatin | 1.28 |
| Magenta Coupler (ExM) | 0.68 |
| (Cpd-9) | 0.014 |
| (Cpd-5) | 0.001 |
| Solvent (Solv-1) | 0.12 |
| **Sixth Layer (Protective Layer):** | |
| Gelatin | 0.96 |
| Acryl-modified copolymer polyvinyl alcohol (modification degree: 17%) | 0.02 |
| (Cpd-12) | 0.04 |

ExY

A 80:10:10 (by mol) mixture of (1), (2) and 3):

(1)

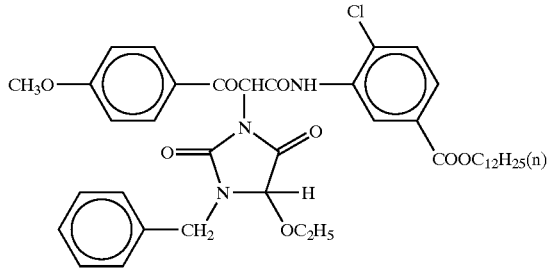

(2)

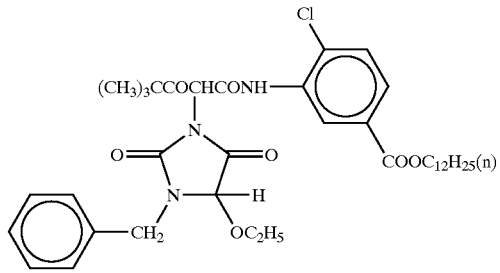

(3)

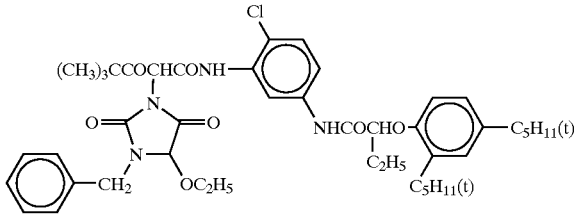

-continued
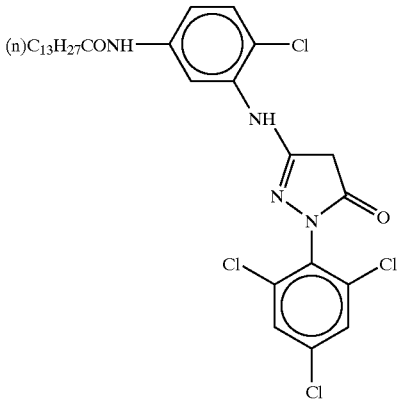
E x M
ExC
A 75:5:20 (by mol) mixture of (1), (2) and (3)
①
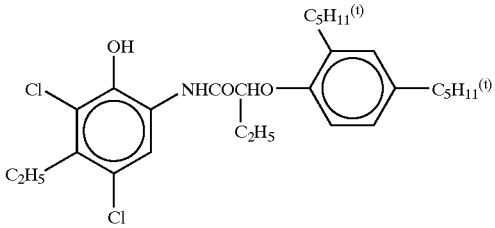
②
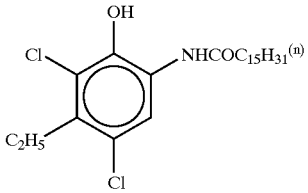
③
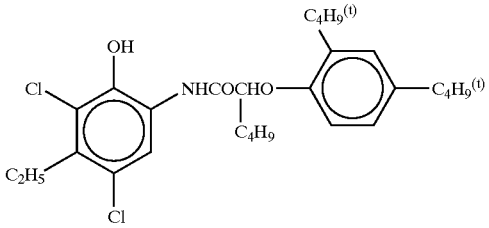
Ex1
A 55:5:20:20 (by mol) mixture of ①, ②, ③and (1):
①
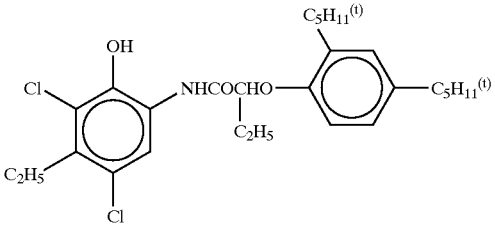
②
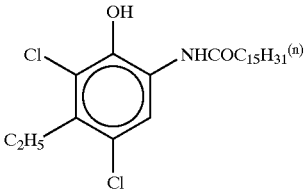
③
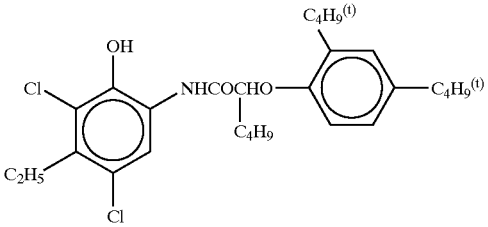
(1)
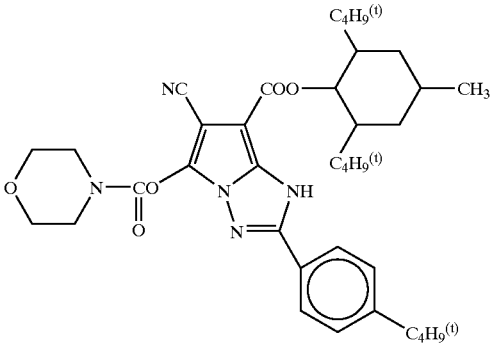
(Cpd-1)
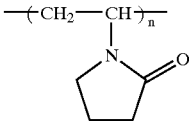
(Cpd-2)
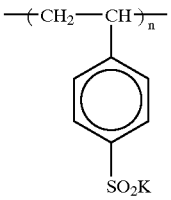

-continued
(Cpd-3)
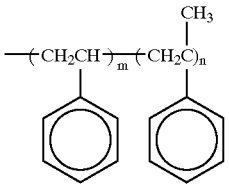
Number average molecular weight: 500
m/n=10/90
(Cpd-4)
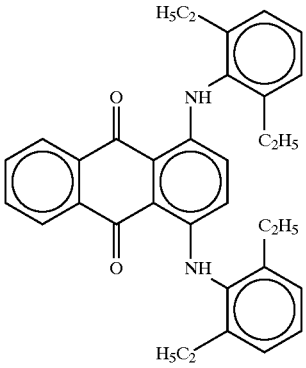
(Cpd-5)
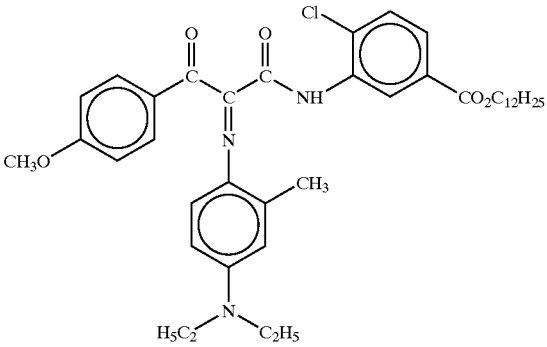
(Cpd-6)
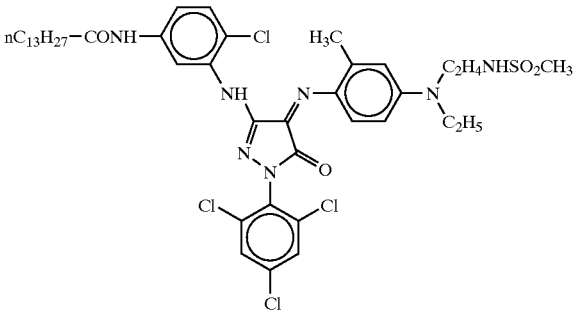
(Cpd-7)
A 2 : 1 : 7 (by weight) mixture of (1), (2) and (3):
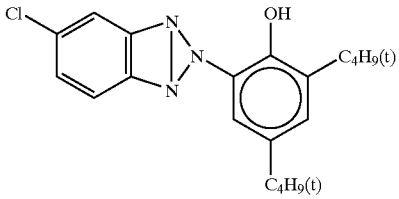
(1)
-continued
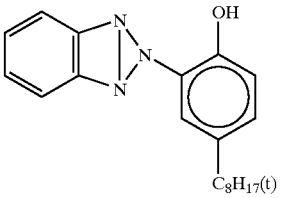
(2)
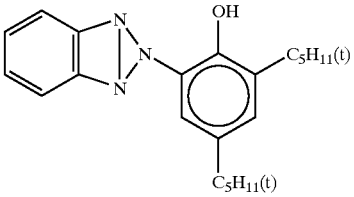
(3)
(Cpd-8)
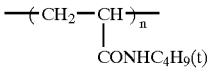
Average molecular weight: about 60,000
(Cpd-9)
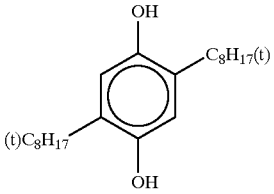
(Cpd-10)
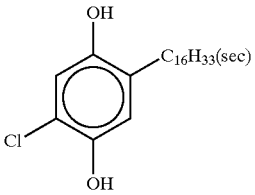
(Cpd-11)
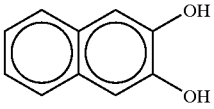
(Cpd-12)
A 7 : 1 (by weight )mixture of
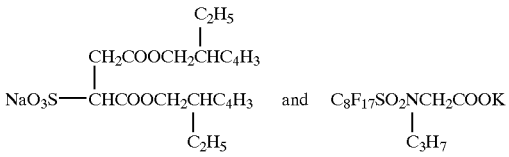
(Cpd-13)
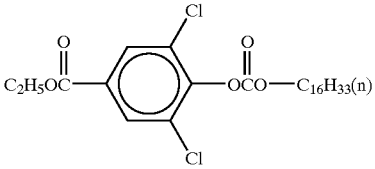
(Solv-1)
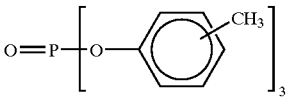

-continued (Solv-2)

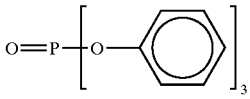

(Solv-3)

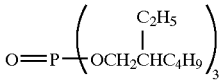

(Solv-4)

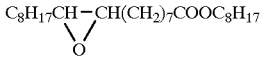

(Solv-5)

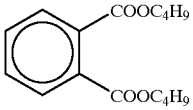

(Solv-6)

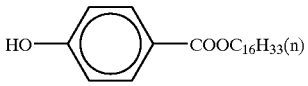

Electrically Conductive Polymer 1:

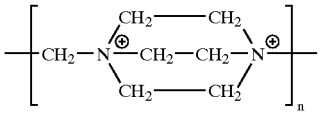

Comparative Dye

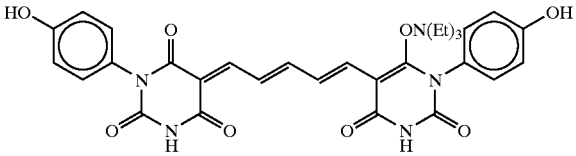

(Preparation of Samples 302 to 327)

Samples 302 to 327 were prepared in the same manner as Sample 301 except that the support was changed to an undercoated polyethylene terephthalate film support (thickness: 120 μm, a hydrophilic colloid layer containing an electrically conductive polymer shown below (0.05 g/m$^2$) and tin oxide fine particles (0.20 g/m$^2$) was provided on the side opposite to the surface to be coated with an emulsion) and an antihalation layer having the following composition containing a dye solid fine particle dispersion was interposed between the support and the first layer.

(Composition of Antihalation Layer)

| | |
|---|---|
| Gelatin | 0.93 |
| Dispersion of dye solid fine particles | 0.16 |

The dye solid fine particle dispersion used in each sample was prepared as follows.

(Preparation of Solid Fine Particle Dispersion of Dye)

A methanol wet cake of Compound (IV-1) was weighed to have a compound net of 240 g, Compound (V-12) as a dispersion aid was weighed to 48 g and water was added thereto to make 4,000 g. Using a "flow-type sand grinder mill (UVM-2)" (manufactured by Imex K.K.) where 1.7 λ of zirconia beads (diameter: 0.5 mm) were filled, the solution obtained above was pulverized at a discharge rate of 0.5 λ/min and a peripheral speed of 10 m/s for 2 hours. The resulting dispersion was diluted to have a compound concentration of 3 wt % and thereto Compound VI-2 was added at a weight ratio to the dye of 3% (referred to as Dispersion A). This dispersion had an average particle size of 0.45 μm.

Dispersions were prepared in the same as above by varying the kinds of the dye and the dispersion aid and the presence or absence of heat treatment after the preparation of dispersion as shown in Table 3-1 at the preparation of the dye solid fine particle dispersions. In the case of performing a heat treatment, Compound VI-2 was added after the heat treatment.

TABLE 3-1

| Dispersion | Kind of Dye | Dispersion Aid | Heat Treatment (temperature/time) |
|---|---|---|---|
| A | IV-1 | V-12 | not performed |
| B | Comparison | V-12 | not performed |
| C | Comparison | V-12 | 60° C.-5 d |
| D | IV-1 | V-12 | 30° C.-20 d |
| E | IV-1 | V-12 | 40° C.-15 d |
| F | IV-1 | V-12 | 60° C.-5 d |
| G | IV-1 | CMC | 60° C.-5 d |
| H | IV-1 | V-12 | 90° C.-10 h |
| I | I-1 | V-12 | 60° C.-5 d |
| J | I-1 | V-12 | 90° C.-10 h |
| K | II-3 | V-12 | 60° C.-5 d |
| L | III-4 | V-12 | 60° C.-5 d |

(Preparation of Processing Solutions)

As a standard method for processing a cinematic color positive film, a processing process resulting from excluding the first fixing solution step, the water washing bath step subsequent thereto and the sound development step from the Process ECP-2 publicly opened by Eastman Kodak was prepared. The samples manufactured all were exposed to such an image that about 30% of the coated silver amount is developed. After the completion of exposure, the samples were subjected to a continuous processing (running test) until the replenishing amount in the color development bath reached 2 times the tank volume, thereby presenting a state Of the development processing reaching running equilibrium. Process ECP-2:

<Processing Steps>

| | Name of Step | Processing Temperature (° C.) | Processing Time (sec) | Replenishing Amount (ml, per 35 mm–100 ft |
|---|---|---|---|---|
| 1 | Prebath | 27 ± 1 | 10–20 | 400 |
| 2 | Water washing | 27 ± 1 | jet washing | — |
| 3 | Development | 36.7 ± 0.1 | 180 | 690 |
| 4 | Stopping | 27 ± 1 | 40 | 770 |
| 5 | Water washing | 27 ± 3 | 40 | 1200 |
| 6 | First fixing | 27 ± 1 | 40 | 200 |
| 7 | Water washing | 27 ± 3 | 40 | 1200 |
| 8 | Acceleration of bleaching | 27 ± 1 | 20 | 200 |
| 9 | Bleaching | 27 ± 1 | 40 | 200 |
| 10 | Water washing | 27 ± 3 | 40 | 1200 |
| 11 | Drying | | | |
| 12 | Sound development | room temperature | 10–20 | — (coating) |
| 13 | Water washing | 27 ± 3 | 1–2 | — (spraying) |
| 14 | Second fixing | 27 ± 1 | 40 | 200 |
| 15 | Water washing | 27 ± 3 | 60 | 1200 |
| 16 | Rinsing | 27 ± 3 | 10 | 400 |
| 17 | Drying | | | |

Formulation of Processing Solutions

The processing solutions each had a composition shown below per 1.

| Name of Step | Name of Chemicals | Tank Solution | Replenishing Solution |
|---|---|---|---|
| Prebath | Borax | 20 g | 20 g |
| | Sodium sulfate | 100 g | 100 g |
| | sodium hydroxide | 1.0 g | 1.5 g |
| Development | Kodak Anti-Calcium No. 4 | 1.0 ml | 1.4 ml |
| | Sodium sulfite | 4.35 g | 4.50 g |
| | D-3 | 2.95 g | 6.00 g |
| | Sodium carbonate | 17.1 g | 18.0 g |
| | Sodium bromide | 1.72 g | 1.60 g |
| | Sodium hydroxide | — | 0.6 g |
| | Sulfuric acid (7N) | 0.62 ml | — |
| Stopping | Sulfuric acid (7N) | 50 ml | 50 ml |
| Fixing (common in first and second fixing steps) | Ammonium thiosulfate (58%) | 100 ml | 170 ml |
| | Sodium sulfite | 2.5 g | 16.0 g |
| | Sodium hydrogensulfite | 10.3 g | 5.8 g |
| | Potassium iodide | 0.5 g | 0.7 g |
| Acceleration of bleaching | Sodium hydrogen-metasulfite | 3.3 g | 5.6 g |
| | Acetic acid | 5.0 ml | 7.0 ml |
| | PBA-1 (Kodak Persulfate Bleach Accelerator) | 3.3 g | 4.9 g |
| | EDTA-4Na | 0.5 g | 0.7 g |
| Bleaching | Gelatin | 0.35 g | 0.50 g |
| | Sodium persulfate | 33 g | 52 g |
| | Sodium chloride | 15 g | 20 g |
| | Sodium dihydrogen-phosphate | 7.0 g | 10.0 g |
| | Phosphoric acid (85%) | 2.5 ml | 2.5 ml |
| Sound development | Natrosal 250HR | 2.0 g | |
| | Sodium hydroxide | 80 g | |
| | Hexyl glycol | 2.0 ml | |
| | Sodium sulfite | 60 g | |
| | Hydroquinone | 60 g | |
| | Ethylenediamine (98%) | 13 ml | |
| Rinsing | Kodak Stabilizer Additive | 0.14 ml | 0.17 ml |
| | Dearcide 702 | 0.7 ml | 0.7 ml |

Samples 302 to 327 thoroughly the same as Light-Sensitive Material 301 except for the following matters were prepared:

a) an antihalation layer containing a dye solid fine particle dispersion prepared by the preparation method shown in Table 3-1 was provided between the support and the first layer, b) the film pH of the light-sensitive material was varied by adding $H_2SO_4$ and NaOH to the coating solutions for the second and fourth layers, c) a compound represented by formula (XI) was added indiscriminately in an amount of 35 mg/r$^2$ to the coating solutions for the second and fourth layers, and d) the kind of cyan coupler was changed as shown in Table 3-2.

Immediately after the coating, these samples were stored at 40° C. and a relative humidity of 65% for 14 days for the purpose of simulating a long-term aging after the coating, and then evaluated on the following items.

(Sharpness)

Each sample was exposed through an optical wedge for the measurement of sharpness and a B, G or R filter using a sensitometer (Model FW, color temperature of the light source: 3,200K, manufactured by Fuji Photo Film Co., Ltd.) for 1/100 second, and then processed according to Process ECP-2B publicly opened by Eastman Kodak. The sharpness was shown by a spatial frequency (recurrences/mm) giving CTF of 0.8. The larger the value, the higher the sharpness.

(Dependency on Exposure Temperature)

Each sample was subjected to gradation exposure for sensitometry through three color (blue, green, red) filters using a sensitometer (Model FW, color temperature of the light source: 3,200K, manufactured by Fuji Photo Film Co., Ltd.) at 60,000 lux for 1/100 second, and then processed according to Process ECP-2B publicly opened by Eastman Kodak. At this time, the sample temperature on exposure was set to 14° C. or 30° C. and respective sensitometry results were compared. In any color (blue, green, red), the exposure sensitivity at 14° C. was lower than the exposure sensitivity at 30° C., but the sensitivity difference was particularly large in the blue exposure sensitivity (BL). Accordingly, stability against the change in temperature at the exposure was evaluated by the sensitivity difference ΔS of BL.

Assuming that the BL sensitivity in the sensitometry density of 0.7 on exposure at 14° C. is S1 and the BL sensitivity in the sensitometry density of 0.7 on exposure at 30° C. is S2, ΔS=(S2−S1) was calculated as an index for the change in gray balance due to change in the temperature at the exposure. The smaller the ΔS value, the higher the stability against the change in temperature at the exposure.

(Suitability for Simple Processing)

A process was prepared by excluding the prebath step from the above-described Process ECP-2 and difference between the samples through this processing procedure and the samples through Process ECP-2 were examined. The results obtained are shown together in Table 3-2.

TABLE 3-2

| Sample | Resin Back Layer | AH Layer | Compound [XI] | Film pH | Cyan Coupler | Suitability for Simple Processing | Sharpness Y | Sharpness M | Sharpness C | Remarks |
|---|---|---|---|---|---|---|---|---|---|---|
| 301 | provided | none | none | 5.8 | ExC | X | 25 | 33 | 26 | Comparison |
| 302 | none | none | none | 5.8 | ExC | ○ | 11 | 19 | 14 | Comparison |
| 303 | none | A | none | 5.8 | ExC | ○ | 14 | 22 | 16 | Comparison |
| 304 | none | B | none | 5.8 | ExC | ○ | 14 | 23 | 16 | Comparison |
| 305 | none | D | none | 5.8 | ExC | ○ | 15 | 22 | 17 | Comparison |
| 306 | none | H | none | 5.8 | ExC | ○ | 20 | 32 | 23 | Comparison |
| 307 | none | none | XI-5 | 5.8 | ExC | ○ | 12 | 20 | 15 | Comparison |
| 308 | none | none | XI-44 | 5.8 | ExC | ○ | 14 | 20 | 16 | Comparison |
| 309 | none | none | XI-48 | 5.8 | ExC | ○ | 13 | 19 | 16 | Comparison |
| 310 | none | D | XI-5 | 4.0 | ExC | ○ | 15 | 19 | 15 | Comparison |
| 311 | none | A | " | 4.3 | ExC | ○ | 14 | 21 | 16 | Comparison |
| 312 | none | F | " | 4.3 | ExC | ○ | 23 | 35 | 26 | Comparison |

TABLE 3-2-continued

| Sample | Resin Back Layer | AH Layer | Compound [XI] | Film pH | Cyan Coupler | Suitability for Simple Processing | Sharpness Y | M | C | Remarks |
|---|---|---|---|---|---|---|---|---|---|---|
| 313 | none | H | " | 4.3 | ExC | ○ | 24 | 36 | 28 | Comparison |
| 314 | none | B | " | 6.8 | ExC | ○ | 15 | 20 | 16 | Comparison |
| 315 | none | H | " | 6.8 | ExC | ○ | 24 | 36 | 28 | Comparison |
| 316 | none | J | " | 6.8 | ExC | ○ | 24 | 35 | 27 | Comparison |
| 317 | none | E | " | 5.8 | ExC | ○ | 24 | 36 | 27 | Invention |
| 318 | none | F | " | 5.8 | ExC | ○ | 25 | 35 | 28 | Invention |
| 319 | none | H | " | 5.8 | ExC | ○ | 27 | 36 | 27 | Invention |
| 320 | none | I | " | 5.8 | ExC | ○ | 26 | 36 | 27 | Invention |
| 321 | none | H | XI-4 | 5.8 | ExC | ○ | 26 | 37 | 27 | Invention |
| 322 | none | H | XI-47 | 5.8 | ExC | ○ | 27 | 36 | 27 | Invention |
| 323 | none | H | XI-48 | 5.8 | ExC | ○ | 27 | 36 | 27 | Invention |
| 324 | none | H | XI-49 | 5.8 | ExC | ○ | 26 | 36 | 27 | Invention |
| 325 | none | H | XI-5 | 5.8 | Ex1 | ○ | 27 | 37 | 29 | Invention |
| 326 | none | H | XI-48 | 5.8 | Ex1 | ○ | 27 | 37 | 29 | Invention |
| 327 | none | K | XI-5 | 5.8 | Ex1 | ○ | 27 | 37 | 29 | Invention |

The effect of the present invention is apparently seen from the results in Table 3-2.

In Sample 301 having a resin back layer, the black resin back could not be completely removed by the process resulting from excluding the prebath step from Process ECP-2, the sample itself was in turn unevenly blackened and furthermore, other samples could not be completely color developed. Thus, Sample 301 was disadvantageous in the point of suitability for simple processing. Samples other than Sample 301 were free of such a trouble and revealed good suitability for simple processing.

Samples 302 and 307 to 309 having no antihalation layer were deficient in the sharpness and failed in attaining high image quality.

Furthermore, in Samples 303 to 306 and 310 to 316 not having a compound represented by formula (XI) of the present invention or having a light-sensitive material film pH outside the range of the present invention, the high image quality was not obtained or the dependency on exposure temperature was extremely deteriorated, which could not withstand the practical use, and particularly in Samples 306, 312, 313, 315 and 316, the sufficient sharpness was obtained, but the dependency on the exposure temperature was extremely deteriorated.

Also, Samples 310 to 311 and 314 having an antihalation layer not passed through a heat treatment step at 40° C. or more were deficient in the sharpness and failed in attaining high image quality.

Thus, Samples 317 to 327 having an antihalation layer of the present invention, containing a compound represented by formula (XI) of the present invention and having a light-sensitive material film pH within the range of the present invention can first give a silver halide color photographic light-sensitive material having high sharpness, stable in the handling of light-sensitive material in laboratories, namely, against environment (temperature) at the exposure of light-sensitive material, and facilitated in the processing process. It is also apparent that these effects are more intensified when at least one cyan coupler is the coupler represented by formula [C-1].

Example II-2

Samples prepared in Example II-1 were developed through the processing procedure resulting from further omitting the prebath step and the subsequent water washing bath step from the simplified Process ECP-2 used in Example II-1.

In Sample 301, the black resin back was not completely removed and the color development bath was contaminated with carbon particles, prohibiting normal color development of other samples.

Samples 302 to 327 were color developed without any trouble similarly to Example II-1 even by this simplified process and in the same tests as in Example II-1, the same results were obtained.

Samples 328 and 329 were prepared in the same manner as Samples 323 and 325 except for changing the silver halide composition of silver halide emulsion grains in the third and fifth layers from Br/Cl=25/75 to Br/Cl=0.9/99.1 for the emulsion grain in the third layer and to Br/Cl=1.5/98.5 for the emulsion grain in the firth layer, and tested in the same manner. As a result, Samples 328 and 329 were found to have more stable dependency on the exposure temperature than Samples 323 and 325.

Thus, the samples according to the present invention can fully exert the performance even in a simplified process.

Example II-3

Samples 330 to 342 were prepared in the same manner as Samples 317 to 327 prepared in Example II-1 and Sample 328 and 329 prepared in Example II-2, respectively, except that the coated amounts in the first, third and fifth layers were changed to 2.1 times, 1.6 times and 1.3 times, respectively, and tested in the same manner as above. Then, the same results as in Example II-1 were obtained.

Effects of the Invention

According to the present invention, a silver halide color photographic light-sensitive material having high sharpness, stable in the handling of light-sensitive material at laboratories, namely, against environment (temperature) at the exposure of light-sensitive material, and capable of simplifying the processing can be obtained.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material for movie, comprising a support having thereon at least one yellow color-forming light-sensitive silver halide emulsion layer, at least one cyan color-forming light-sensitive silver halide emulsion layer, at least one magenta color-forming light-sensitive silver halide emulsion layer, and at least one light-insensitive non-color forming hydrophilic colloid layer, wherein at least one cyan color-forming silver halide emulsion layer contains at least one cyan dye-forming coupler selected from the compounds represented by the following formula [C-2], and at least one light-insensitive non-color forming hydrophilic colloid layer is positioned between the support and a light-sensitive silver halide emulsion layer most adjacent to the support:

[C-2]

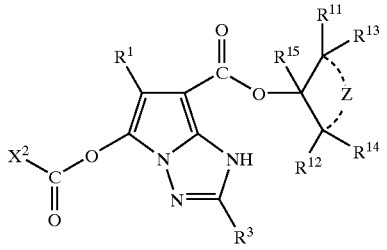

wherein $R^1$ represents an electron attractive group having a Hammetts substituent constant $\sigma_p$ value of 0.20 or more, $R^{11}$, $R^{12}$, $R^{13}$, $R^{14}$ and $R^{15}$, which may be the same or different, each represents hydrogen atom or a substituent, $R^3$ represents hydrogen atom or a substituent, Z represents a non-metallic atom group necessary for forming a 5-, 6-, 7- or 8-membered ring, and $X^2$ represents a heterocyclic group, an unsubstituted or substituted amino group, an aryl group or an alkyl group, wherein at least one non-color forming hydrophilic colloid layer positioned between said support and a light-sensitive silver halide emulsion layer most adjacent to the support contains a solid fine particle dispersion of a dye represented by formula [I]:

$$D—(X)_y \quad [I]$$

wherein

D represents a compound residue having a chromophore,

X represents a dissociative hydrogen atom or a group having a dissociative hydrogen atom, and y represents an integer of from 1 to 7, wherein said solid fine particle dispersion of a dye represented by formula [I] is dispersed using a dispersion aid represented by formula [V-a] or [V-b]:

[V-a]

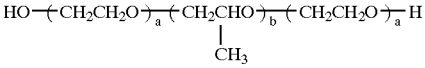

[V-b]

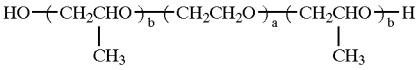

wherein a and b each is a number of from 5 to 500.

2. The silver halide color photographic light-sensitive material for movie as claimed in claim 1, wherein said dye of formula [I] is represented by formula [II] or [III]:

$$A^1{=}L^1{—}(L^2{=}L^3)_m{—}Q \quad [II]$$

wherein $A^1$ represents an acidic nucleus, Q represents an aryl group or a heterocyclic group, $L^1$, $L^2$ and $L^3$ each represents a methane group, and m represents 0, 1 or 2, provided that the compound represented by formula [II] has from 1 to 7 groups selected from the group consisting of a carboxylic acid group, a sulfonamide group, a sulfamoyl group, a sulfonylcarbamoyl group, an acylsulfamoyl group, a phenolic hydroxyl group and an enol group of an oxonol dye, within the molecule;

$$A^1{=}L^1{—}(L^2{=}L^3)_m{—}A \quad [III]$$

wherein $A^1$ and $A^2$ each represents an acidic nucleus, $L^1$, $L^2$ and $L^3$ each represents a methane group, and n represents 1 or 2, provided that the compound represented by formula [III] has from 1 to 7 groups selected from the group consisting of a carboxylic acid group, a sulfonamide group, a sulfamoyl group, a sulfonylcarbamoyl group, an acylsulfamoyl group, a phenollic hydroxyl group and an enol group of an oxonol dye, within the molecule.

3. The silver halide color photographic light-sensitive material for movie as claimed in claim 2, wherein said solid fine particle dispersion of a dye represented by formula [I] is a solid fine particle dispersion of a dye represented by formula [III].

4. The silver halide color photographic light-sensitive material for movie as claimed in claim 1, wherein fine particles in said solid dispersion of a dye represented by formula [I] have an average particle size of from 0.005 to 10 $\mu$m.

5. The silver halide color photographic light-sensitive material for movie as claimed in claim 1, wherein the non-color forming hydrophilic colloid layer containing said solid fine particle dispersion of a dye has a dye content of from 5 to 30 wt % based on the hydrophilic colloid.

6. The silver halide color photographic light-sensitive material for movie as claimed in claim 1, wherein said solid fine particle dispersion of a dye is prepared through a heat treatment step at 400 or more.

7. The silver halide color photographic light-sensitive material for movie as claimed in claim 1, wherein the solid fine particle dispersion of a dye represented by formula [I] is heat-treated at 60° C. or more.

8. The silver halide color photographic light-sensitive material for movie as claimed in claim 1, wherein the solid fine particle dispersion of a dye represented by formula [I] is heat-treated at 40° C. or more after it is dispersed.

9. The silver halide color photographic light-sensitive material for movie as claimed in claim 1, wherein the solid fine particle dispersion of a dye represented by formula [I] is heat-treated at 60° C. or more after it is dispersed.

10. The silver halide color photographic light-sensitive material for movie as claimed in claim 1, wherein the support is a polyester support.

11. A silver halide color photographic light-sensitive material for movie, comprising a transparent support having thereon at least three kinds of light-sensitive hydrophilic colloid layers each containing any one of yellow, magenta and cyan dye-forming couplers and containing silver halide emulsion grains different from each other in the color sensitivity, and at least one light-insensitive hydrophilic colloid layer, wherein any one layer contains at least one compound represented by formula [XI], at least one light-insensitive hydrophilic colloid layer contains a solid fine particle dispersion of a dye represented by formula [I], and said silver halide color photographic light-sensitive material has a film pH of form 4.6 to 6.4:

[XI]

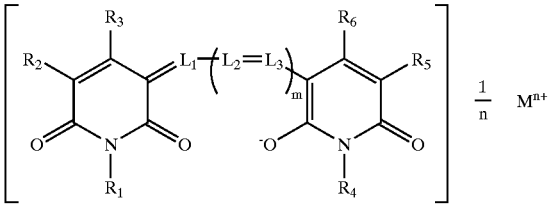

wherein $R_1$ and $R_4$ each independently represents hydrogen atom, an aliphatic group, an aromatic group, a heterocyclic group, —$NR_7R_8$, —$NR_7CONR_7R_8$, —$NR_8COR_9$ or —$NR_8SO_2R_9$, $R_2$ and $R_5$ each independently represents hydrogen atom, an aliphatic group, an aromatic group, a heterocyclic group, a cyano group, a sulfo group, —$NR_7R_8$, —$NR_8COR_9$, —$NR_8SO_2R_9$, —$NR_7CONR_7R_8$, —$CO_2R_7$, —$CONR_7R_8$, —$COR_9$, —$SO_2R_9$ or —$SO_2NR_7R_8$, $R_3$ and $R_6$ each independently represents a hydrogen atom, an aliphatic group, an aromatic group, —$OR_7$, —$CO_2R_7$, —$COR_9$, —$CONR_7R_8$, —$NR_7R_8$, —$NR_8COR_9$, —$NR_8SO_2R_9$, —$NR_7CONR_7R_8$, —$SO_2R_9$, —$SO_2NR_7R_8$ or a cyano group, $R_7$ and $R_8$ each independently represents hydrogen atom, an aliphatic group or an aromatic group, $R_9$ represents an aliphatic group or an aromatic group, $R_7$ and $R_8$ or $R_8$ and $R_9$ may be combined with each other to form a 5- or 6-membered ring, $L_1$, $L_2$ and $L_3$ each independently represents a methine group, m represents 0, 1 or 2, $M^{n+}$ represents a n-valence cation, and n represents 1, 2 or 3:

$$D—(X)_y \quad [I]$$

wherein

D represents a compound residue having a chromophore,

X represents a dissociative hydrogen atom or a group having a dissociative hydrogen atom, and y represents an integer of from 1 to 7, wherein said solid fine particle dispersion of a dye represented by formula [I] is dispersed using a dispersion aid represented by formula [V-a] or [V-b]:

[V-a]

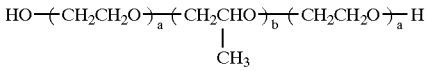

[V-b]

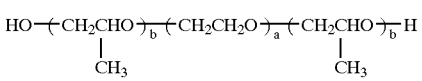

wherein a and b each is a number of from 5 to 500, and wherein the solid fine particle dispersion of a dye represented by formula [I] is heat-treated at 40° C. or more after it is dispersed, with the proviso that the compound represented by formula [XI] is added by any one method of the following items 1) to 4):

1) a method of directly dissolving or dispersing the compound in an emulsion layer or a hydrophilic colloid layer;

2) a method of dissolving or dispersing the compound in an aqueous solution or a solvent and then using the solution in an emulsion layer or a hydrophilic colloid layer;

3) a method of allowing a hydrophilic polymer having a charge opposite to the dye ion to be present in a layer as a mordant and causing localization of the compound in a specific layer by the interaction between the polymer and the dye molecule; and 4) a method of dissolving the compound and then using a surface active agent.

12. The silver halide color photographic light-sensitive material for movie as claimed in claim 11, wherein in formula [XI], $R_1$ and $R_4$ each represents a group having at least one sulfo group or carboxy group, $R_2$ and $R_5$ each represents a cyano group or a substituted or unsubstituted carbamoyl group, and $R_3$ and $R_6$ each represents an aliphatic group or an aromatic group.

13. The silver halide color photographic light-sensitive material for movie as claimed in claim 11, wherein at least one cyan dye-forming coupler is represented by formula [C-1]:

[C-1]

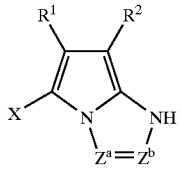

wherein $Z^a$ and $Z^b$ each represents —C($R^3$)═ or —N═, provided that either one of $Z^a$ and $Z^b$ is —N═ and another is —C($R^3$)═, $R^1$ and $R^2$ each independently represents an electron attractive group having a Hammett's substituent constant $\sigma_p$ value of from 0.20 or more, provided that the sum of $\sigma_p$ values of $R^1$ and $R^2$ is 0.65 or more, $R^3$ represents hydrogen atom or a substituent, X represents hydrogen atom or a group capable of splitting off upon coupling reaction with an oxidation product of an aromatic primary amine color developing agent, and the group represented by $R^1$, $R^2$, $R^3$ or X may assume a divalent group and combine with a divalent or greater polymer or a polymer chain to form a homopolymer or a copolymer.

14. The silver halide color photographic light-sensitive material for movie as claimed in claim 13, wherein the cyan dye-forming coupler represented by formula [C-1] is represented by formula [C-2]:

[C-2]

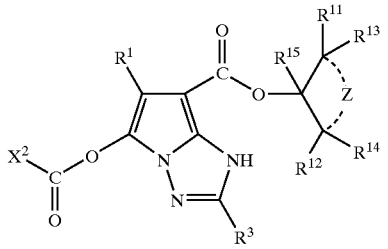

wherein $R^{11}$, $R^{12}$, $R^{13}$, $R^{14}$ and $R^{15}$, which may be the same or different, each represents hydrogen atom or a substituent, $R^3$ represents hydrogen atom or a substituent, and X2 represents hydrogen atom or a substituent.

15. The silver halide color photographic light-sensitive material for movie as claimed in claim 13, wherein the halogen composition of all silver halide emulsion grains contained is silver chlorobromide, silver chloroiodide, silver chloroiodobromide or silver chloride, having a silver chloride content of 90 mol % or more.

16. The silver halide color photographic light-sensitive material for movie as claimed in claim 11, wherein the amount of the compound represented by formula [XI] used in terms of the optical density from 0.05 to 30.

17. The silver halide color photographic light-sensitive material for movie as claimed in claim 11, wherein said solid fine particle dispersion of a dye represented by formula [I] is a solid fine particle dispersion of a dye represented by formula [II] or [III]:

$$A^1{=}L^1{-}(L^2{=}L^3)_m{-}Q \qquad [III]$$

wherein $A^1$ represents an acidic nucleus, Q represents an aryl group or a heterocyclic group, $L^1$, $L^2$ and $L^3$ each represents a methine group, and m represents 0, 1 or 2, provided that the compound represented by formula [II] has from 1 to 7 groups selected from the group consisting of a carboxylic acid group, a sulfonamide group, a sulfamoyl group, a sulfonylcarbamoyl group, an acylsulfamoyl group, a phenolic hydroxyl group and an enol group of an oxonol dye, within the molecule;

$$A^1{=}L^1{-}(L^2{=}L^3)_m{-}A \qquad [III]$$

wherein $A^1$ and $A^2$ each represents an acidic nucleus, $L^1$, $L^2$ and $L^3$ each represents a methine group, and n represents 1 or 2, provided that the compound represented by formula [III] has from 1 to 7 groups selected from the group consisting of a carboxylic acid group, a sulfonamide group, a sulfamoyl group, a sulfonylcarbamoyl group, an acylsulfamoyl group, a phenollic hydroxyl group and an enol group of an oxonol dye, within the molecule.

18. The silver halide color photographic light-sensitive material for movie as claimed in claim 11, wherein said solid fine particle dispersion of a dye represented by formula [I] is a solid fine particle dispersion of a dye represented by formula [IV]:

[IV]

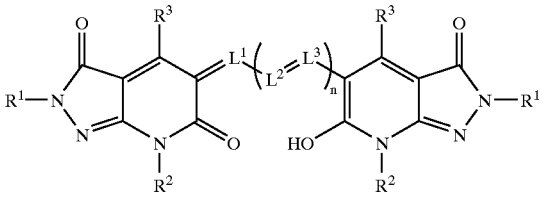

wherein $R^1$ represents hydrogen atom, an alkyl group, an aryl group or a heterocyclic group, $R^2$ represents hydrogen atom, an alkyl group, an aryl group, a heterocyclic group, $—COR^4$ or $—SO_2R^4$, $R^3$ represents hydrogen atom, a cyano group, a hydroxyl group, a a carboxyl group, an alkyl group, an aryl group, $—CO_2R^4$, $—OR^4$, $—NR^5R^6$, $—CONR^5R^6$, $—NR^5COR^4$, $—NR^5SO_2R^4$ or $—NR^5CONR^5R^6$ (wherein $R^4$ represents an alkyl group or an aryl group, and $R^5$ and $R^6$ each represents hydrogen atom, an alkyl group or an aryl group), $L^1$, $L^2$, $L^3$ each represents a methane group, and n represents 1 or 2.

19. The silver halide color photographic light-sensitive material for movie as claimed in claim 11, wherein fine particles in said solid dispersion of a dye represented by formula [I] have an average particle size of from 0.005 to 10 μm.

20. The silver halide color photographic light-sensitive material for movie as claimed in claim 11, wherein the solid fine particle dispersion of a dye represented by formula [I] is heat-treated at 60° C. or more after it is dispersed.

21. The silver halide color photographic light-sensitive material for movie as claimed in claim 11, wherein the support is a polyester support.

22. A silver halide color photographic light-sensitive material for movie, comprising a support having thereon at least one yellow color-forming light-sensitive silver halide emulsion layer, at least one cyan color-forming light-sensitive silver halide emulsion layer, at least one magenta color-forming light-sensitive silver halide emulsion layer, and at least one light-insensitive non-color forming hydrophilic colloid layer, wherein at least one cyan color-forming silver halide emulsion layer contains at least one cyan dye-forming coupler selected from the compounds represented by the following formula [C-2], and at least one light-insensitive non-color forming hydrophilic colloid layer is positioned between the support and a light-sensitive silver halide emulsion layer most adjacent to the support:

[C-2]

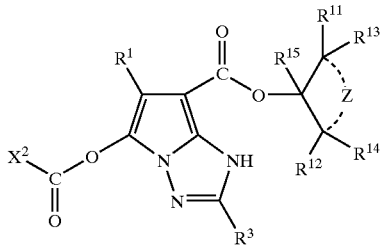

wherein $R^1$ represents an electron attractive group having a Hammett's substituent constant ap value of 0.20 or more, $R^{11}$, $R^{12}$, $R^{13}$, $R^{14}$ and $R^{15}$, which may be the same or different, each represents hydrogen atom or a substituent, $R^3$ represents hydrogen atom or a substituent, Z represents a non-metallic atom group necessary for forming a 5-, 6-, 7- or 8-membered ring, and $X^2$ represents hydrogen atom or a substituent, wherein at least one non-color forming hydrophilic colloid layer positioned between said support and a light-sensitive silver halide emulsion layer most adjacent to the support contains a solid fine particle dispersion of a dye represented by formula [I]:

$$D{-}(X)_y \qquad [I]$$

wherein

D represents a compound residue having a chromophore,

X represents a dissociative hydrogen atom or a group having a dissociative hydrogen atom, and y represents an integer of from 1 to 7, wherein the solid fine particle dispersion of a dye represented by formula [I] is heat-treated at 60° C. or more after it is dispersed.

23. The silver halide color photographic light-sensitive material for movie as claimed in claim 22, wherein $X^2$ represents a heterocyclic group, an unsubstituted or substituted amino group, an aryl group or an alkyl group.

24. A silver halide color photographic light-sensitive material for movie, comprising a transparent support having thereon at least three kinds of light-sensitive hydrophilic colloid layers each containing any one of yellow, magenta and cyan dye-forming couplers and containing silver halide emulsion grains different from each other in the color sensitivity, and at least one light-insensitive hydrophilic colloid layer, wherein any one layer contains at least one compound represented by formula [XI], at least one light-insensitive hydrophilic colloid layer contains a solid fine particle dispersion of a dye represented by formula [I], and said silver halide color photographic light-sensitive material has a film pH of form 4.6 to 6.4:

[XI]

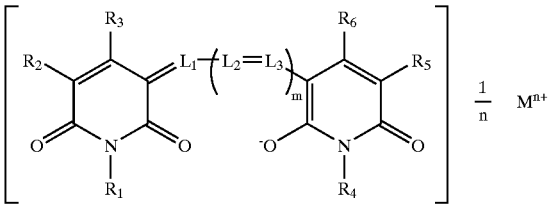

wherein $R_1$ and $R_4$ each independently represents hydrogen atom, an aliphatic group, an aromatic group, a heterocyclic group, —$NR_7R_8$, —$NR_7CONR_7R_8$, —$NR_8COR_9$ or —$NR_8SO_2R_9$, $R_2$ and $R_5$ each independently represents hydrogen atom, an aliphatic group, an aromatic group, a heterocyclic group, a cyano group, a sulfo group, —$NR_7R_8$, —$NR_8COR_9$, —$NR_8SO_2R_9$, —$NR_7CONR_7R_8$, —$CO_2R_7$, —$CONR_7R_8$, —$COR_9$, —$SO_2R_9$ or —$SO_2NR_7R_8$, $R_3$ and $R_6$ each independently represents a hydrogen atom, an aliphatic group, an aromatic group, —$OR_7$, —$CO_2R_7$, —$COR_9$, —$CONR_7R_8$, —$NR_7R_8$, —$NR_8COR_9$, —$NR_8SO_2R_9$, —$NR_7CONR_7R_8$, —$SO_2R_9$, —$SO_2NR_7R_8$ or a cyano group, $R_7$ and $R_8$ each independently represents hydrogen atom, an aliphatic group or an aromatic group, $R_9$ represents an aliphatic group or an aromatic group, $R_7$ and $R_8$ or $R_8$ and $R_9$ may be combined with each other to form a 5- or 6-membered ring, $L_1$, $L_2$ and $L_3$ each independently represents a methine group, m represents 0, 1 or 2, $M^{n+}$ represents a n-valence cation, and n represents 1, 2 or 3:

$$D—(X)_y \qquad [I]$$

wherein

D represents a compound residue having a chromophore,

X represents a dissociative hydrogen atom or a group having a dissociative hydrogen atom, and y represents an integer of from 1 to 7, wherein the solid fine particle dispersion of a dye represented by formula [I] is heat-treated at 60° C. or more after it is dispersed, with the proviso that the compound represented by formula [XI] is added by any one method of the following items 1) to 4):

1) a method of directly dissolving or dispersing the compound in an emulsion layer or a hydrophilic colloid layer;

2) a method of dissolving or dispersing the compound in an aqueous solution or a solvent and then using the solution in an emulsion layer or a hydrophilic colloid layer;

3) a method of allowing a hydrophilic polymer having a charge opposite to the dye ion to be present in a layer as a mordant and causing localization of the compound in a specific layer by the interaction between the polymer and the dye molecule; and 4) a method of dissolving the compound and then using a surface active agent.

* * * * *